US011324984B2

(12) United States Patent
KashKash et al.

(10) Patent No.: US 11,324,984 B2
(45) Date of Patent: May 10, 2022

(54) RESISTANCE BAND EXERCISE MACHINE

(71) Applicant: OK Engineering Inc, Palm Harbor, FL (US)

(72) Inventors: Omar Ismail KashKash, Palm Harbor, FL (US); Yousef Ismail KashKash, Palm Harbor, FL (US)

(73) Assignee: OK Engineering Inc., Palm Harbor, FL (US)

( * ) Notice: Subject to any disclaimer, the term of this patent is extended or adjusted under 35 U.S.C. 154(b) by 0 days.

(21) Appl. No.: 16/916,093

(22) Filed: Jun. 29, 2020

(65) Prior Publication Data

US 2021/0402242 A1 Dec. 30, 2021

(51) Int. Cl.

| | |
|---|---|
| ***A63B 21/04*** | (2006.01) |
| ***A63B 21/055*** | (2006.01) |
| ***A63B 21/28*** | (2006.01) |
| ***A63B 21/02*** | (2006.01) |
| ***A63B 21/00*** | (2006.01) |

(Continued)

(52) U.S. Cl.

CPC ..... *A63B 21/0442* (2013.01); *A63B 21/022* (2015.10); *A63B 21/023* (2013.01); *A63B 21/0552* (2013.01); *A63B 21/154* (2013.01); *A63B 21/285* (2013.01); *A63B 21/4007* (2015.10); *A63B 23/1236* (2013.01); *A63B 21/0023* (2013.01); *A63B 21/4005* (2015.10); *A63B 21/4035* (2015.10); *A63B 2208/0257* (2013.01)

(58) Field of Classification Search

CPC ..... A63B 21/0442; A63B 21/154; A63B 21/4007; A63B 21/281; A63B 21/022; A63B 21/0552; A63B 21/023; A63B 21/4035; A63B 21/4005; A63B 21/0023; A63B 21/00058–00065; A63B 21/02–0442; A63B 21/05–0557; A63B 21/065; A63B 21/15–154; A63B 21/285; A63B 21/4001; A63B 21/4009; A63B 23/1227–1236; A63B 2008/0257

See application file for complete search history.

(56) References Cited

U.S. PATENT DOCUMENTS 2,593,624 A * 4/1952 Stevens ..... A63B 23/12 606/237
4,241,914 A * 12/1980 Bushnell ..... A63B 1/00 482/130
4,492,375 A 1/1985 Connelly
(Continued)

*Primary Examiner* — Garrett K Atkinson
*Assistant Examiner* — Kathleen M Fisk
(74) *Attorney, Agent, or Firm* — Nicholas Pfeifer; Smith & Hopen, P. A.

(57) ABSTRACT

A resistance band exercise machine for performing various exercises. An embodiment includes a housing for a cable-pulley variable resistance system. The cable-pulley variable resistance system is configured to receive one or more safety bars to set a starting position of an exercise. Some embodiments include a training partner assistantship feature for a training partner to assist the user by imparting a secondary force on the machine. The configuration of the cable-pulley variable resistance system may be in any manner based on the exercise. A user performs an exercise on the resistance band exercise machine to overcome a primary (resistance band) and secondary (springs) sources of variably increasing resistance from the cable-pulley variable resistance system.

15 Claims, 64 Drawing Sheets

(51) Int. Cl.
*A63B 23/12* (2006.01)
*A63B 21/002* (2006.01)

(56) References Cited

U.S. PATENT DOCUMENTS 4,531,727 A * 7/1985 Pitre ..... A63B 21/06 482/101
4,540,171 A 9/1985 Clark et al.
4,546,971 A 10/1985 Raasoch
4,561,651 A * 12/1985 Hole ..... A63B 21/06 482/102
4,606,539 A * 8/1986 Farnham ..... A63B 21/0023 482/148
4,620,704 A 11/1986 Shifferaw
4,627,615 A 12/1986 Nurkowski
4,953,855 A 9/1990 Shields
4,998,723 A * 3/1991 Santoro ..... A63B 21/078 482/104
5,106,079 A * 4/1992 Escobedo ..... A63B 21/0615 482/137
5,328,429 A 7/1994 Potash et al.
5,669,861 A 9/1997 Toups
5,924,965 A * 7/1999 Vardy ..... A63B 21/0083 482/112
6,447,431 B1 9/2002 Milburn et al.
7,588,521 B1 * 9/2009 Fazzari ..... A63B 21/06 482/141
8,152,700 B2 * 4/2012 Adams ..... A63B 23/0355 482/94
9,616,274 B2 * 4/2017 Wehrell ..... A63B 21/4009
9,656,116 B2 5/2017 Giannelli et al.
10,016,646 B2 * 7/2018 Butler ..... A63B 21/00065
10,052,517 B2 * 8/2018 Critelli ..... A63B 21/068
10,226,665 B2 * 3/2019 Kordecki ..... A63B 23/0216
10,369,398 B2 8/2019 Lagree et al.
10,639,515 B2 * 5/2020 Simmons ..... A63B 23/03566
11,058,909 B2 * 7/2021 Adams ..... A63B 21/4009
2002/0098959 A1 * 7/2002 Florek ..... A63B 23/12 482/141
2004/0097352 A1 * 5/2004 Bergman ..... A63B 21/00181 482/141
2004/0242388 A1 * 12/2004 Kusminsky ..... A63B 21/015 482/131
2006/0199706 A1 * 9/2006 Wehrell ..... A63B 21/4019 482/92
2006/0252611 A1 11/2006 Quick et al.
2011/0275499 A1 * 11/2011 Eschenbach ..... A63B 21/00181 482/141
2013/0123081 A1 * 5/2013 Boland ..... A63B 21/023 482/141
2014/0357460 A1 * 12/2014 Sorace ..... A63B 21/0552 482/141
2019/0175985 A1 * 6/2019 Chapman ..... A63B 21/0059
2019/0374814 A1 * 12/2019 KashKash ..... A63B 1/00
2020/0324159 A1 * 10/2020 Roncone ..... A63B 21/151
2021/0001163 A1 * 1/2021 Ozgun ..... A63B 21/4047

* cited by examiner

RESISTANCE BAND EXERCISE MACHINE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILLING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to weightlifting machines with weight stack systems to provide an increasingly variable load over the concentric range of the exercise and provide assistantship to perform a variably decreasing overload over the eccentric range of the exercise.

2. Background Art

The following is a tabulation of some prior art that presently appears relevant:

| U.S. Pat. No. | | | |
|---|---|---|---|
| Pat. No. | Kind Code | Issue Date | Patentee |
| 4,492,375 | A | Jan. 8, 1985 | Richard Connelly |
| 4,620,704 | A | Nov. 4, 1986 | Tessema Shifferaw |
| 4,546,971 | A | Oct. 15, 1985 | Paul Raasoch |
| 5,328,429 | A | Jul. 12, 1994 | Potash et al. |
| 9,656,116 | B2 | May 23, 2017 | Giannelli et al. |
| 5,669,861 | A | Sep. 23, 1997 | Lanny Toups |
| 4,953,855 | A | Sep. 4, 1990 | William Shields |
| 6,447,431 | B1 | Sep. 10, 2002 | Milburn et al. |
| 10,369,398 | B2 | Aug. 6, 2019 | Lagree et al. |
| 4,627,615 | A | Dec. 9, 1986 | Paul Nurkowski |
| 4,540,171 | A | Sep. 10, 1985 | Clark et al. |

| U.S. Patent Application Publications | | | |
|---|---|---|---|
| Publication Nr. | Kind Code | Publ. Date | Applicant |
| 20060252611 | A1 | Nov. 9, 2006 | Quick et al. |

Muscle groups have strength curves in which they can exert a maximum force output due to a mechanical advantage at a particular position or range along its motion.

Resistance applied to the strong range of an exercise motion or muscle group will allow for the greatest amount of resistance to be used and it will develop the muscles, tendons, ligaments, and bones at a faster rate than if the resistance was only applied to the weak range of an exercise motion or muscle group. The amount of resistance capable of being handled over the strong range of an exercise motion or muscle group is disproportionately greater than the amount of resistance capable of being handled over the weak range due to a mechanical advantage of the limbs involved during the exercise. As such it is desirable to increase the amount of resistance applied over the strong range of motion for an exercise motion or muscle group during the concentric phase of the exercise as well as the eccentric phase of the exercise. Moreover, yielding isometrics in which you withstand a heavy resistance preferably as you hold a strong position for time is desirable for producing a high force output. Lastly, overcoming isometrics allows for the maximum force possible to be generated for an exercise motion or muscle group because you attempt to overcome a high level of resistance such as an immovable object as you assume a strong position preferably. This is true because of the inverse relationship between the force developed by a muscle or group of muscles and the velocity of an external load. Simply, the faster you move an external load the less force you can develop and the slower the external load moves the more force you can develop. In view of the above it is desirable to vary the resistance increasingly along the concentric and eccentric ranges of the exercise to match the strength curves of the muscle groups involved as many existing weightlifting machines with weight stack systems do not provide this benefit as the primary source of resistance. There are weightlifting machines with secondary sources of variably increasing resistance, but they are limited as they are called supplementary for a good reason. For example, secondary sources of variably increasing resistance will usually provide a low amount of resistance to supplement the primary source of resistance to allow for an incremental progression for the total amount of resistance selected. As such the weightlifter must handle the fixed amount of primary resistance throughout the range of motion which does not allow the weightlifter to handle their maximum amount of resistance during the strong range of motion. Usually, the resistance is increasingly varied over the concentric and eccentric phases of an exercise by using a gravitational mass such as a weight stack system and resilient materials such as elastic bands or torsional springs in combination or alone. Sometimes electromechanical devices are used to provide increasingly variable resistance. In U.S. Pat. No. 4,546,971 to Paul Raasoch (1985) a user exercises the muscles of the human body by movement through an exercise stroke in which concentric and eccentric weights are selected to provide exertion to a bodily muscle function. In U.S. Pat. No. 5,328,429 to Potash et al. (1994) an attachment for a weight stack provides a downward force to the weight stack during the eccentric portion of the exercise through the use of a drive motor and an eccentric force control cable adopted to be coupled between the drive motor and the weight stack. In U.S. Pat. No. 5,669,861 to Lanny J. Toups (1997) a weight device creates a controlled and infinitely variable resistance by multiplying the weight selected on a weight stack over the concentric portion of the exercise. The device provides isokinetic and isotonic resistance. A device that multiplies the selected weight amount on the weight stack to provide increasingly variable resistance over the concentric portion of the exercise. In U.S. Pat. No. 4,953,855 to William D. Shields (1990) a split phase cam machine uses a cam split into two distinct phases and an independent weight stack for each phase of the cam. The weight stacks are labeled "starting" and "finishing" to allow for the performance of the "peak contraction" technique where a user selects less weight for the "starting" weight stack and more weight as needed to the "finishing" weight stack to forcefully squeeze the muscles when fully contracted and to hold this position for a few seconds. In U.S. Pat. No. 9,656,116 to Giannelli et al. (2017) a first and second force resistance device is provided. The first being a weight stack and the second being a rotating wheel as an actuating device that is acted upon by the first resistance and the user's speed, velocity, force, energy, or power thereby causing the second resistance device to exert a second resistance that is non-linear (geometrically or exponentially) in proportion to the degree of effort done by the user. In U.S. Pat. No. 6,447,431 to Millburn et al. (2002) a device for retrofitting onto or incorporating into a conventional weightlifting machine is provided. A load tank replaces or supplements a number of weight plates in a conventional weight stack, while a charge tank rests on the floor proximal to the weightlifting machine. A fluid control means is provided for alternatively filling the load tank with water stored in the charge tank and draining the fluid back into the charge tank from the load tank, as desired in proportion to the muscle fatigue of the weightlifter. This invention is based on the premise that weightlifting machines are commonly used in resistance training, where the amount of weight is fixed at an amount less than the weightlifting capacity of the weightlifter. As the weightlifter progresses through his repetitions, the muscles eventually fatigue. The muscles generally reach their capacity only during the last few repetitions. Thus, several sets of repetitions can be necessary for appropriate muscle building, making the first few repetitions wasteful. Therefore, this invention attempts to reduce or eliminate the initial, inefficient repetitions by employing a system that begin at a weight at the weightlifter's capacity, and reduce the amount of weight throughout the exercise. In U.S. patent application publication 20060252611 to Quick et al. (2006) an exercise machine with bench press, weight stack, and elastic bands provide variable resistance during the concentric contraction. Pushing motion on the bench press bar transmits the force to a series of wheels connected by flexible bands and to a pair of weight stacks positioned behind the bench press. The weight members of the weight stack are connected by pins such that an upward movement of the uppermost weight members causes a pulling force to be applied to successive lower weight members one at a time, thereby allowing incremental increase in the resistance force to the lifting motion of the user. Depending on the strength of the user, elastic bands are used because weight plates often jump from 5 to 10 pounds without the possibility for an increment in weight in between. In U.S. Pat. No. 10,369,398 to Lagree et al (2019) an improved exercise machine with a variable resistance system to provide increasing resistance over the concentric portion of an exercise is provided. The improved exercise machine improves upon Pilates apparatuses by making the selection of variable resistance level clear to the user for continuous uninterrupted exercise. In addition, the direction of variable resistance can be changed immediately to provide the exerciser with another exercise to perform for circuit training benefits. The variable resistance system can be applied to strength training machines such as a pull down and shoulder press combination to optimize the circuit training benefits because of time saved from having to move from one apparatus to another and selecting the desired resistance level which often requires set up time. In U.S. Pat. No. 4,627,615 to Nurkowski (1986) a progressive resistance mechanism suitable for use with a weightlifting machine provides increasingly variable resistance over the concentric portion of the exercise. The progressive resistance mechanism uses two or more weight stacks that are selectively and independently engaged having a selector post through each weight stack. Each selector post has a first pin for selecting a subset of weights and at least one selector post has a second pin for locking a slidable collar at selected distances along the post above the carriage. The upward-travelling carriage engages the various pre-set collars in sequence to lift the associated selector posts. The weight stacks depending from the selector posts are thus serially engaged during the course of a single user repetition. In U.S. Pat. No. 4,620,704 to Shifferaw (1986) an exercise machine for muscle building uses resilient rods which are flexed and resist movement of a person using the machine to provide increasingly variable resistance over the concentric portion of the exercise. In U.S. Pat. No. 4,492,375 to Richard E. Connelly (1985) an exercise apparatus provides variably increasing resistance to the concentric range of the exercise by using elastic bands or torsional springs. In U.S. Pat. No. 4,540,171 to Clark et al (1985) an apparatus for muscular exercise is provided where the user conducts a repetitive motion under load with the eccentric range of the exercise being loaded with more load than the concentric range of the exercise.

For Raasoch's disclosure, it requires more weight stack space, more weight stack plates, and cannot be incorporated towards existing weight stack systems found on weightlifting machines without a significant change to the mechanical parts and/or its assembly. For Potash's et al. disclosure, it does not provide increasingly variable resistance over the concentric portion of the exercise. For Toups's disclosure, it requires weight stack plates as the primary source of resistance. For Shields's disclosure, it requires at least two independent weight stack plates to create an increasingly variable resistance over the concentric range of motion. For Giannelli's et al. disclosure, it requires weight stack plates and a rotating wheel device as an actuating device to create the variable resistance in proportion to the degree of effort done by the user. For Millburn's et al. disclosure, it does not provide increasingly variable resistance over the concentric portion of the exercise. For Quick's et al. disclosure, it applies to a bench press machine with a free moving barbell and it does not apply to strength training machines with moving handles that move in a fixed path with a weight stack and cable pulley system. For Lagree's disclosure, it does not provide supplementary resistance in 5 Pound increments or any amount of resistance between 0 and 10 (i.e. 0.5 lb, 2 lbs, 1 lb, etc). So, incremental progression of 5 pounds are not possible and it will cause a significant limitation for a weightlifter's progress with the resistance level used. It cannot be incorporated towards existing weight stack systems found on weightlifting machines without a significant change to the mechanical parts and/or its assembly. For Nurkowski's disclosure, it requires at least two or more independent weight stacks to provide increasingly variable resistance over the concentric range of the motion. For Shifferaw's disclosure, it cannot be incorporated into the existing weight stack housing frames of weightlifting machines. For Connelly's disclosure, it cannot be incorporated into weightlifting machines utilizing a weight stack with cable pulley system along with the other mechanical parts known in the art. For Clark's disclosure, it does not provide variably increasing resistance over the concentric range of the exercise.

These disclosures heretofore known suffer from a few disadvantages:

(a) One cannot selectively select a primary source of variable resistance that is as inexpensive as elastic bands to provide more resistance towards the end of the motion where there is a mechanical advantage for the limbs involved to develop the muscles, tendons, ligaments, and bones at a faster rate than if most of the resistance was applied during the first half of the exercise motion.

(b) One cannot selectively add incremental resistance to a primary source of variably increasing resistance such as elastic bands to provide incremental progression of the resistance used to promote adding small amounts of resistance consistently over time as the way to progress a weightlifter's strength as the primary factor with the addition of repetitions and sets as the secondary factor when needed.

(c) One cannot utilize the ergonomic/biomechanical design features of weightlifting machines with weight stack and cable pulley systems while using a primary source of variably increasing resistance that is as cheap as elastic bands and perform assisted negative repetitions with variably decreasing resistance over the eccentric range of the motion.

(d) One cannot utilize the ergonomic/biomechanical design features of weightlifting machines with weight stack and cable pulley systems while using a primary source of variably increasing resistance such as elastic bands and have an exercise range of motion feature for performing yielding isometrics and overcoming isometrics for added exercise intensity and variation of training routine.

BRIEF SUMMARY OF THE INVENTION

In accordance with one embodiment a resistance band exercise machine comprises a cable-pulley variable resistance system housing, a cable-pulley variable resistance system, a pair of uprights with a safety bar inserted into a safety bar hole, and a training partner assistantship cable-pulley system or a training partner assistantship feature of having an input lifting arm with a handle grip and/or a shoulder padding for a user to perform various exercises against a primary (resistance band) and secondary (springs) sources of variably increasing resistance, resistance band with isometrics using safety bars, and perform more full/partial range of motion negative repetitions through variably decreasing resistance with the help of a training partner.

Advantages

Accordingly, several advantages of one or more aspects are as follows: to provide a resistance band exercise machine with a cable-pulley variable resistance system that enables a user wearing a harness or belt to perform push-up exercises in the prone position with their hands on the platform with primary variably increasing resistance and to quickly change the resistance independently, that enables a user to perform push-up exercises with primary variably increasing resistance using partial range of motion, that enables a user to perform push-up exercises with primary variably increasing resistance through a range of motion and perform isometrics against a safety bar, that enables a user to perform push-up exercises with primary variably increasing resistance through full/partial range of motion negative repetitions using a training partner, that enables a user to perform push-up exercises with primary source of variably increasing resistance from start to end position of an exercise and secondary source of variably increasing resistance towards end position of an exercise. These advantages will be apparent from a consideration of the drawings and ensuing descriptions.

BRIEF DESCRIPTION OF THE SEVERAL VIEWS OF THE DRAWINGS

In the drawings, closely related figures have the same number but different alphabetic suffixes.

DETAILED DESCRIPTION OF THE INVENTION—FIGS. 1A AND 1P

The word "exemplary" is used herein to mean "serving as an example, instance, or illustration." Any embodiment or design described herein as "exemplary" is not necessarily to be construed as preferred or advantageous over other embodiments or designs.

Figure 1A:
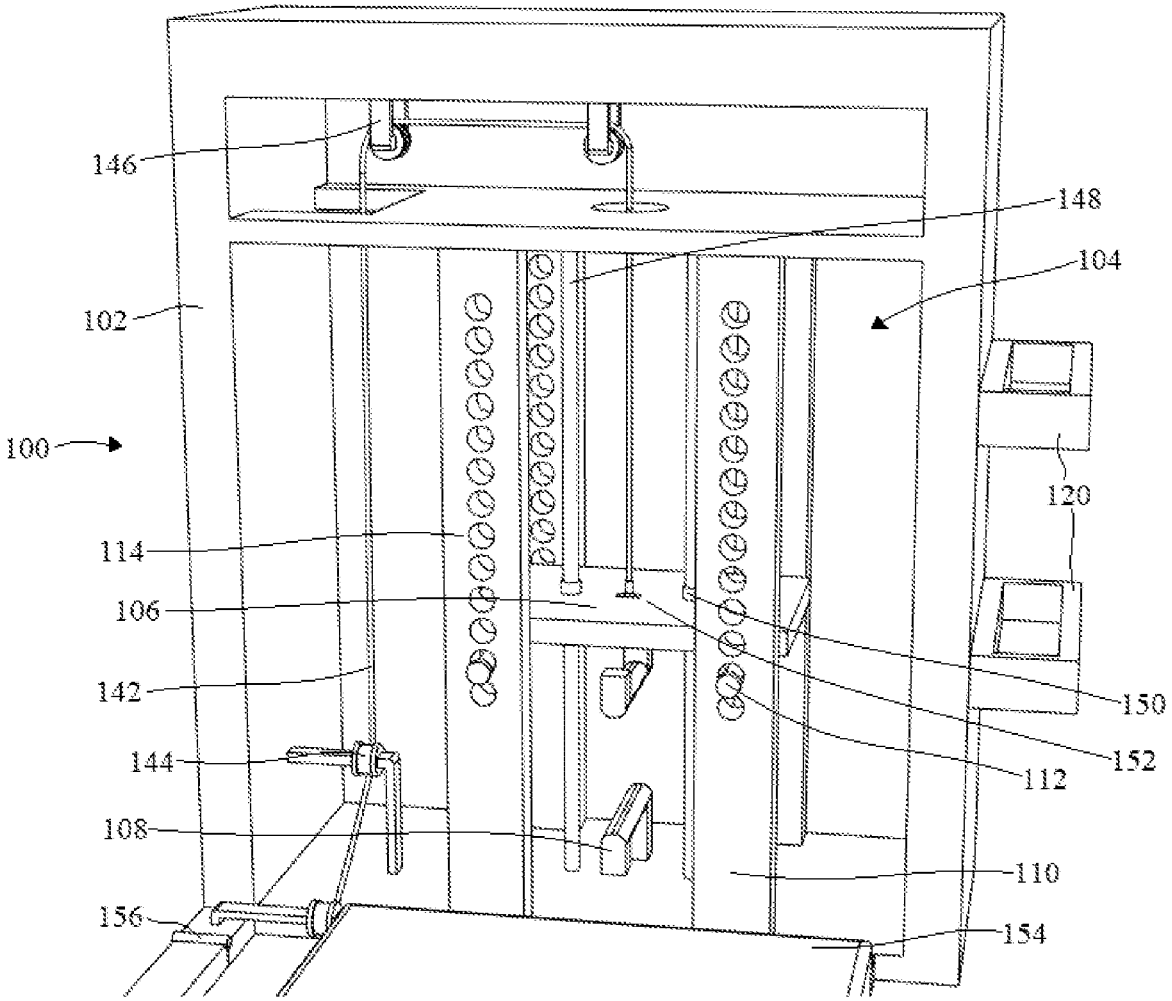
FIGS. 1A to 1E show a perspective view of resistance band exercise machine and in start position of an exercise's range of motion in accordance with one embodiment.
Figure 1B:
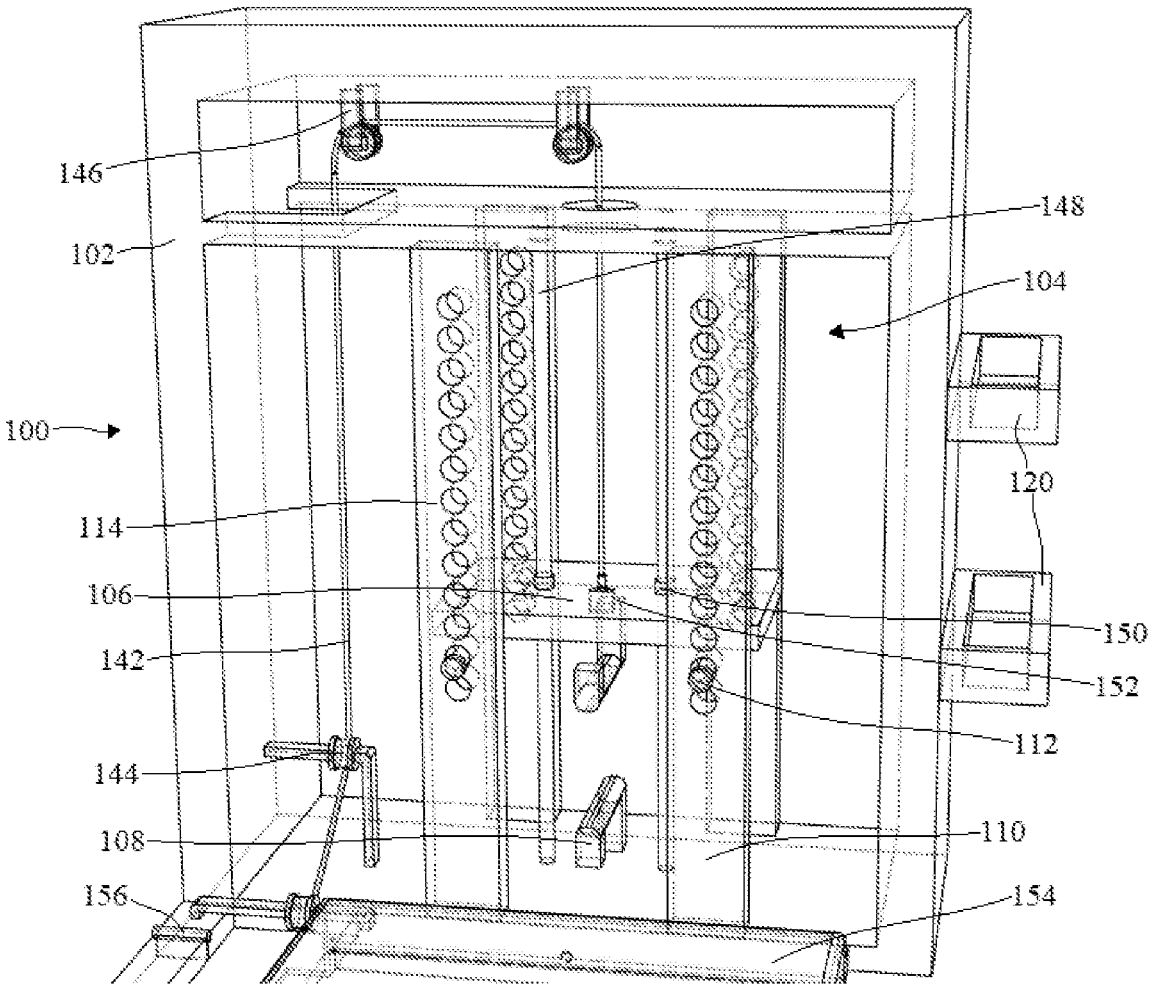
Figure 1C:
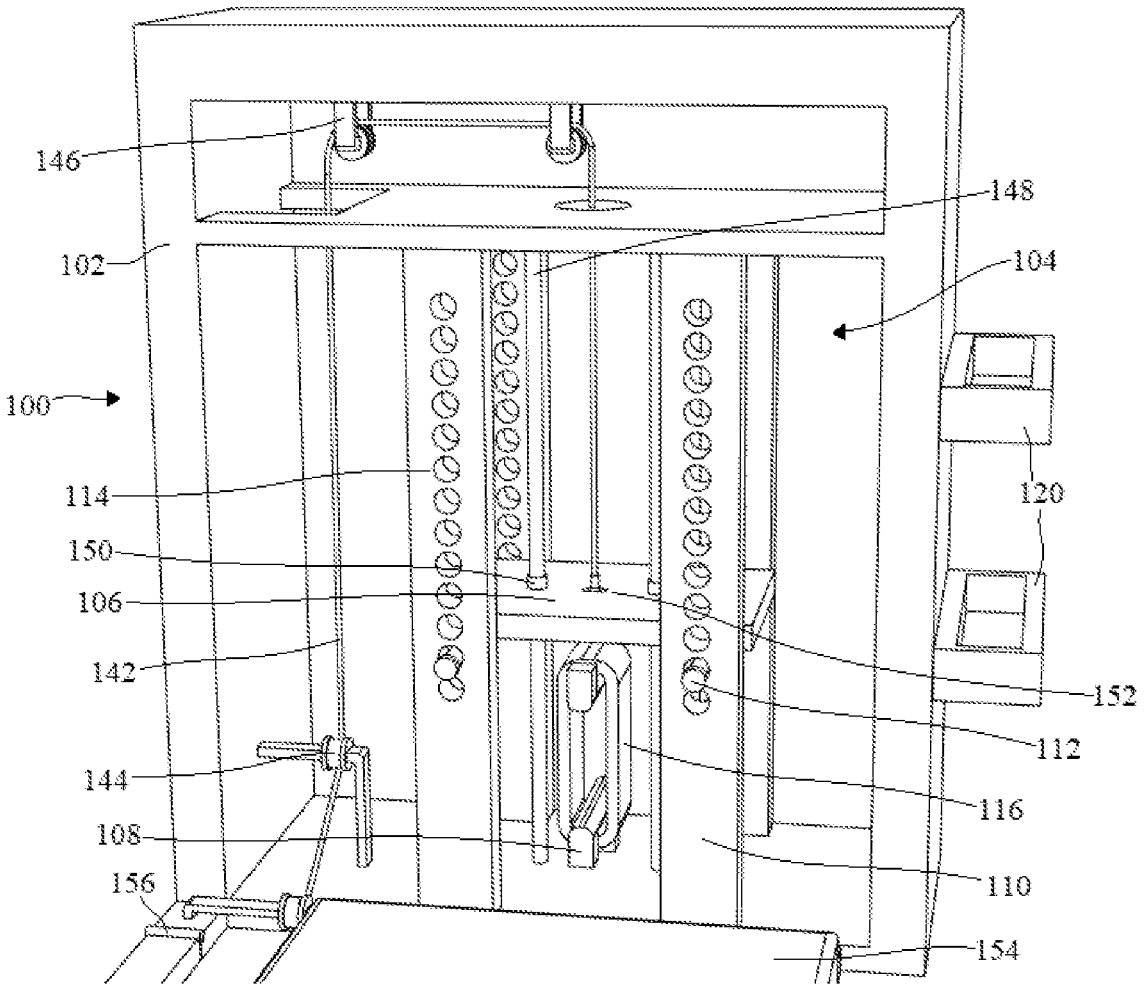
Figure 1D:
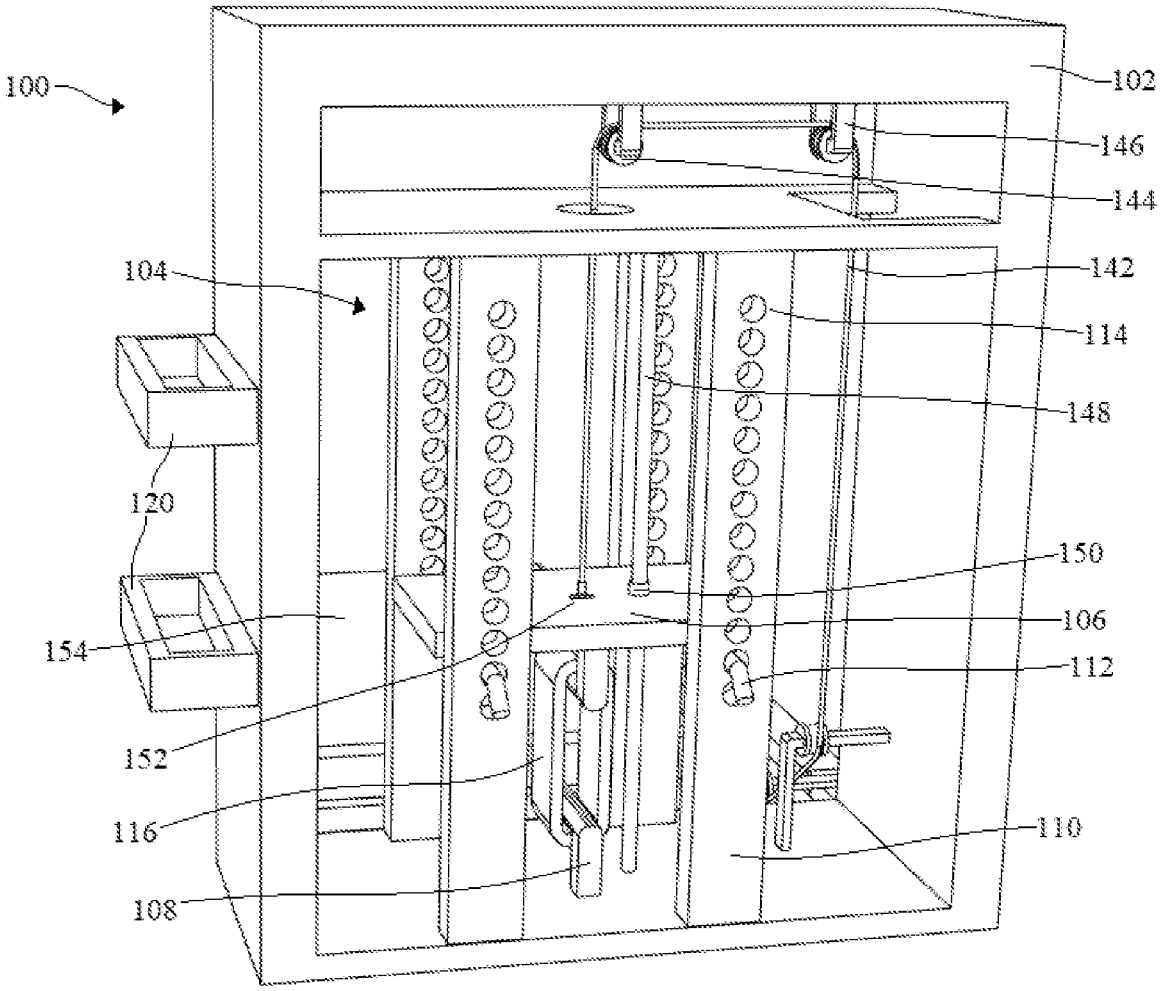
Figure 1E:
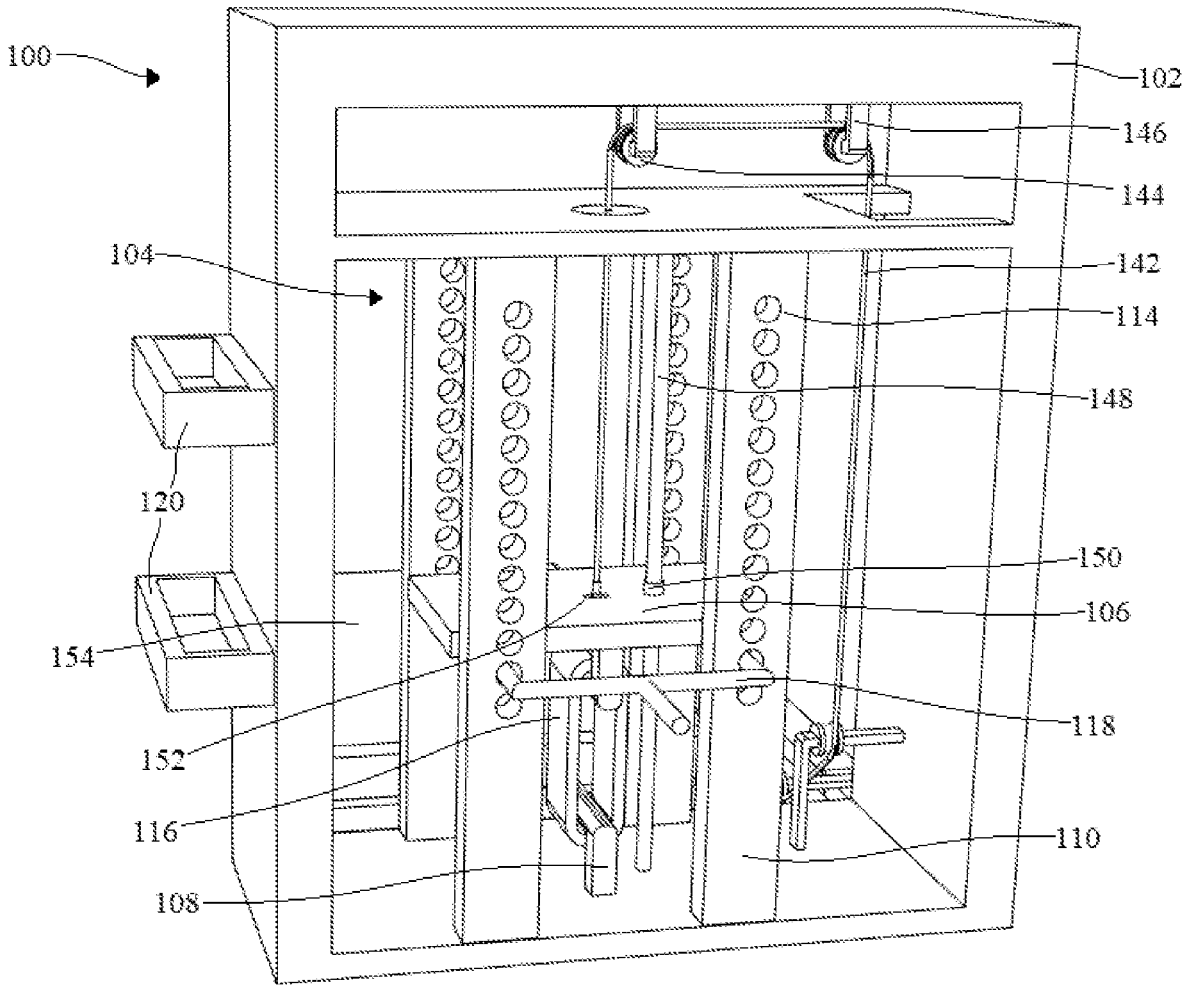
Figure 1F:
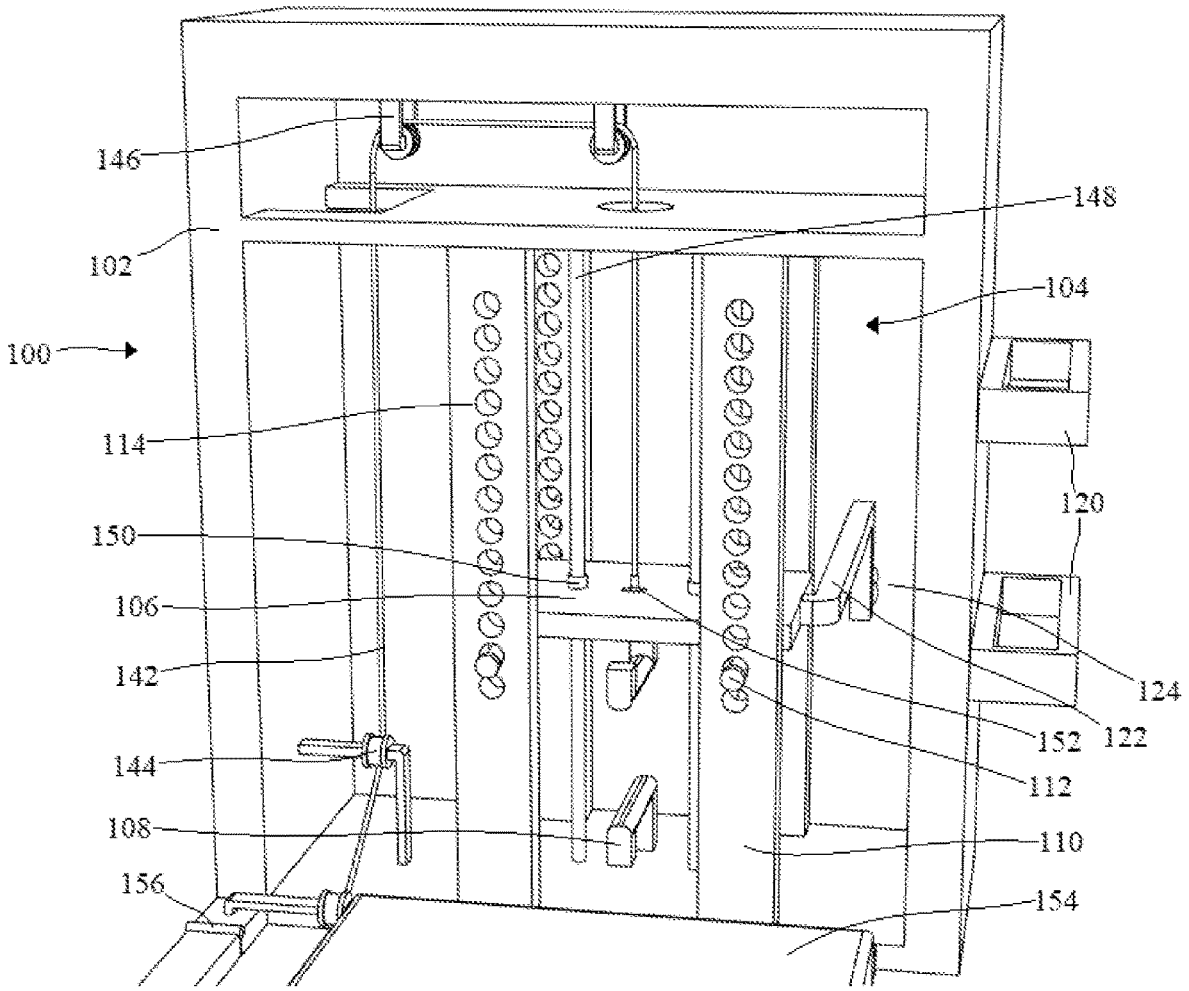
FIGS. 1F to 1L show a perspective view of resistance band exercise machine and in start position of an exercise's range of motion in accordance with another embodiment.
Figure 1G:
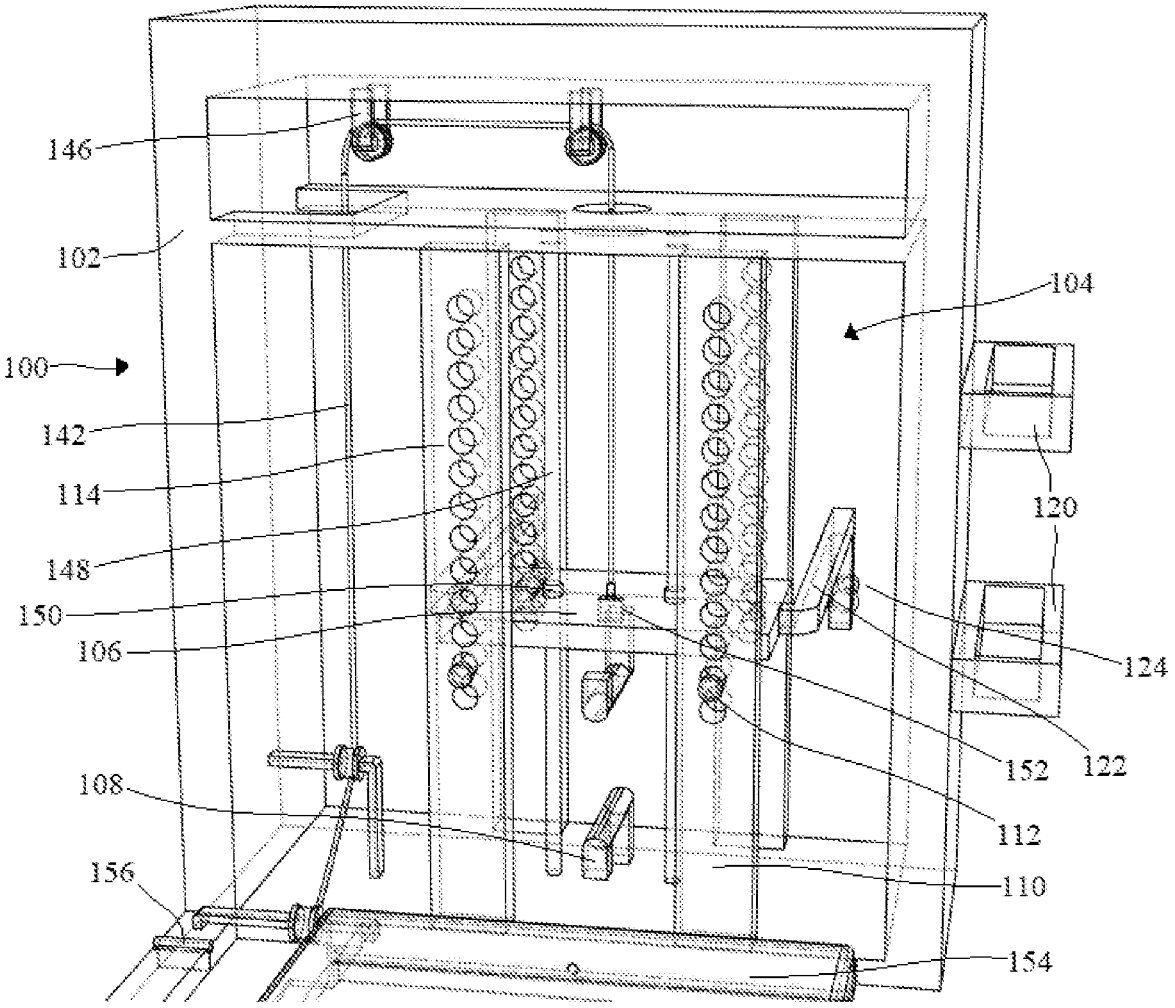
Figure 1H:
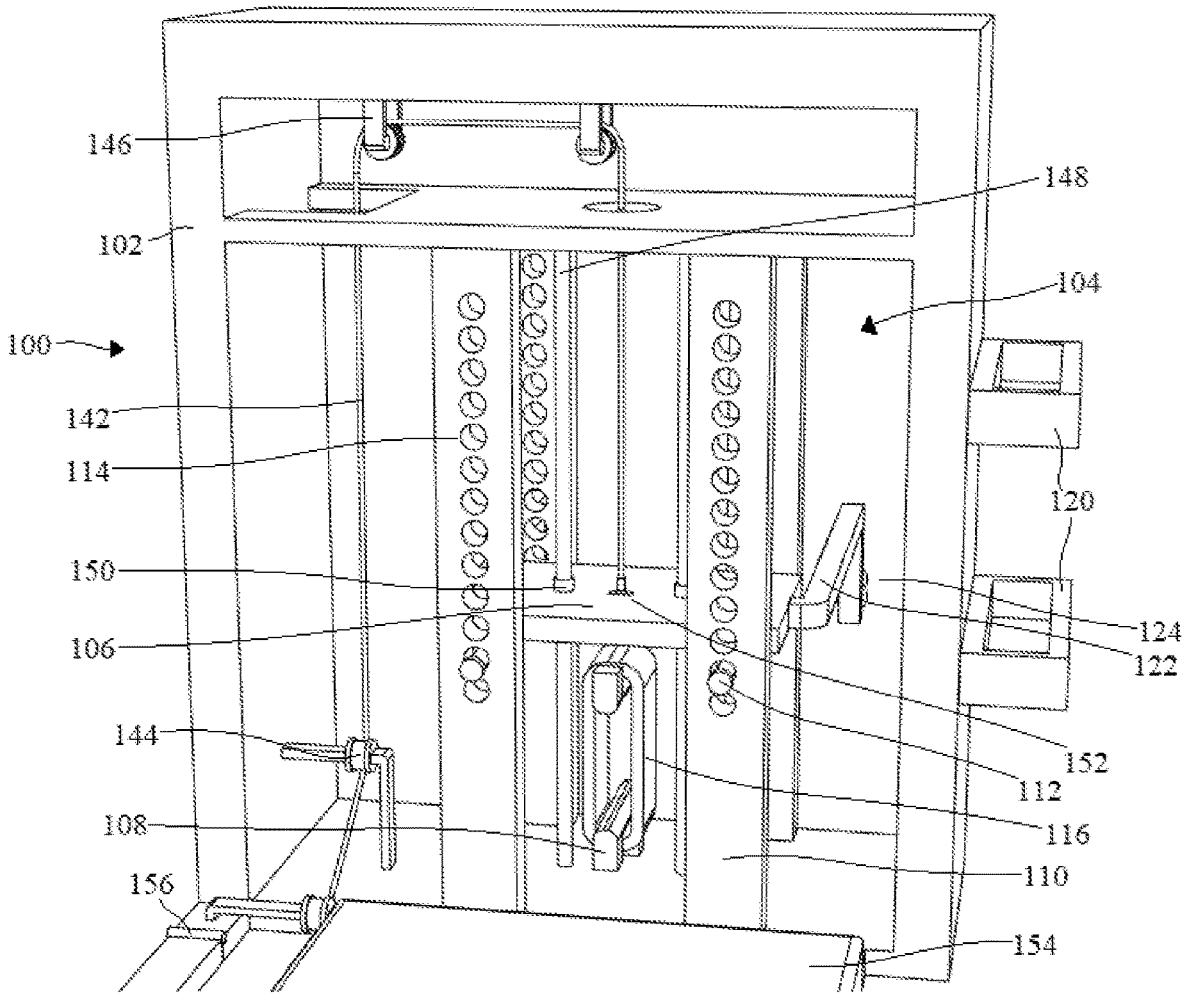
Figure 1I:
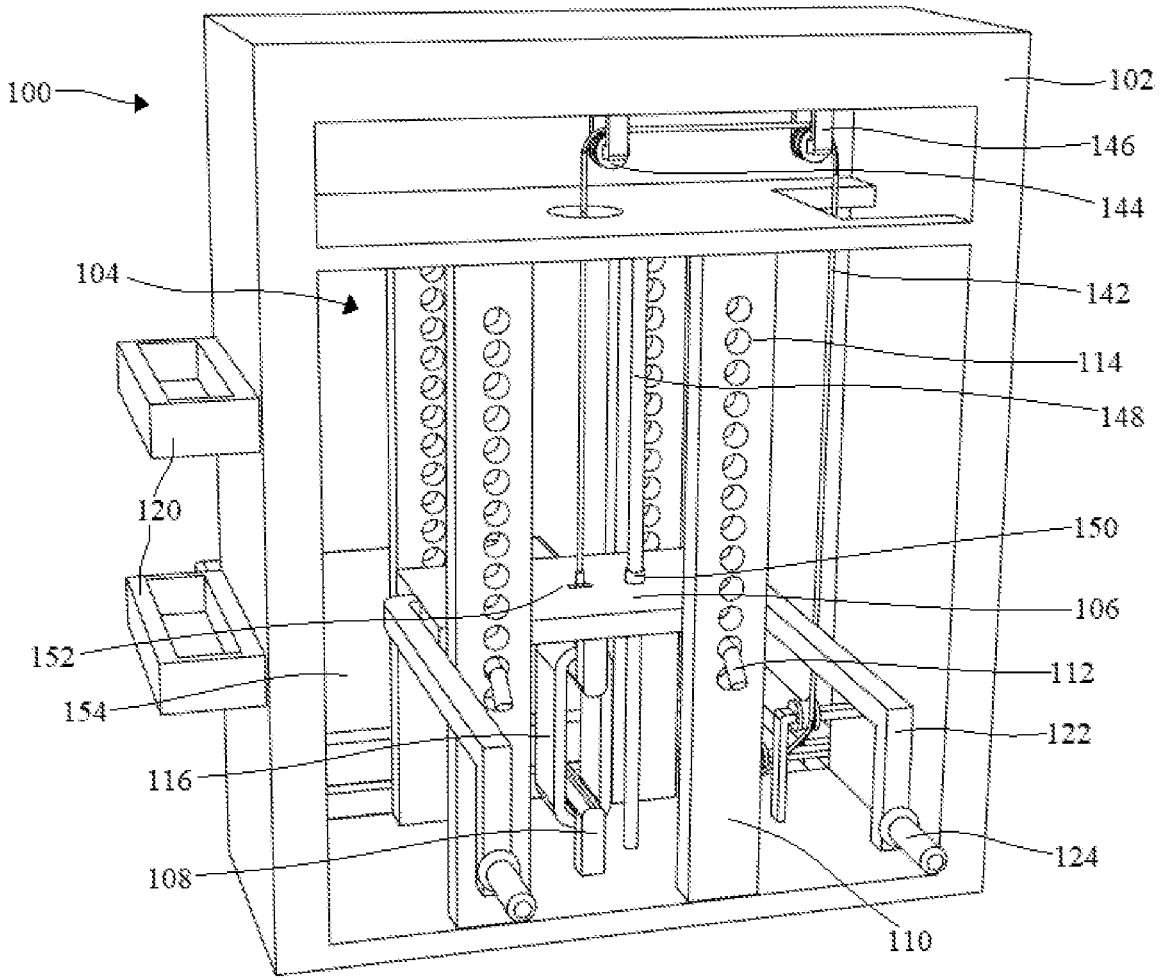
Figure 1J:
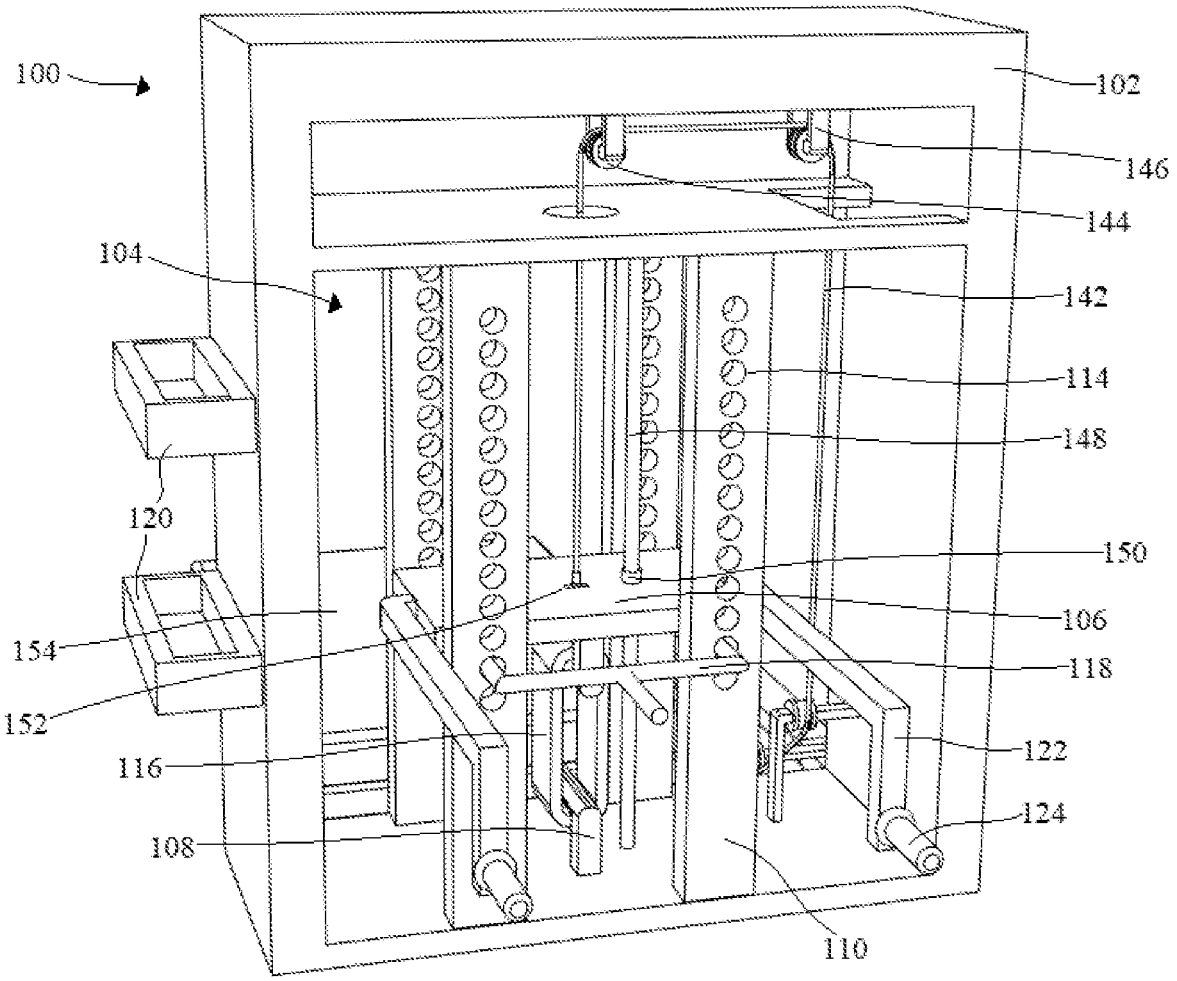

Referring now to FIGS. 1A-1E, an exemplary embodiment of a resistance band exercise machine 100 is disclosed. The resistance band exercise machine has a cable-pulley variable resistance system housing 102 and a cable-pulley variable resistance system 104. The cable-pulley variable resistance system has a top plate 106 with a resistance band hook 108 welded, bolted, or connected in any manner to the underside of the top plate and another resistance band hook 108 to the cable-pulley variable resistance system housing beneath the top plate's resistance band hook. There can be multiple resistance band hooks. The cable-pulley variable resistance system has a pair of uprights 110 welded, bolted, or connected in any manner to the cable-pulley variable resistance system housing and positioned such that the top plate rests on a pair of safety bars 112 when inserted into a safety bar hole 114. Belts, cables, cams, pulleys, or any combination thereof may be used in the cable-pulley variable resistance system. The configuration of the cable-pulley variable resistance system may be in any arrangement based on the exercise. Since different exercises have different ranges of motion, the number of safety bar holes will vary. Also, the safety bars determine the starting position of an exercise. The cable-pulley variable resistance system has a primary source of variably increasing resistance (resistance band 116) that is looped around the resistance band hooks as shown in FIG. 1C-1D. The cable-pulley variable resistance system may or may not have a pair of guide rods 148. This means that without the pair of guide rods the top plate will not have a shaft collar 150. A joined safety bar 118 may be used instead for convenience as shown in FIG. 1E. All types of resistance bands as well as springs may be used as a primary source of variably increasing resistance with the resistance band exercise machine. On one side of the cable-pulley variable resistance system housing is a container 120 to hold items such as towels, cleaning agent spray bottle, water bottle, resistance bands, safety bars, etc. The material of the cable-pulley variable resistance system housing may be made of stainless steel or any other material known in the art.

Figure 1K:
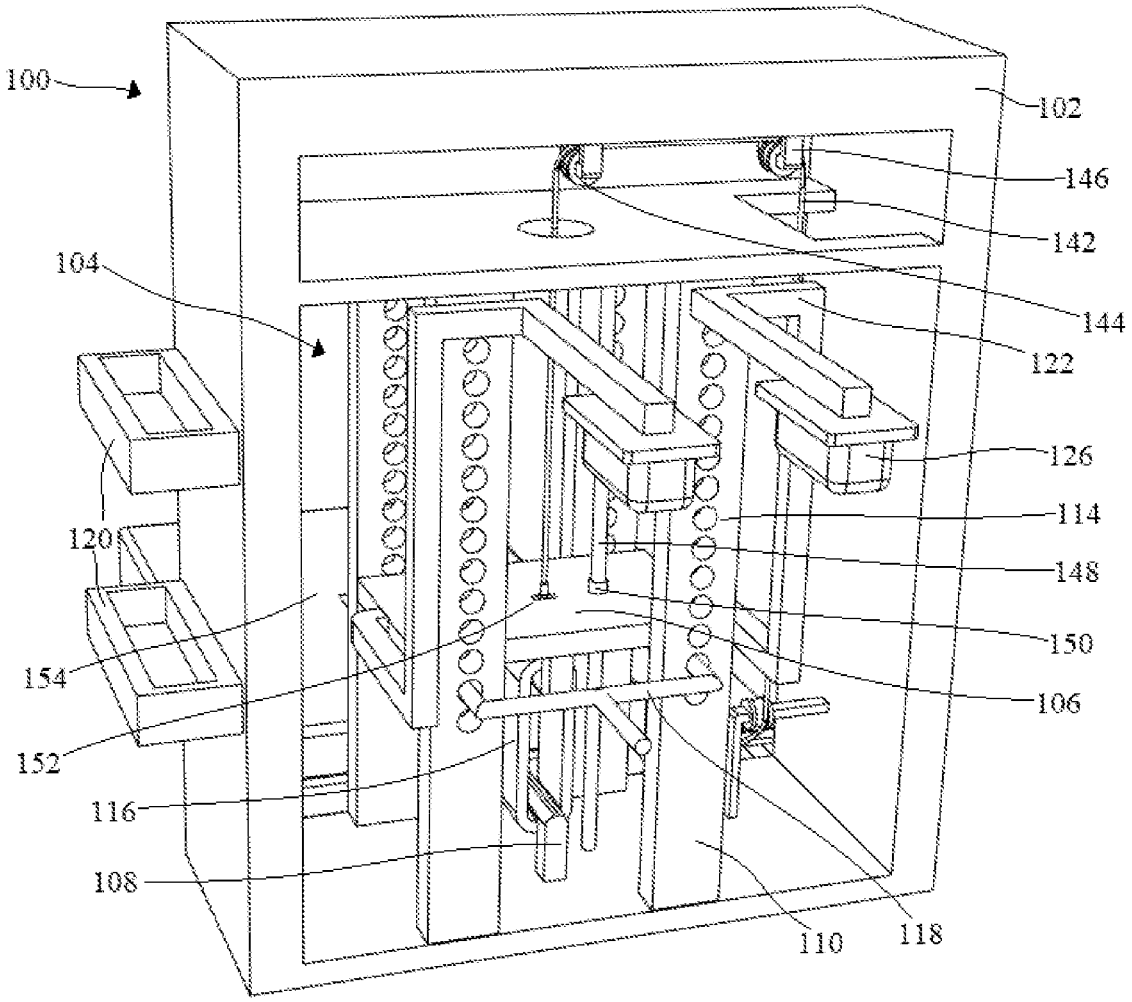
Figure 1L:
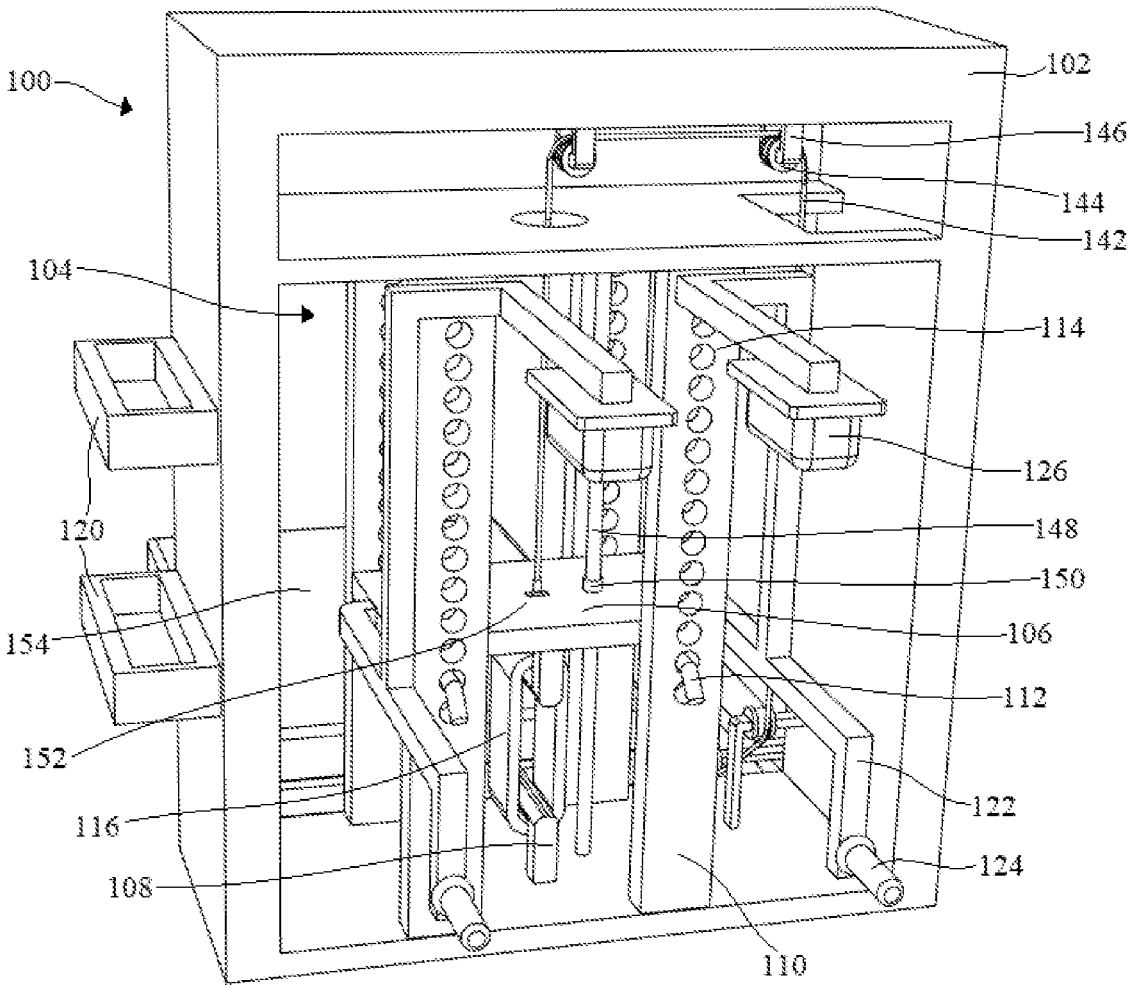
Figure 1M:
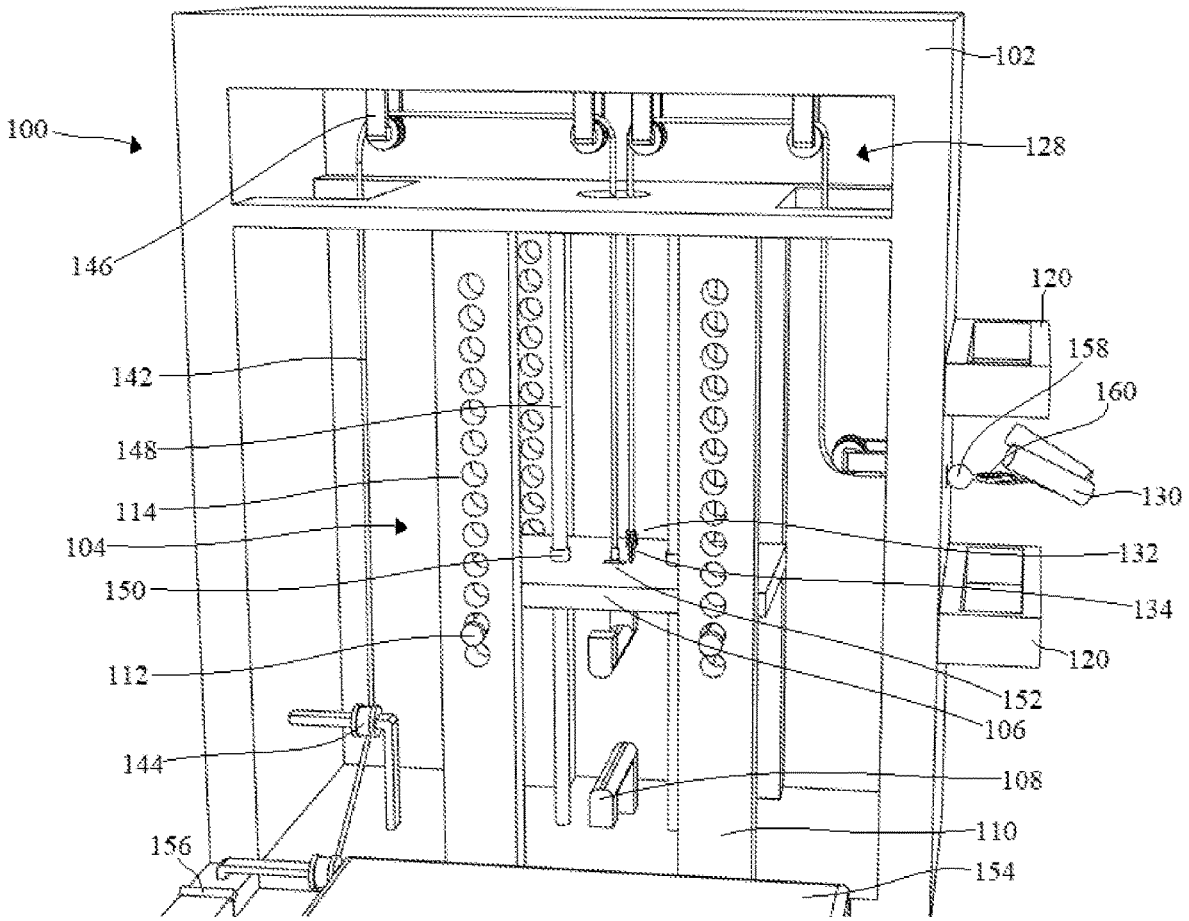
FIGS. 1M to 1P show a perspective view of resistance band exercise machine and in start position of an exercise's range of motion in accordance with another embodiment.
Figure 1N:
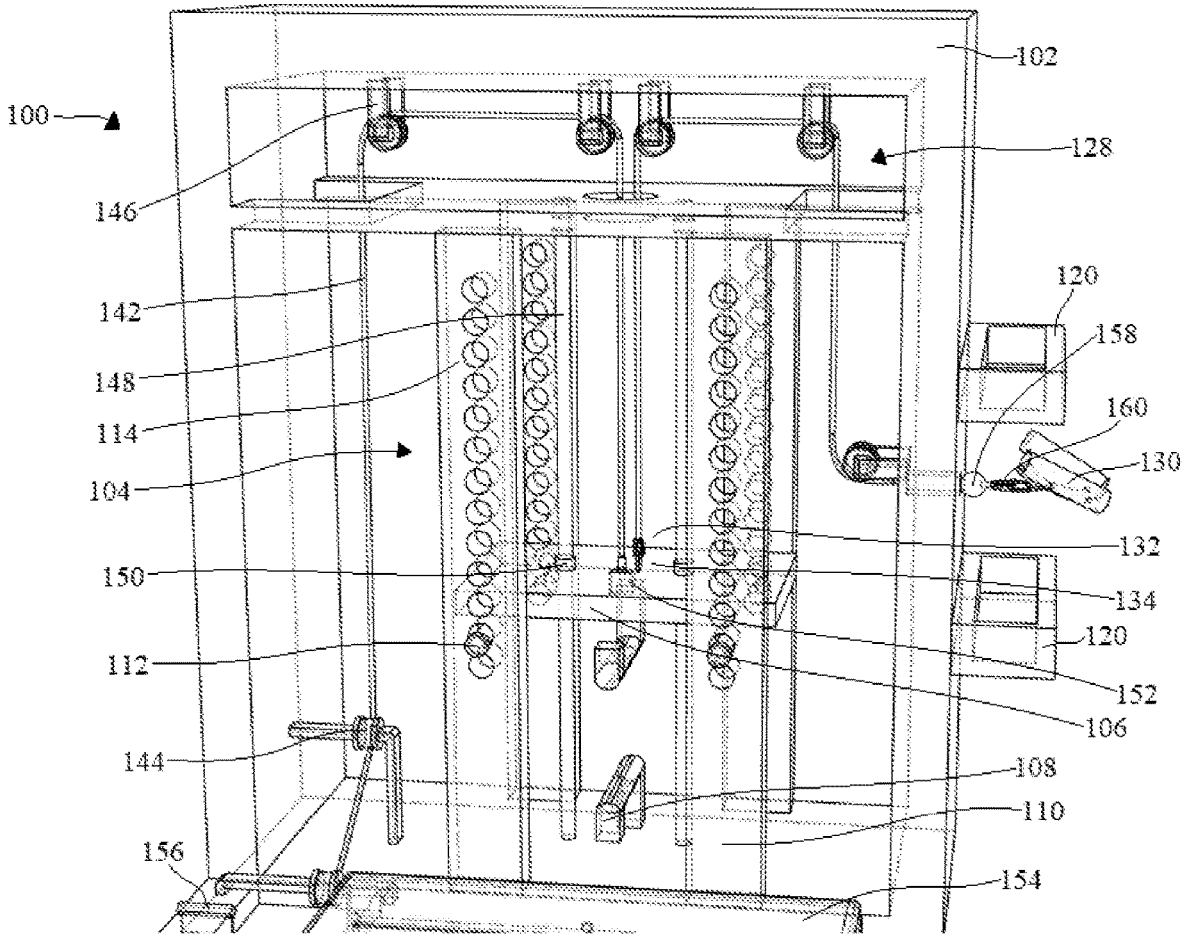
Figure 1O:
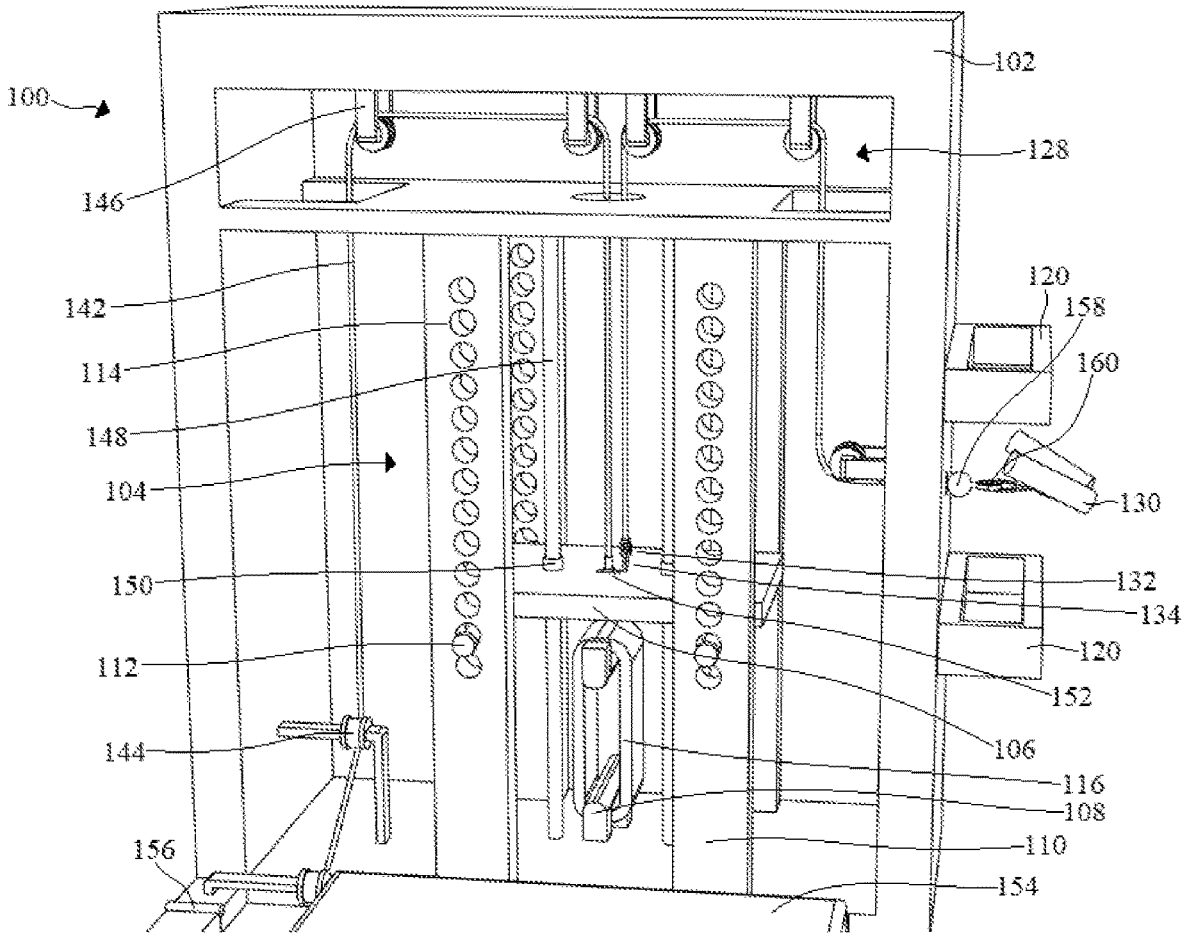
Figure 1P:
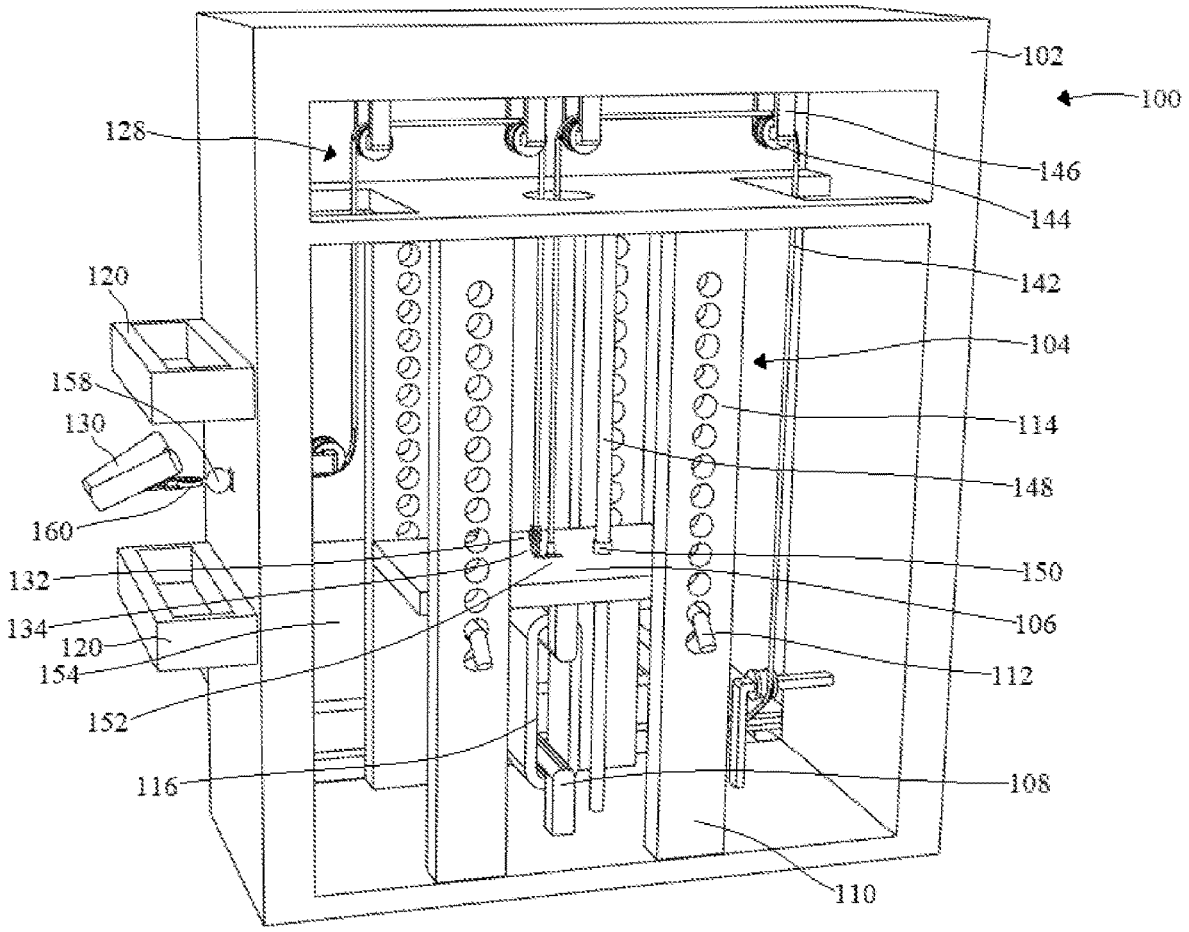
Figure 2A:
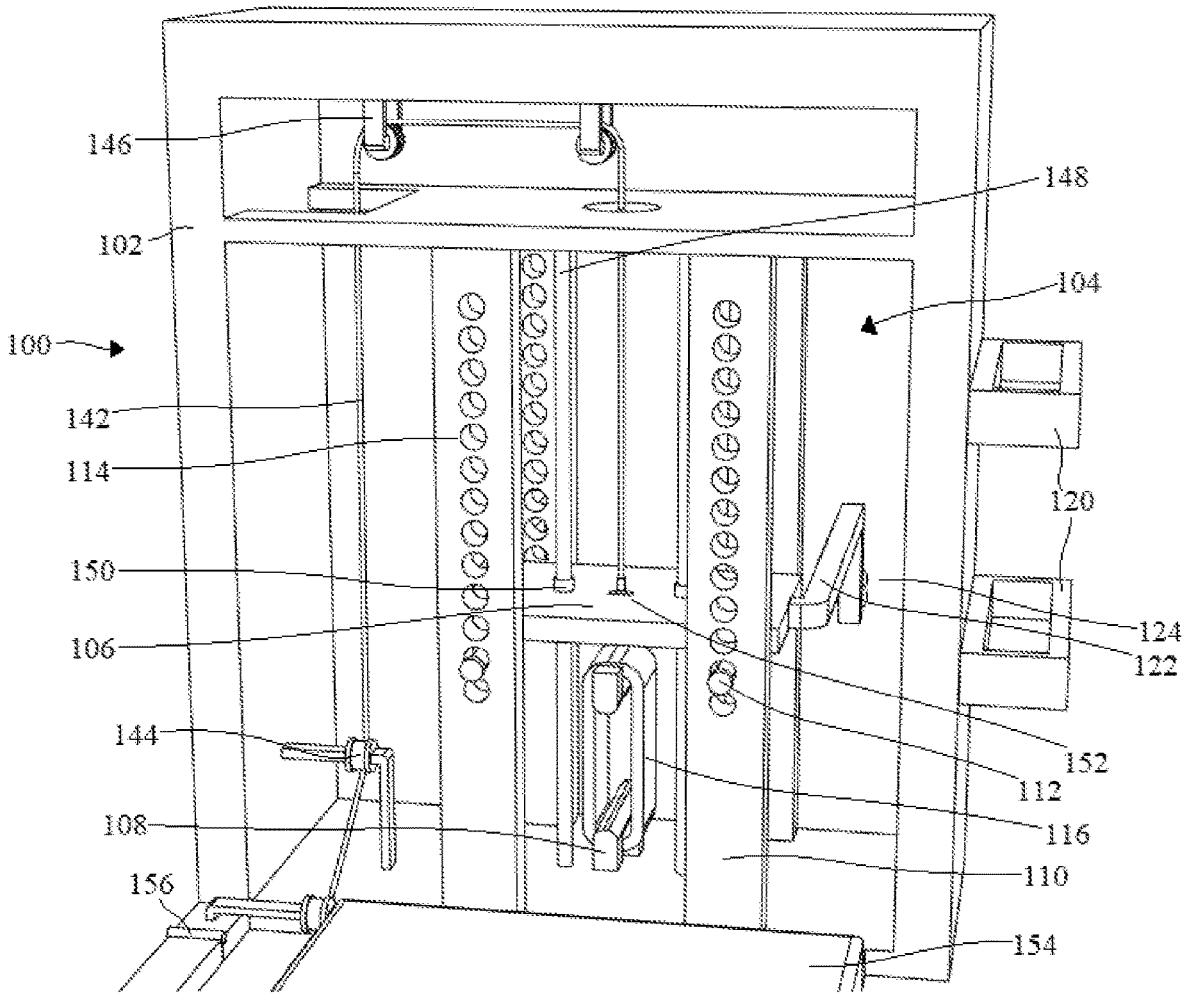
FIGS. 2A to 2D show resistance band exercise machine in start, mid, and end positions of an exercise's range of motion in accordance with another embodiment.
Figure 2B:
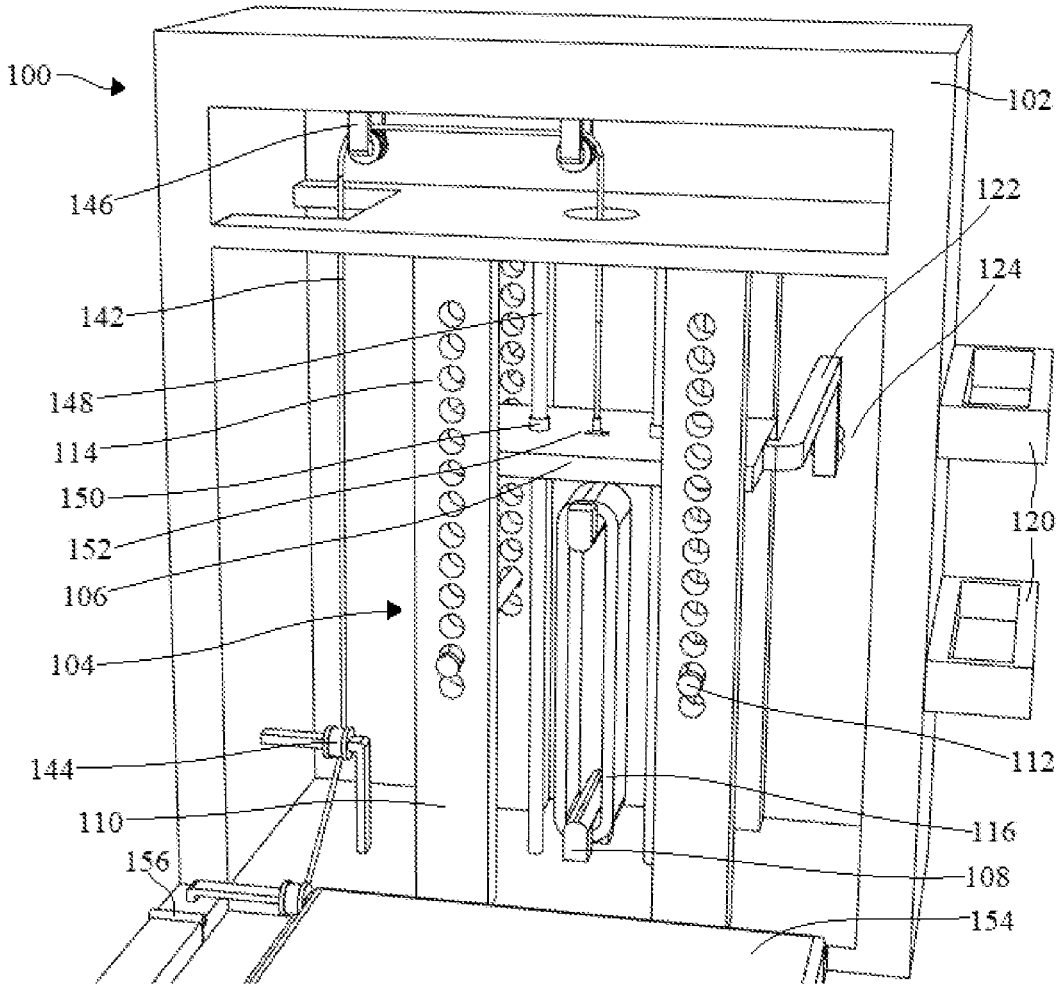
Figure 2C:
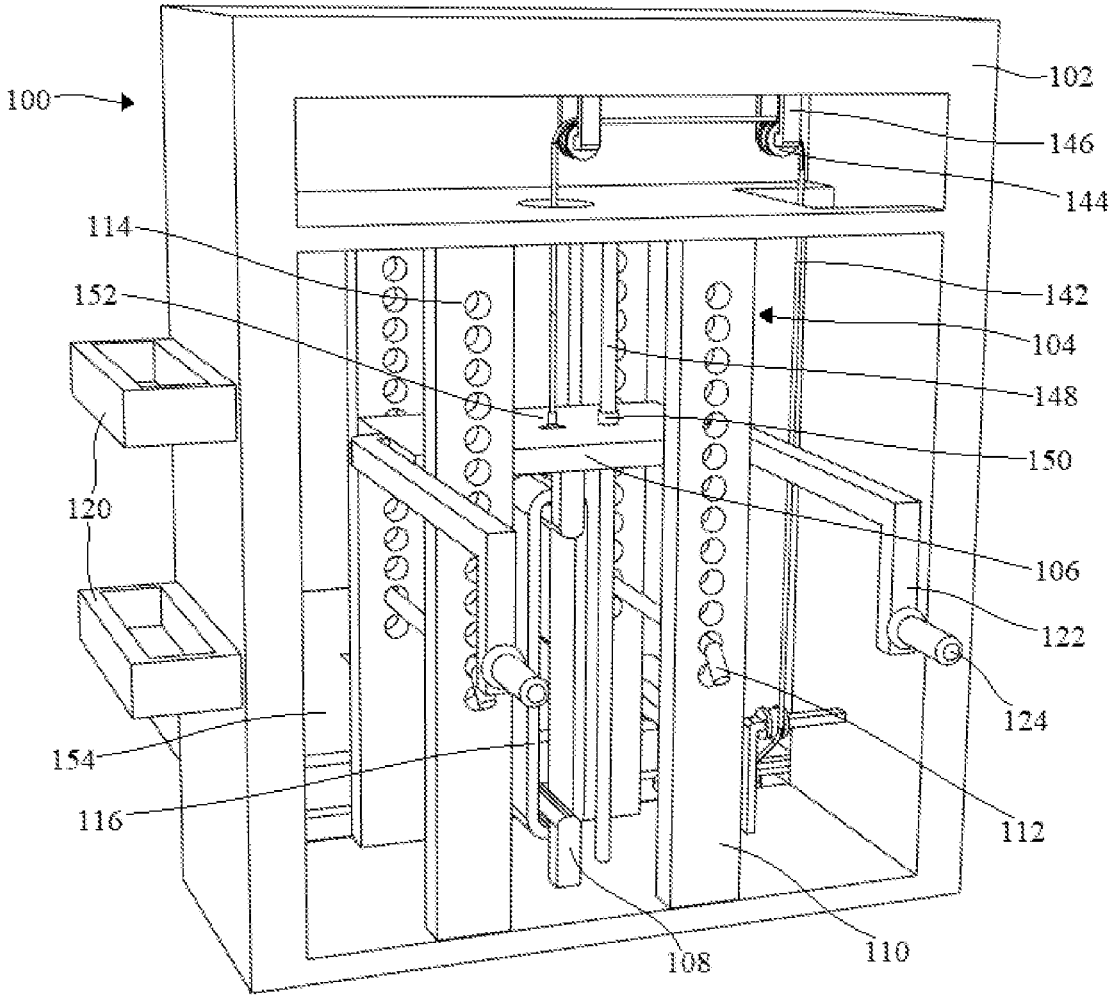
Figure 2D:
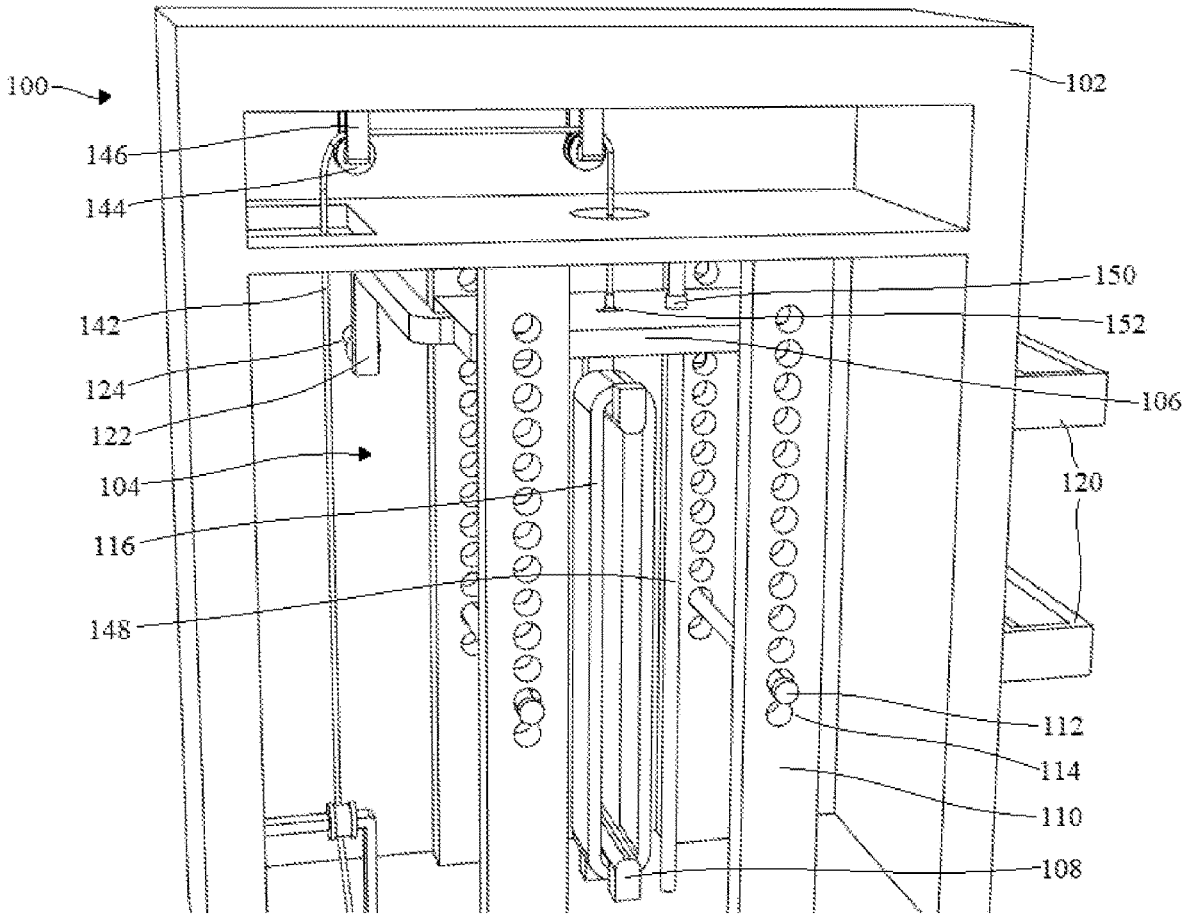

Referring now to FIGS. 1F-1L, another exemplary embodiment of a resistance band exercise machine 100 is disclosed. This exemplary embodiment is the same as the one above shown in FIGS. 1A-1E with the addition of a training partner assistantship feature to the cable-pulley variable resistance system of having an input lifting arm 122 with a handle grip 124 that is welded, bolted, or connected in any manner to the top plate. Alternatively, the input lifting arm may have a shoulder padding 126 or both as shown in FIGS. 1K and 1L, respectively.

Referring now to FIGS. 1M-1P, another exemplary embodiment of a resistance band exercise machine 100 is disclosed. This exemplary embodiment is the same as the one above shown in FIGS. 1F-1L but with a different training partner assistantship feature of having a training partner assistantship cable-pulley system 128. The training partner assistantship cable-pulley system has an exercise handle attachment 130 on one end and a snap link hook 132 that connects to an O ring 134 on the other end that is welded or connected in any manner to the top plate. Any exercise handle attachment may be used.

Referring now to FIGS. 2A-2D, an exercise is performed through a full range of motion from start to end position stretching the resistance band without the help of a training partner 136.

Figure 3A:
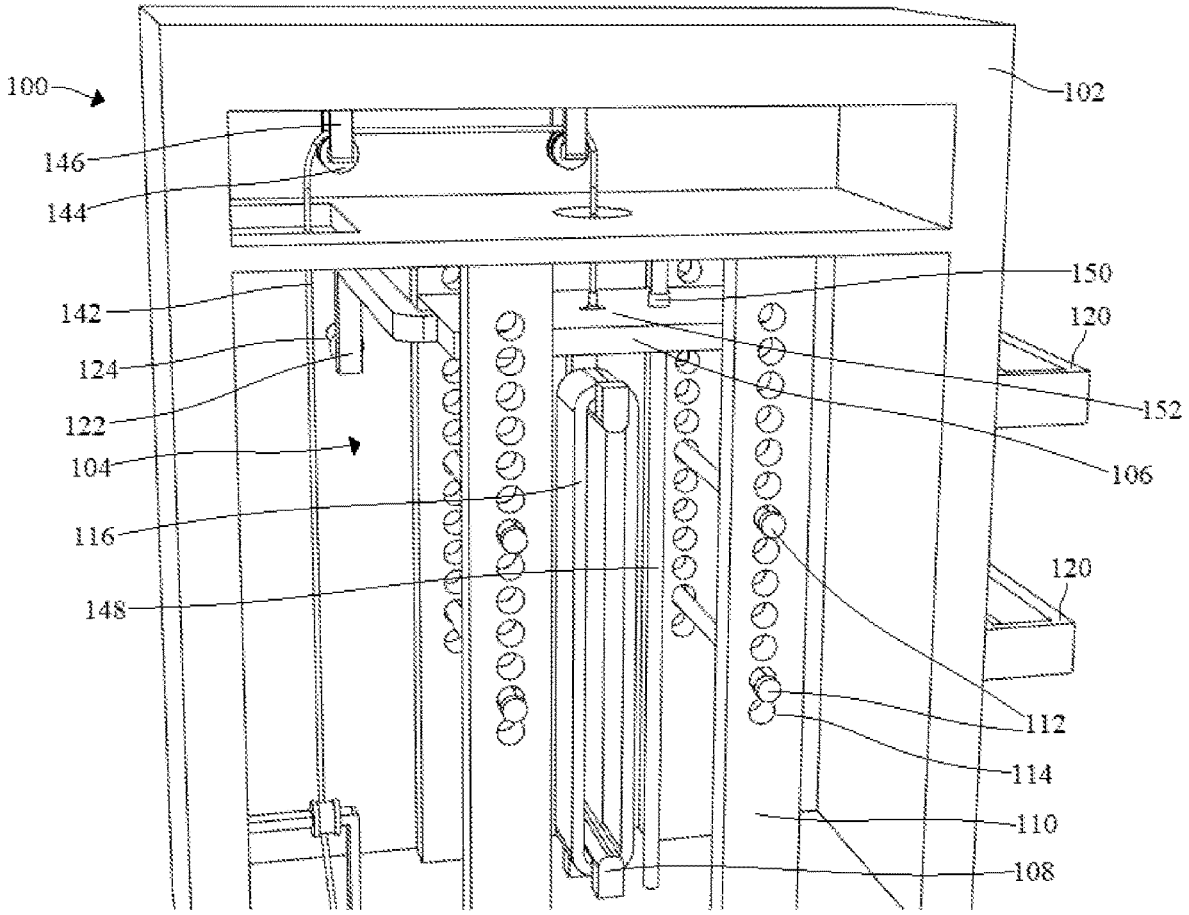
FIGS. 3A to 3C show a method of reducing an exercise's range of motion and method of performing isometrics in resistance band exercise machine in accordance with another embodiment.
Figure 3B:
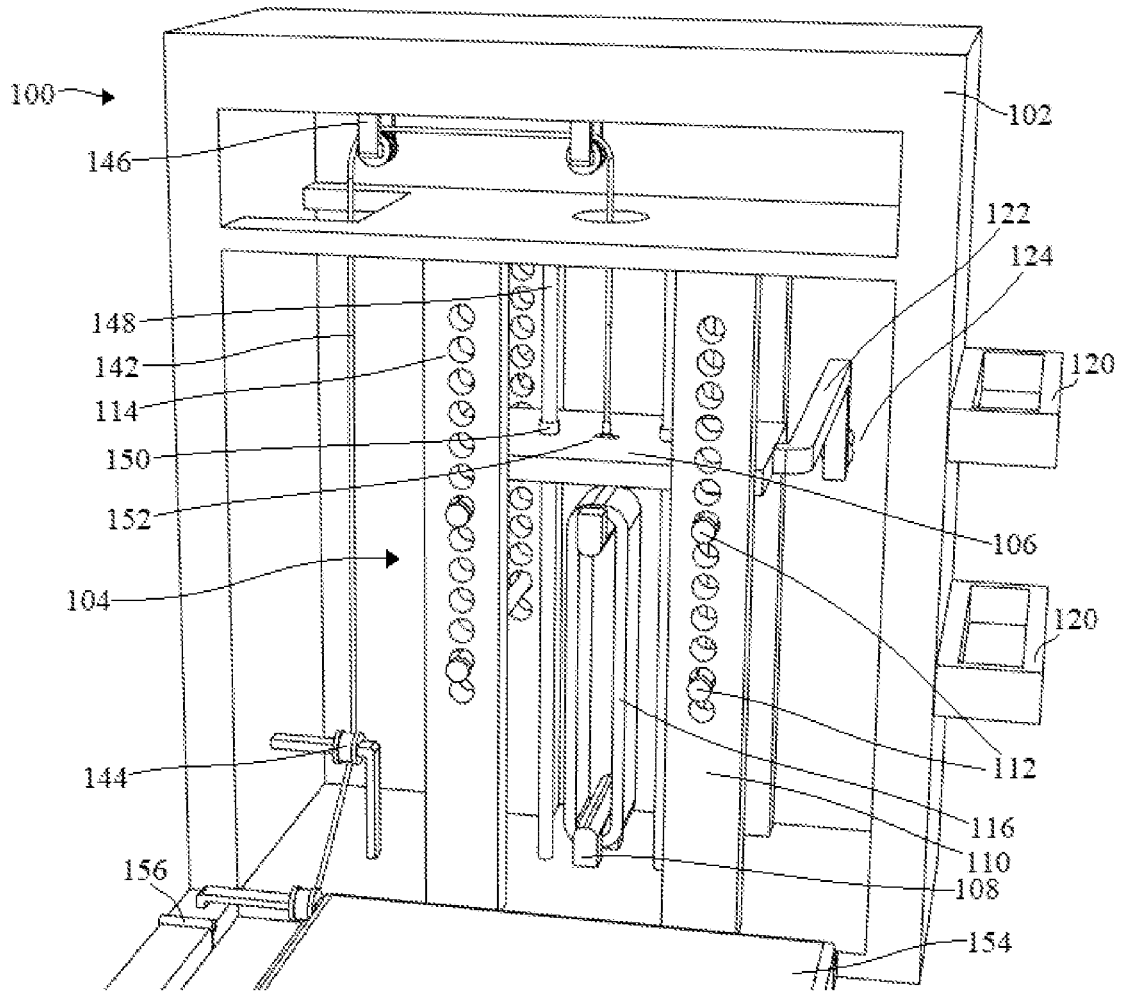
Figure 3C:
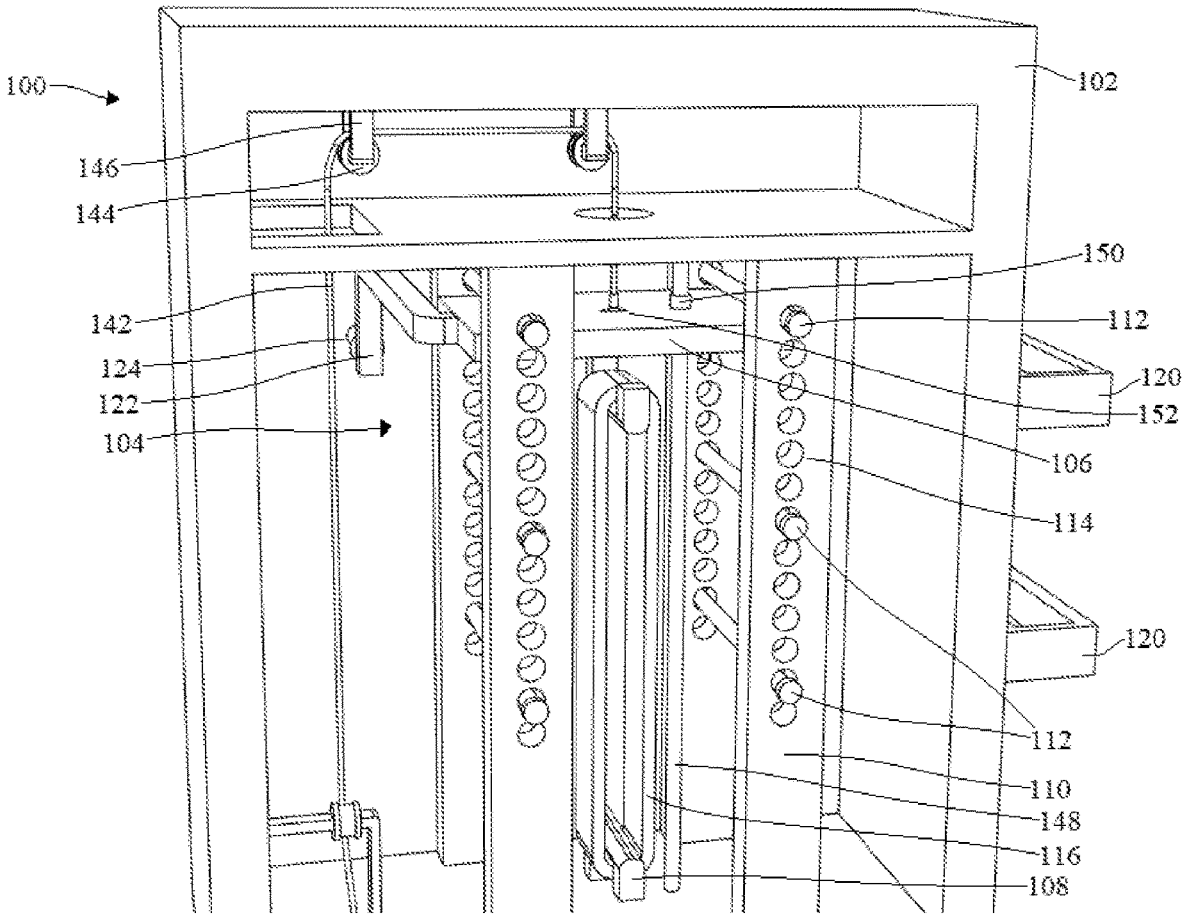
Figure 4A:
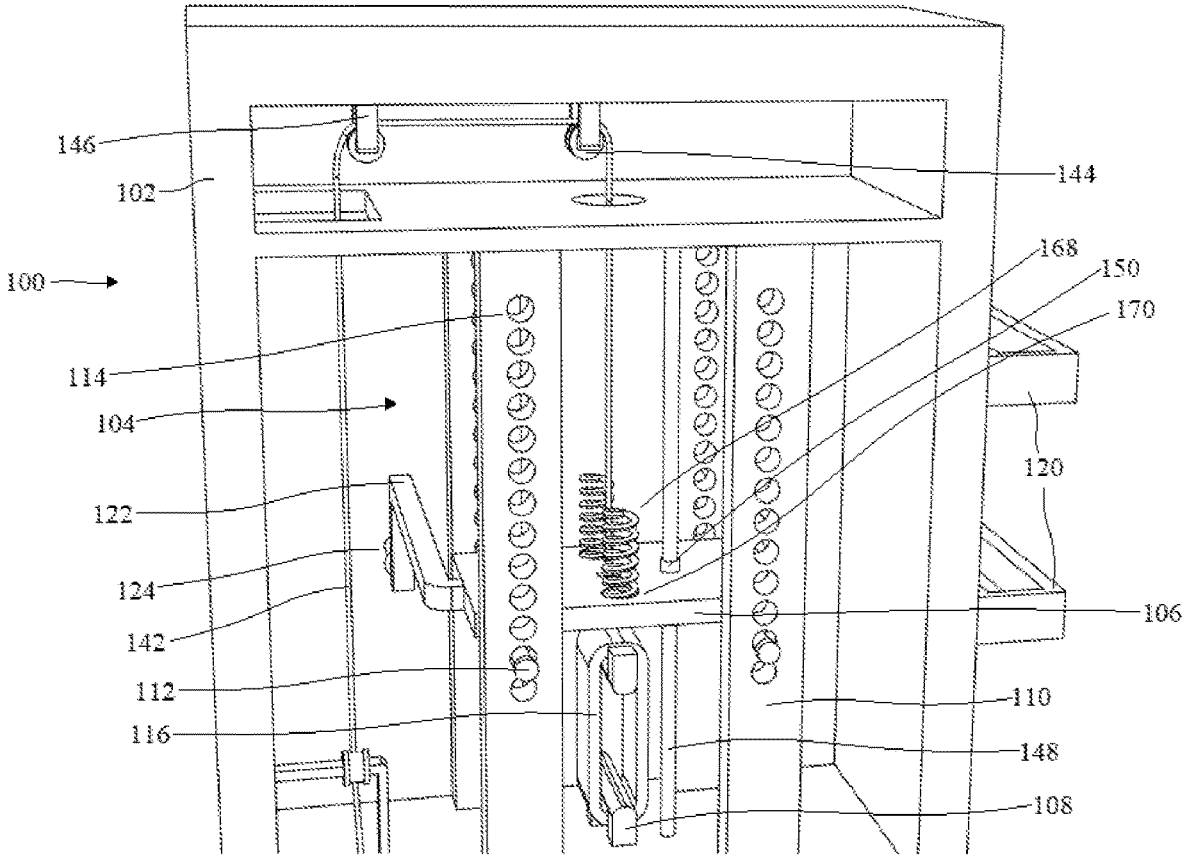
FIGS. 4A to 4D show a method of adding a secondary source of variably increasing resistance that a user contracts against towards the end position of an exercise in addition to a primary source of variably increasing resistance that a user contracts against from start to end position of an exercise in resistance band exercise machine in accordance with another embodiment.
Figure 4B:
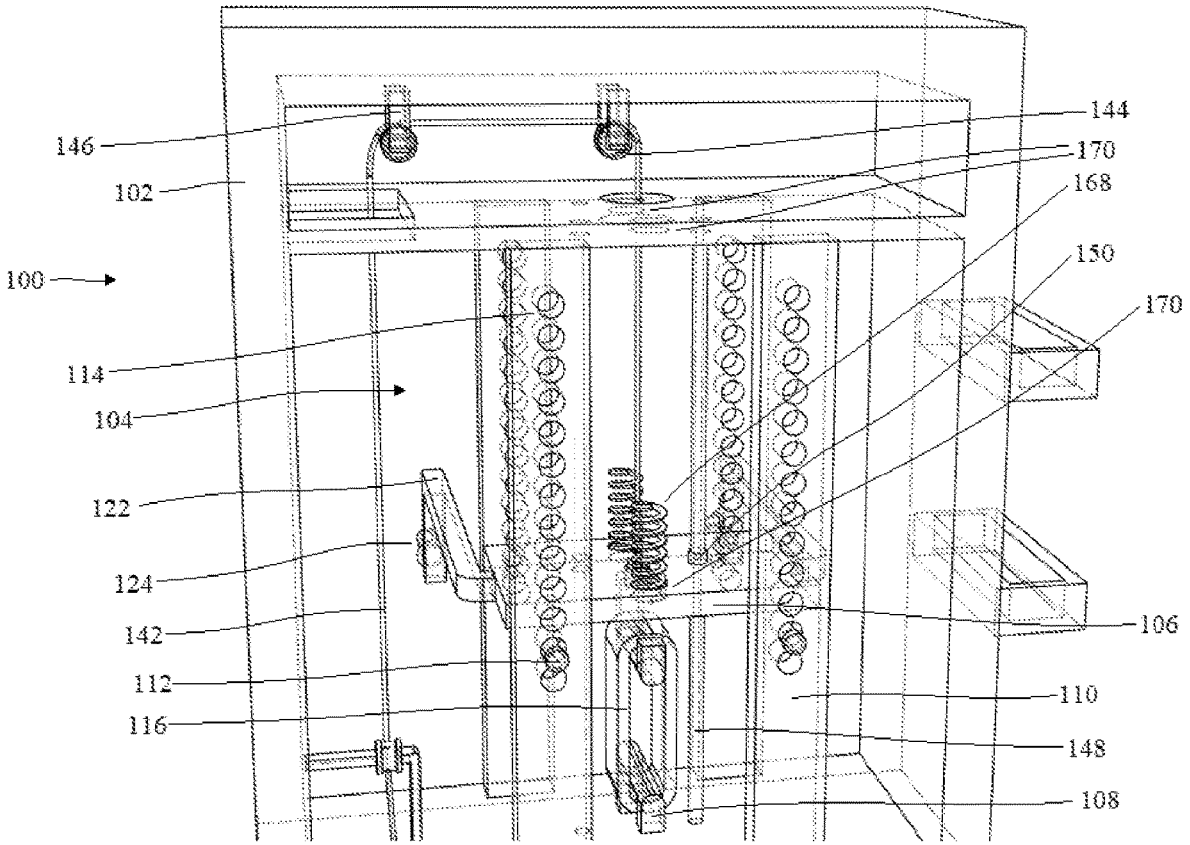
Figure 4C:
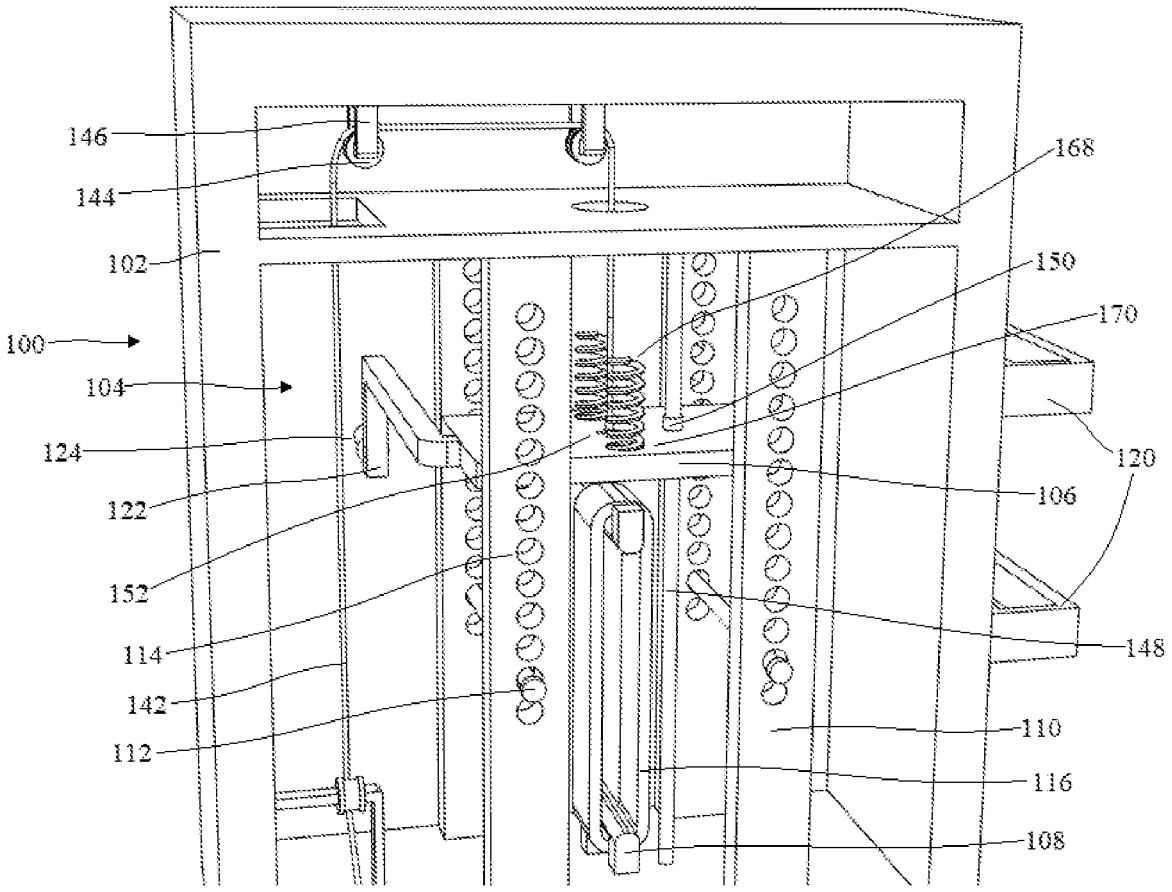
Figure 4D:
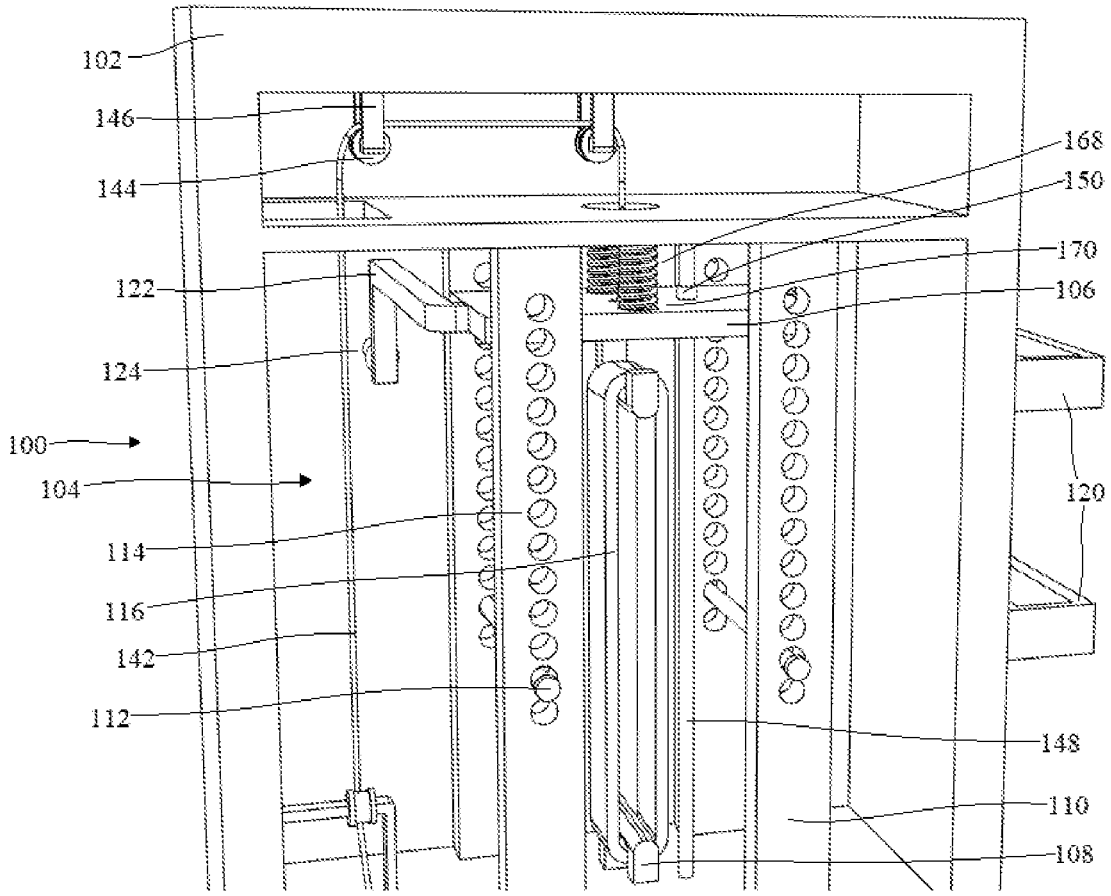

Referring now to FIGS. 3A-3C, the training partner inserts additional pair of safety bars 112 into the safety bar hole after an exercise is performed to the end position to reduce the exercise's range of motion and perform isometrics.

Referring now to FIGS. 4A-4D, another exemplary embodiment of a resistance band exercise machine 100 is disclosed. The cable-pulley variable resistance system has the resistance band and a secondary source of variably increasing resistance (springs 168). An exercise is performed through a full range of motion from start to end position contracting against the resistance band then the springs approaching end position of an exercise. The springs is placed on the top plate into a recessed spring pocket 170 with another recessed spring pocket on the cable-pulley variable resistance system housing to keep the springs in place at the end position of an exercise. The addition of the springs to the resistance band increase the variability in resistance level from start to end position of an exercise matching the user's muscle group strength curve. The springs may be placed on top where the recessed spring pocket is on the cable-pulley variable resistance system housing and held in place by any means known in the art. A plurality of springs from the cable-pulley variable resistance system may be used in the resistance band exercise machine and placement of the recessed spring pocket may be anywhere on the top plate and the cable-pulley variable resistance system housing. Any means known in the art other than the recessed spring pocket to keep the springs in place may be used in the resistance band exercise machine.

The resistance band exercise machine includes, but is not limited to, exercises from U.S. patent application publication 20190374814-A1. The resistance band exercise machine applies to all other exercises targeting different muscle groups in the human body.

The exercise from U.S. patent application publication 20190374814-A1 is shown in FIGS. 5-13 as an example of interaction between a user 162 and the resistance band exercise machine.

Operation—FIGS. 5, 6, 7, 8, 9, 10, 11, 12, and 13

Figure 5A:
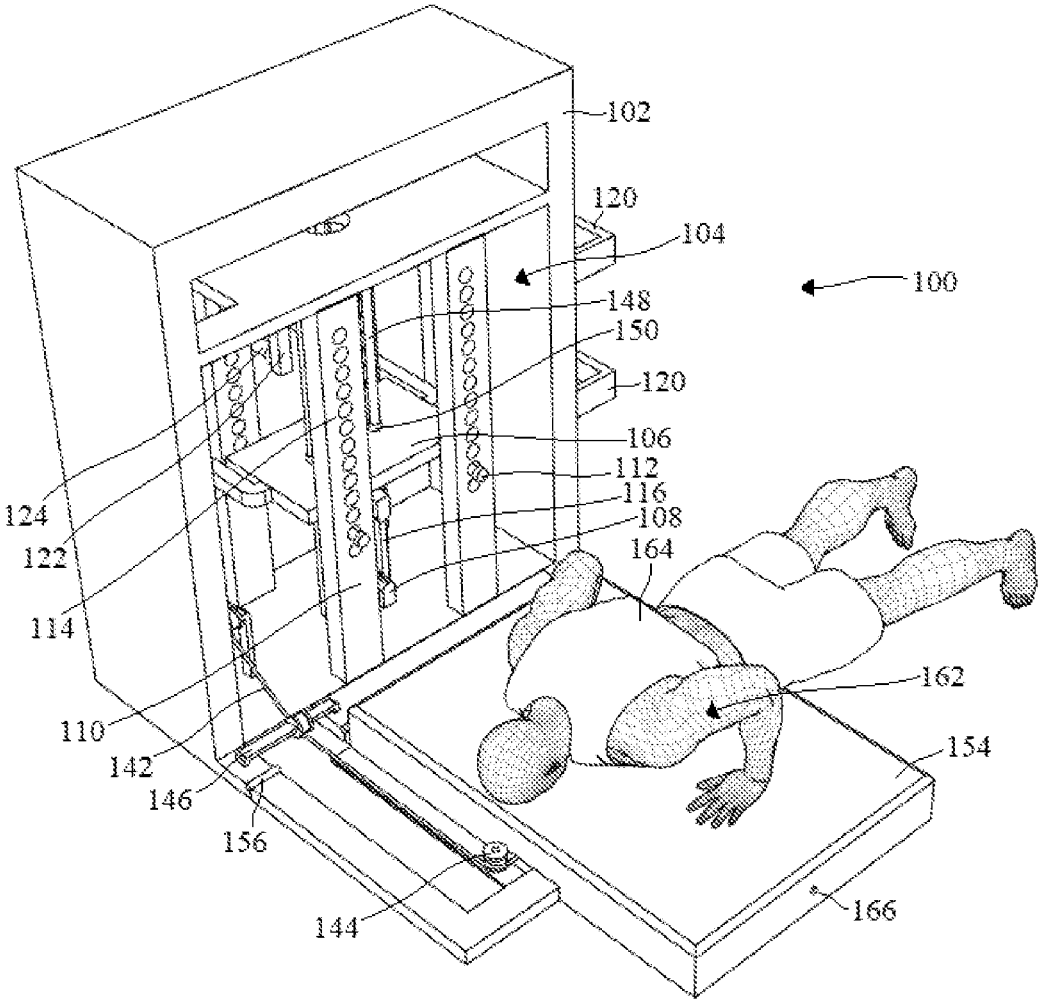
FIGS. 5A to 5C show interaction between user and resistance band exercise machine through a full range of motion exercise in accordance with another embodiment.
Figure 5B:
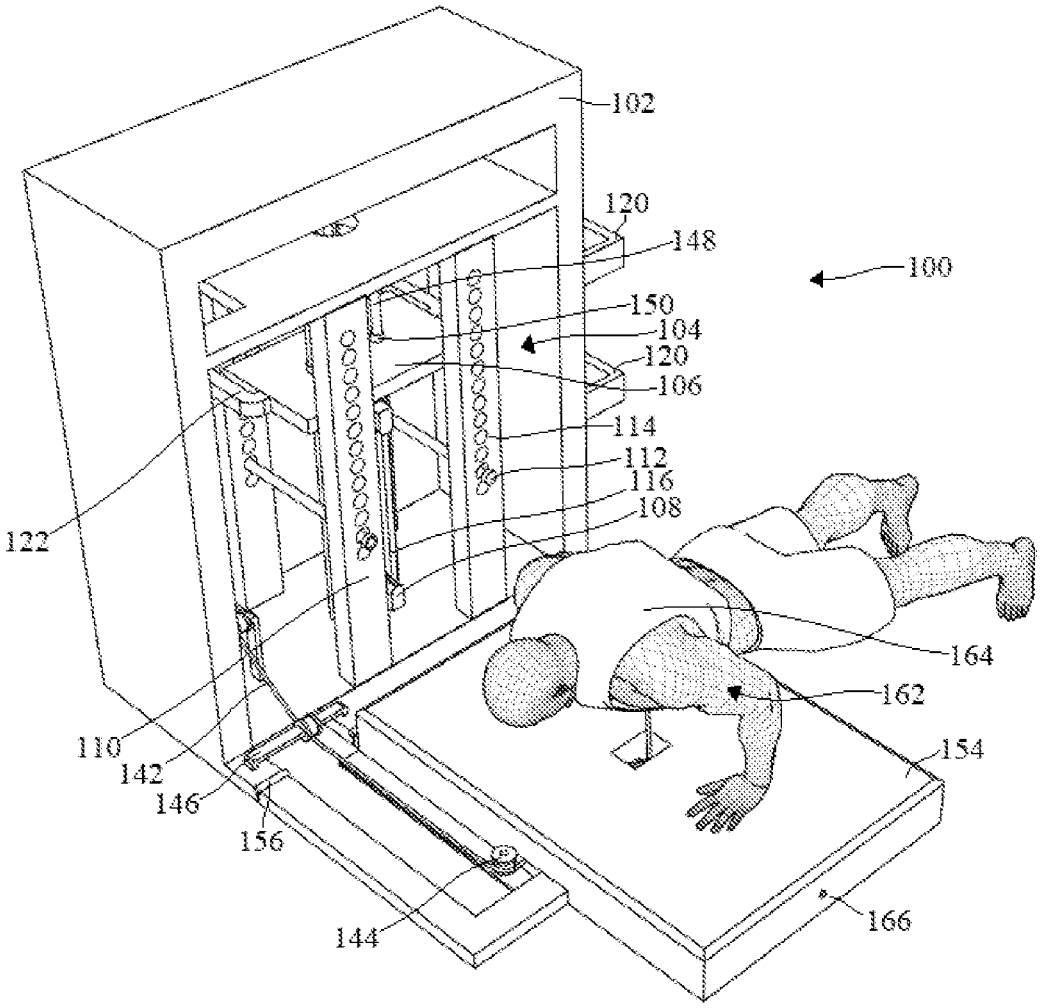
Figure 5C:
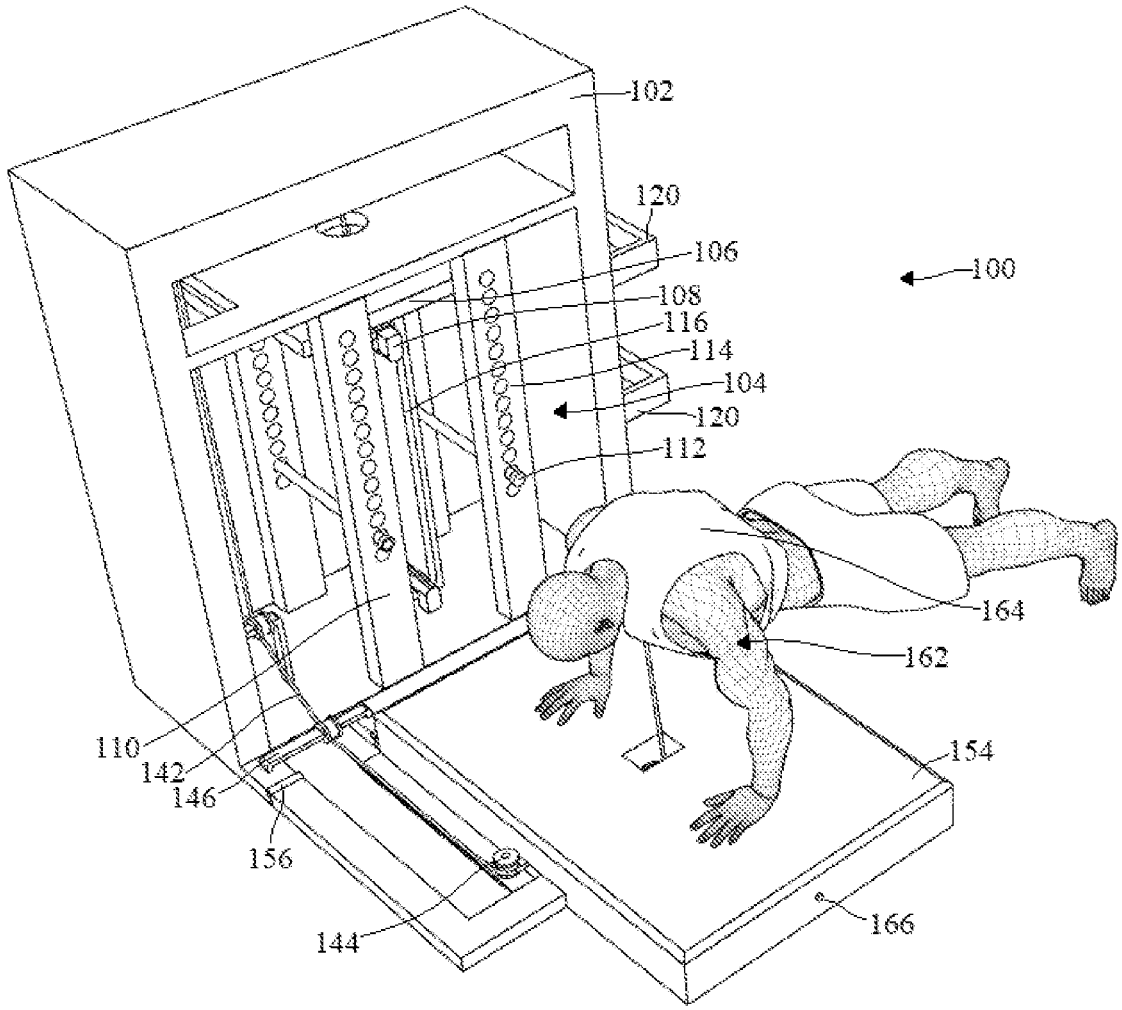
Figure 6A:
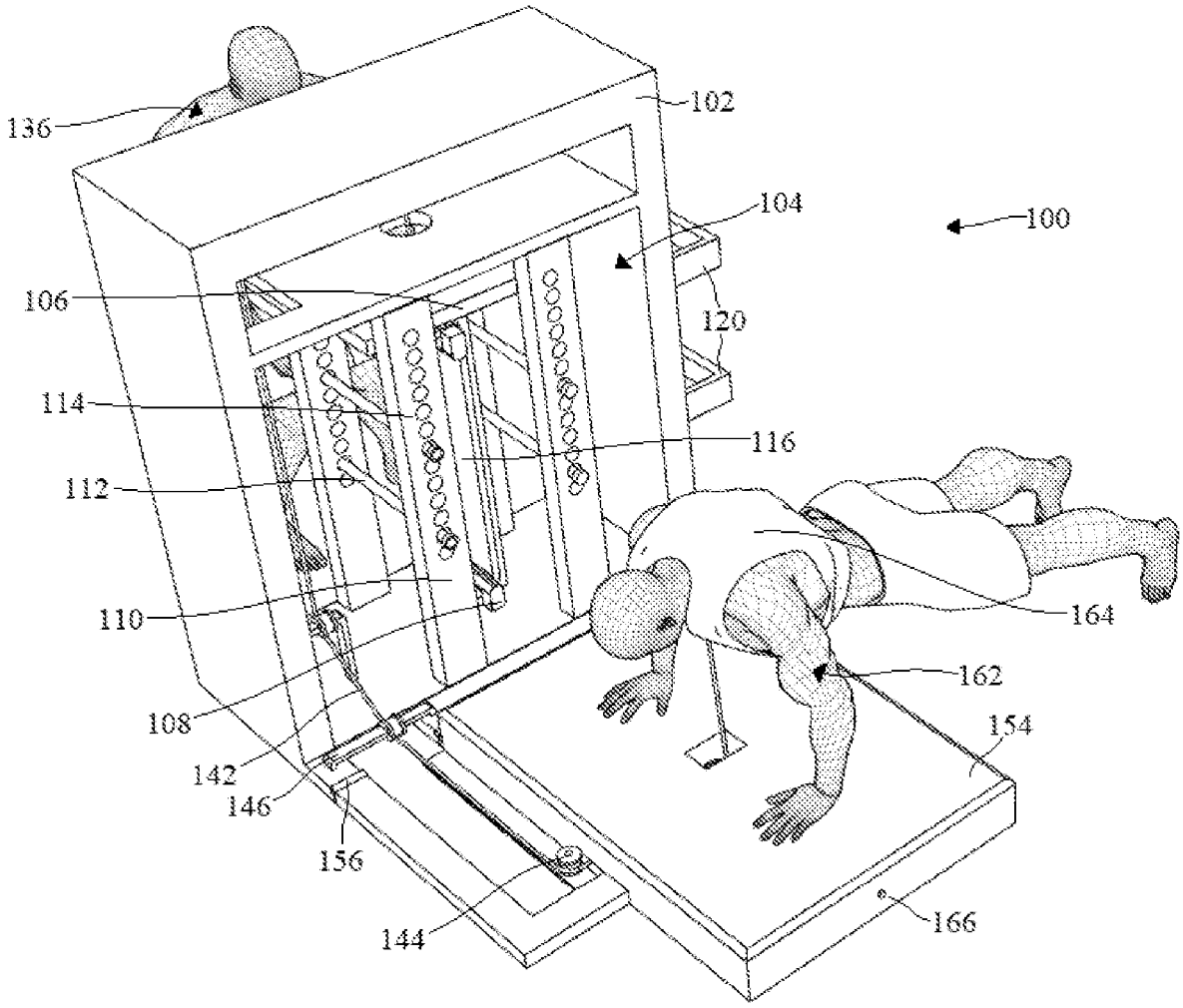
FIGS. 6A to 6C show a method of reducing an exercise's range of motion and method of performing isometrics with interaction between user and resistance band exercise machine in accordance with another embodiment.
Figure 6B:
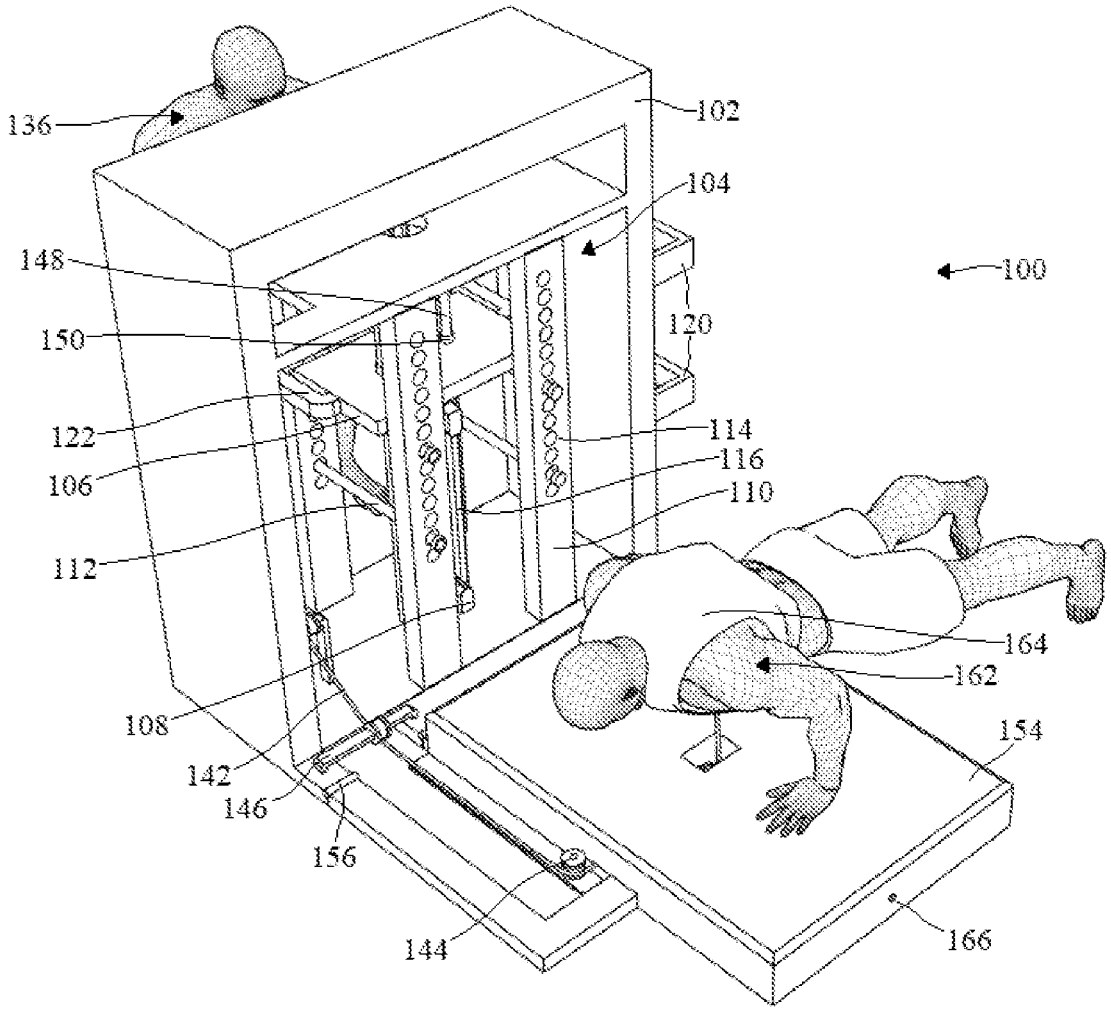
Figure 6C:
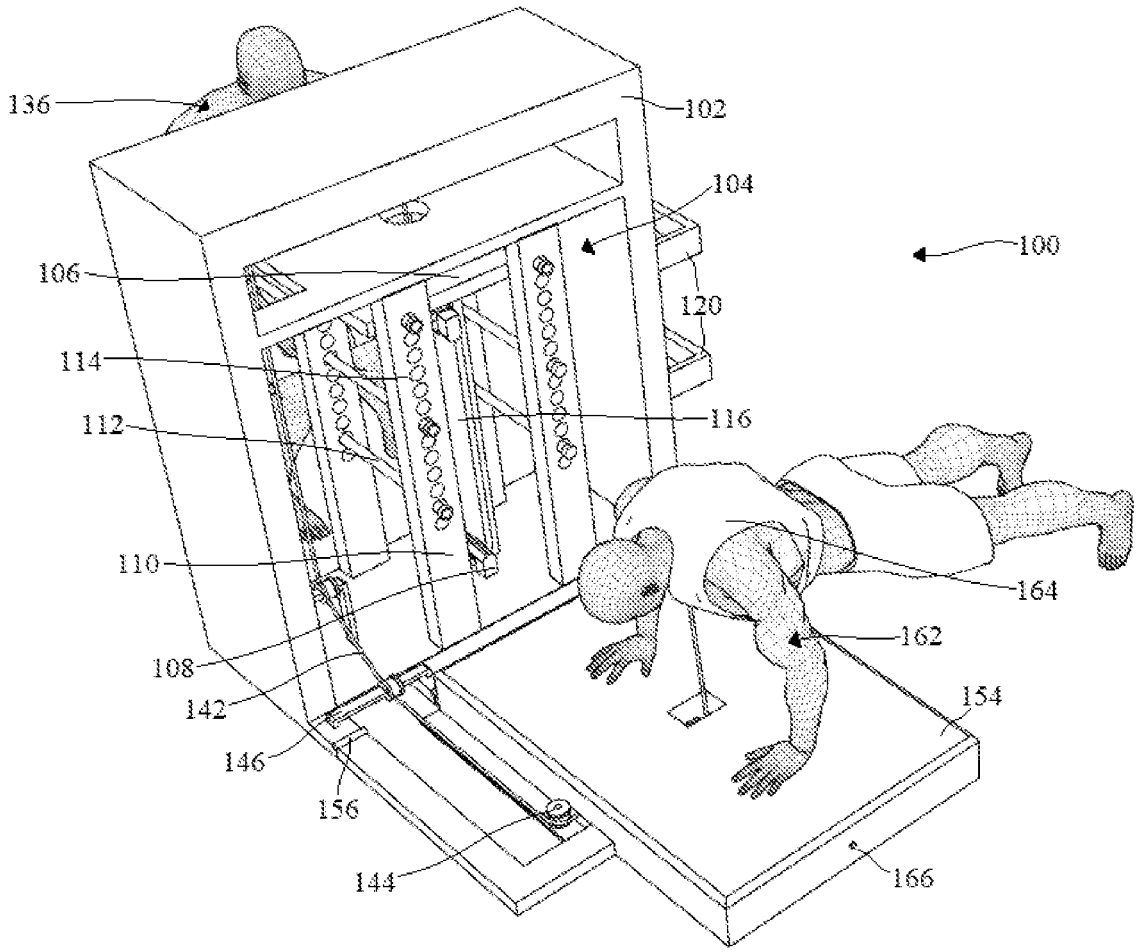

The user performs the exercise with their hands on a platform 154 through full range of motion for a number of repetitions on the resistance band exercise machine against the resistance band that is variably increasing in resistance from start to end position of the exercise by wearing a harness or belt 164 having snap link hook suspended from it and configured to connect to a cable 142 as shown in FIGS. 5A-5C. When the user cannot perform another full range of motion repetition, the training partner inserts the safety bars into the safety bar hole to reduce the exercise's range of motion as shown in FIG. 6A. The user performs a number of partial range of motion repetitions and the training partner inserts the safety bars into the safety bar hole so that the user can perform isometrics against the safety bars when they cannot perform another partial range of motion repetition as shown in FIGS. 6B and 6C. The user may begin the exercise with reduced range of motion by first performing a full range of motion repetition so that the training partner can insert the safety bars into the safety bar hole.

Figure 7A:
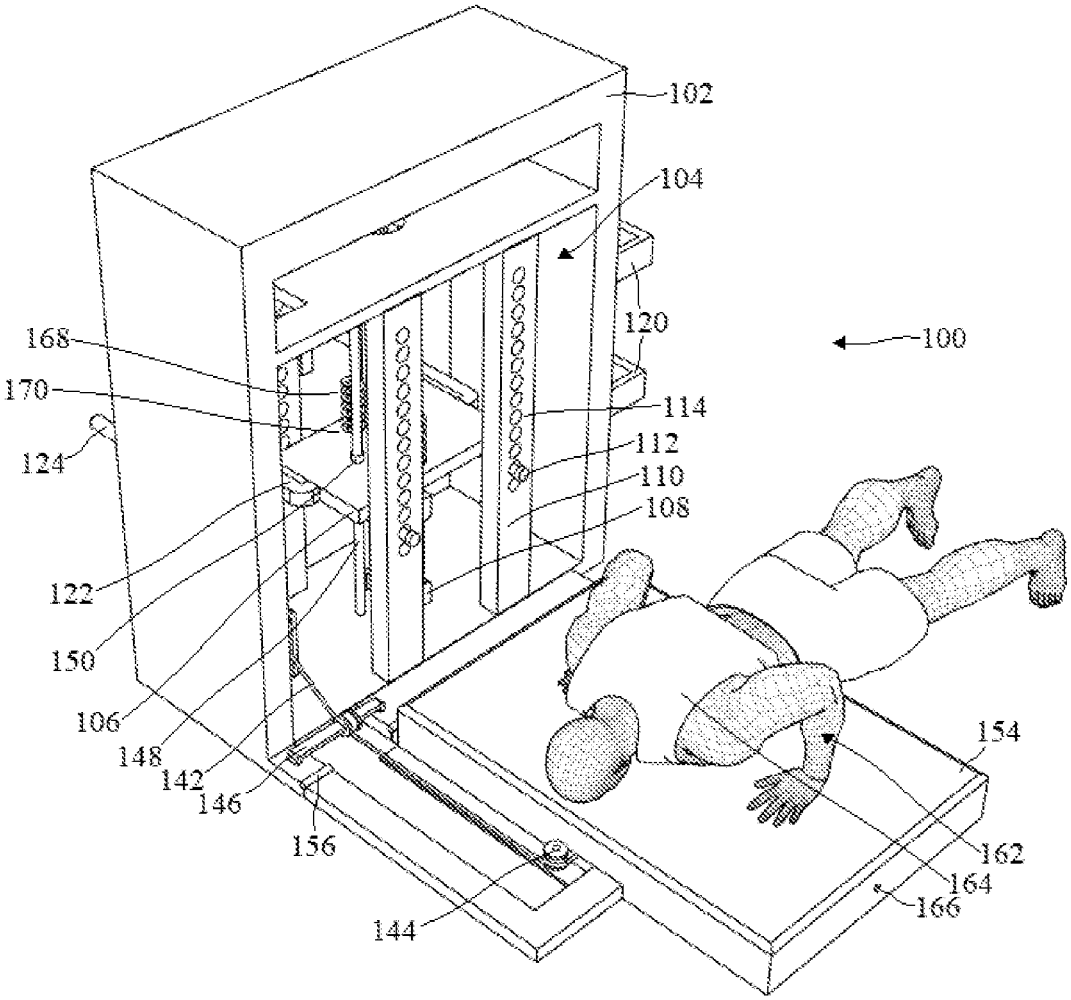
FIGS. 7A to 7C show interaction between user and resistance band exercise machine through a full range of motion exercise using primary and secondary sources of variably increasing resistance in accordance with another embodiment.
Figure 7B:
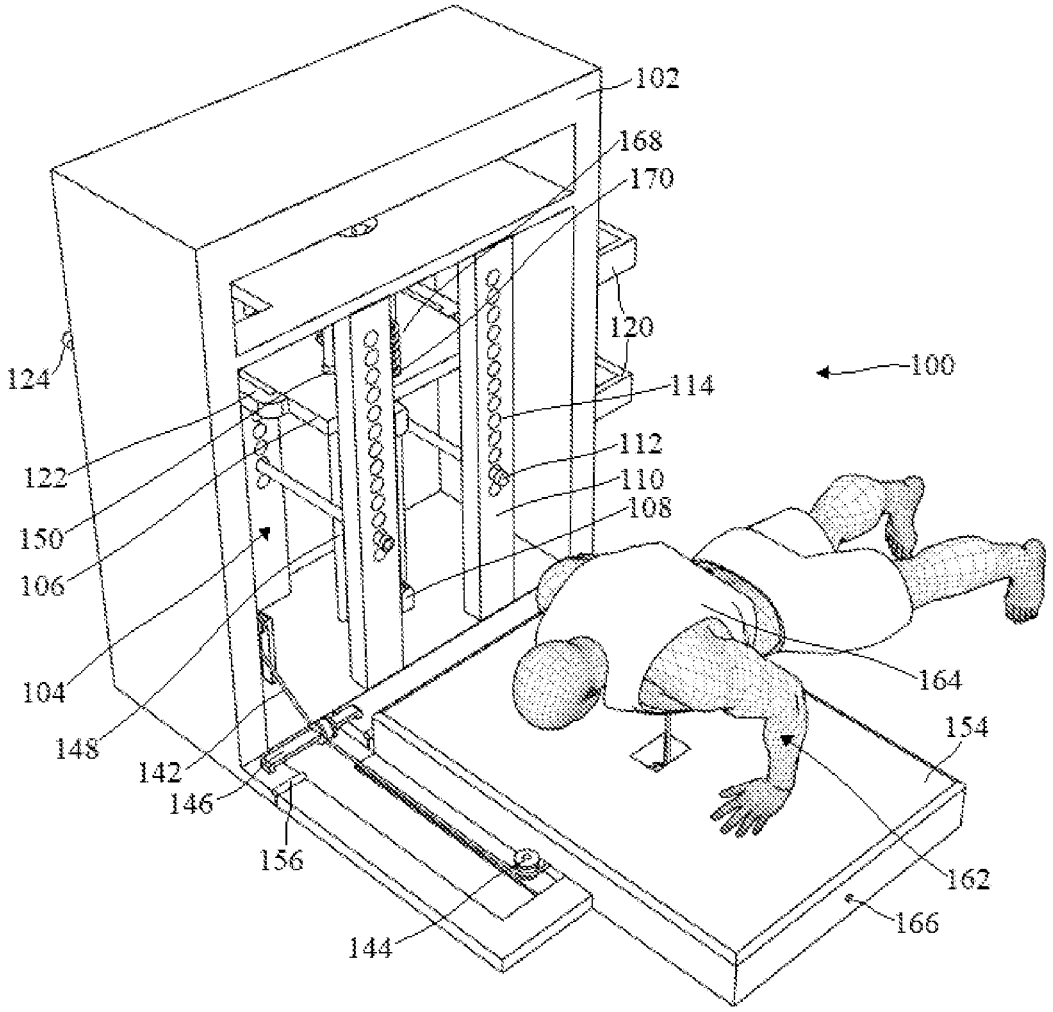
Figure 7C:
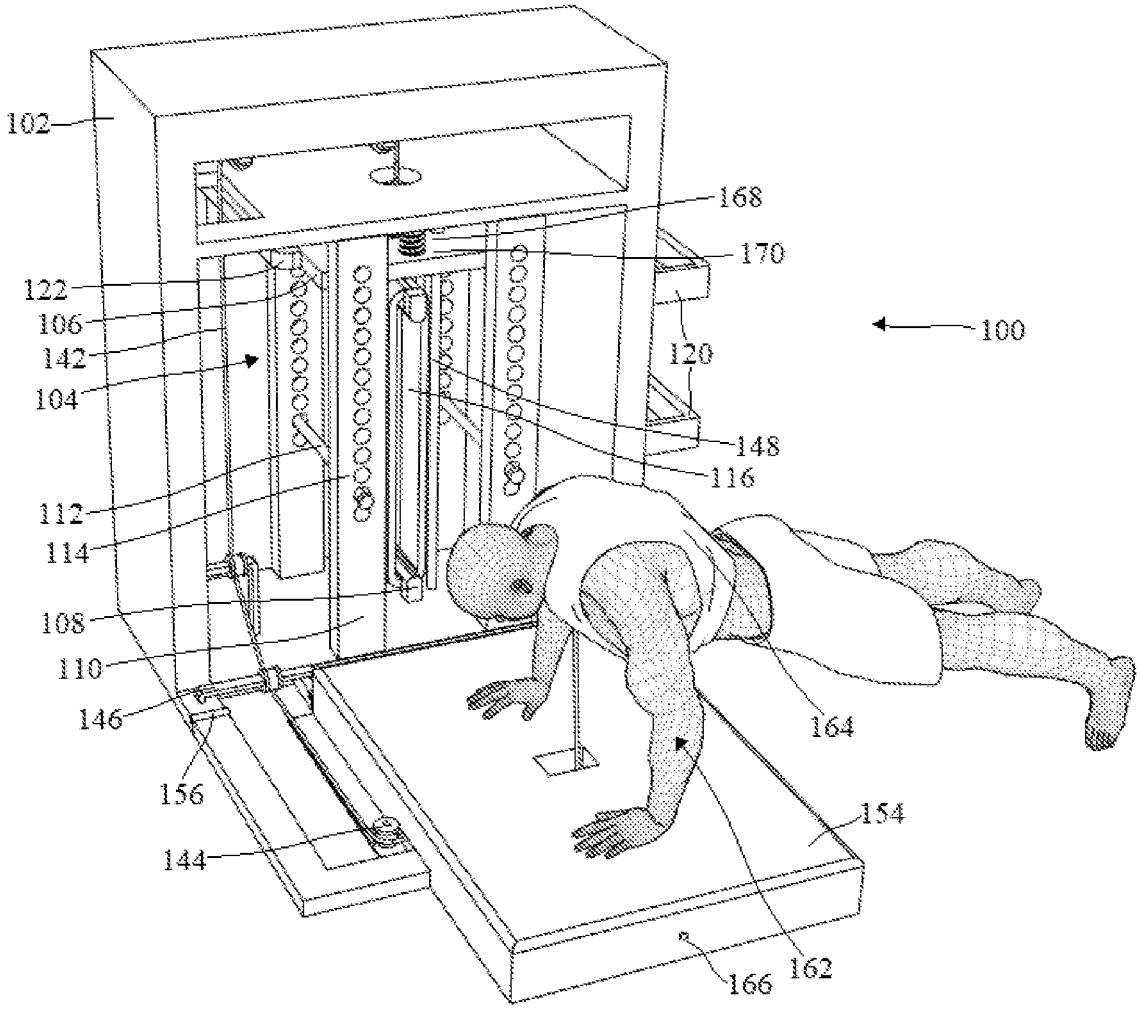
Figure 8A:
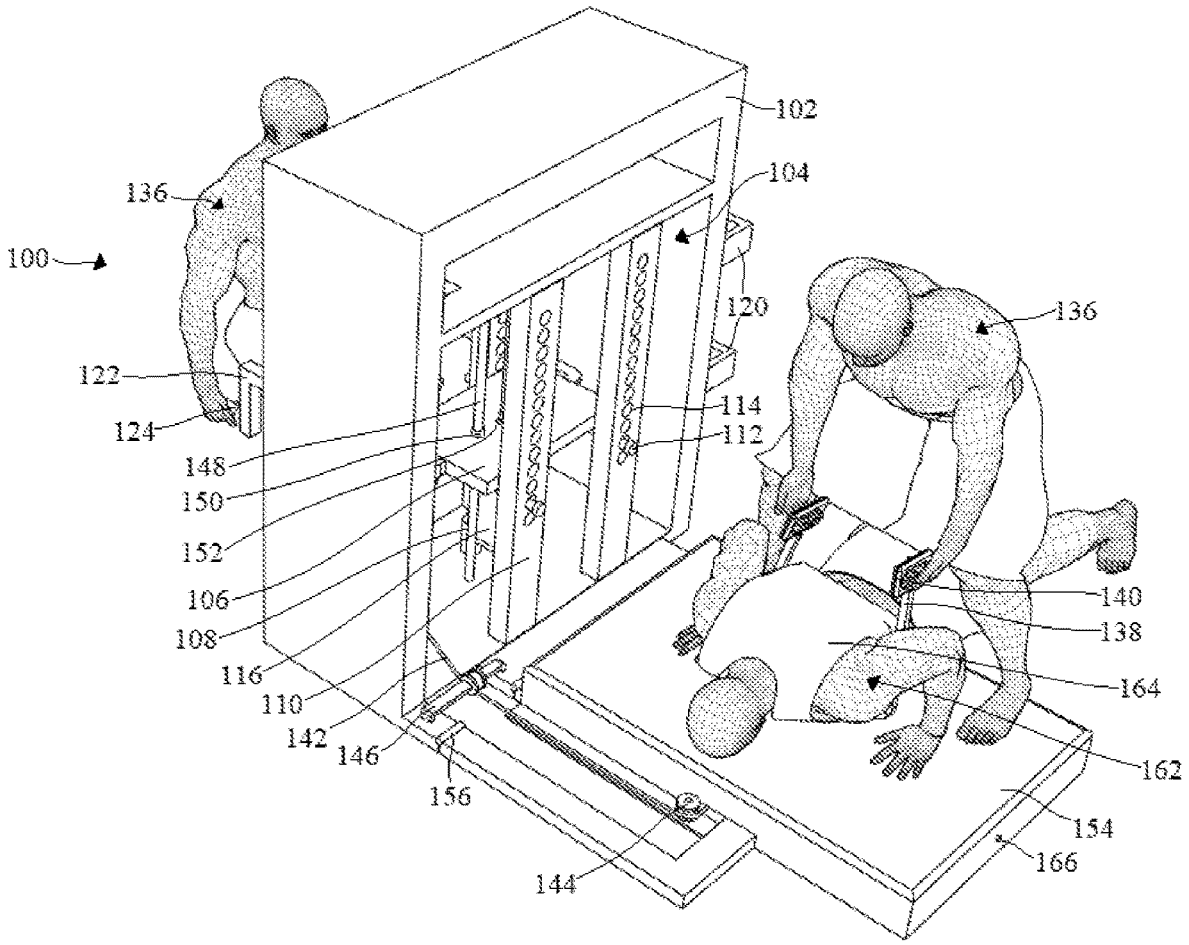
FIGS. 8A to 8F show a method of performing a negative full range of motion repetition only with interaction between user and resistance band exercise machine in accordance with another embodiment.
Figure 8B:
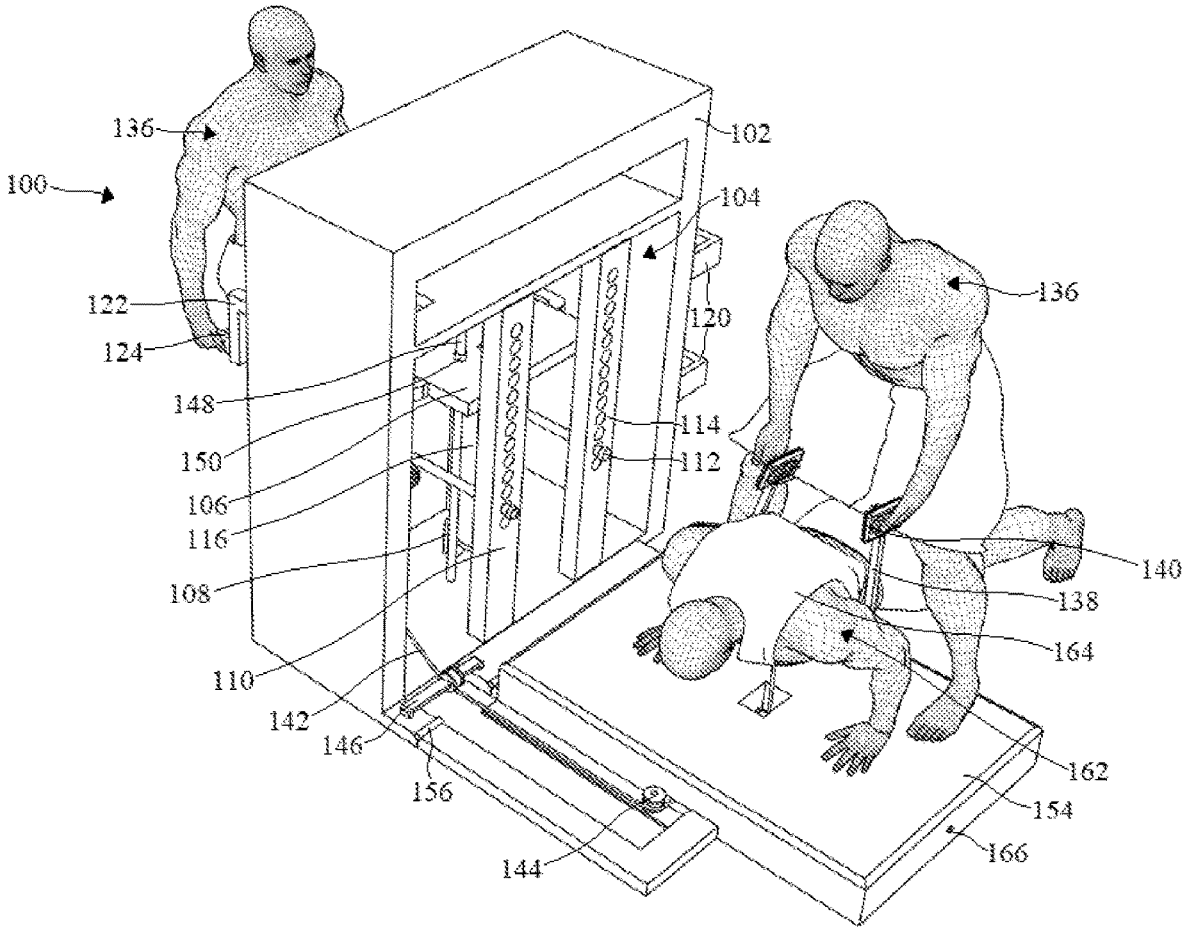
Figure 8C:
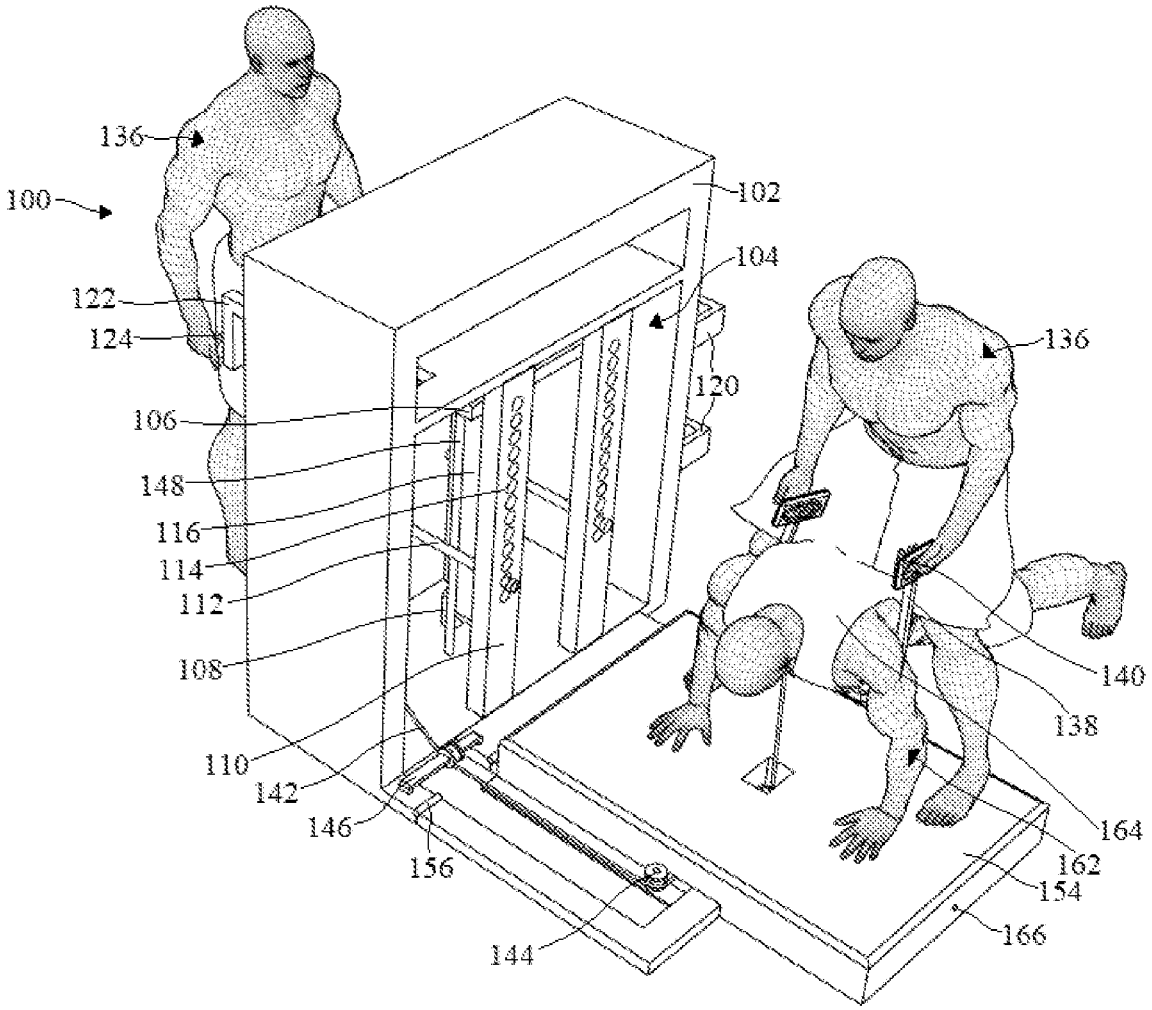
Figure 8D:
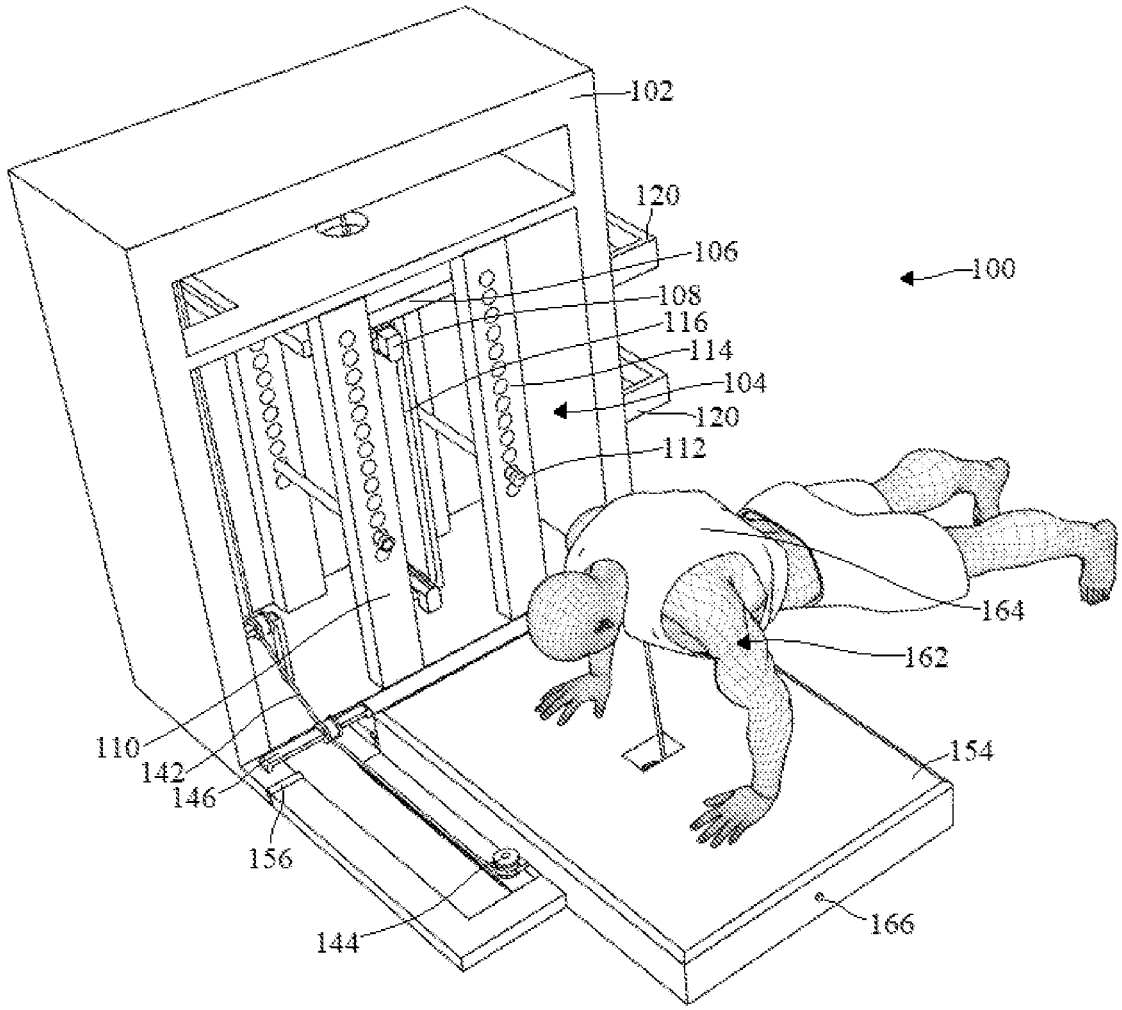
Figure 8E:
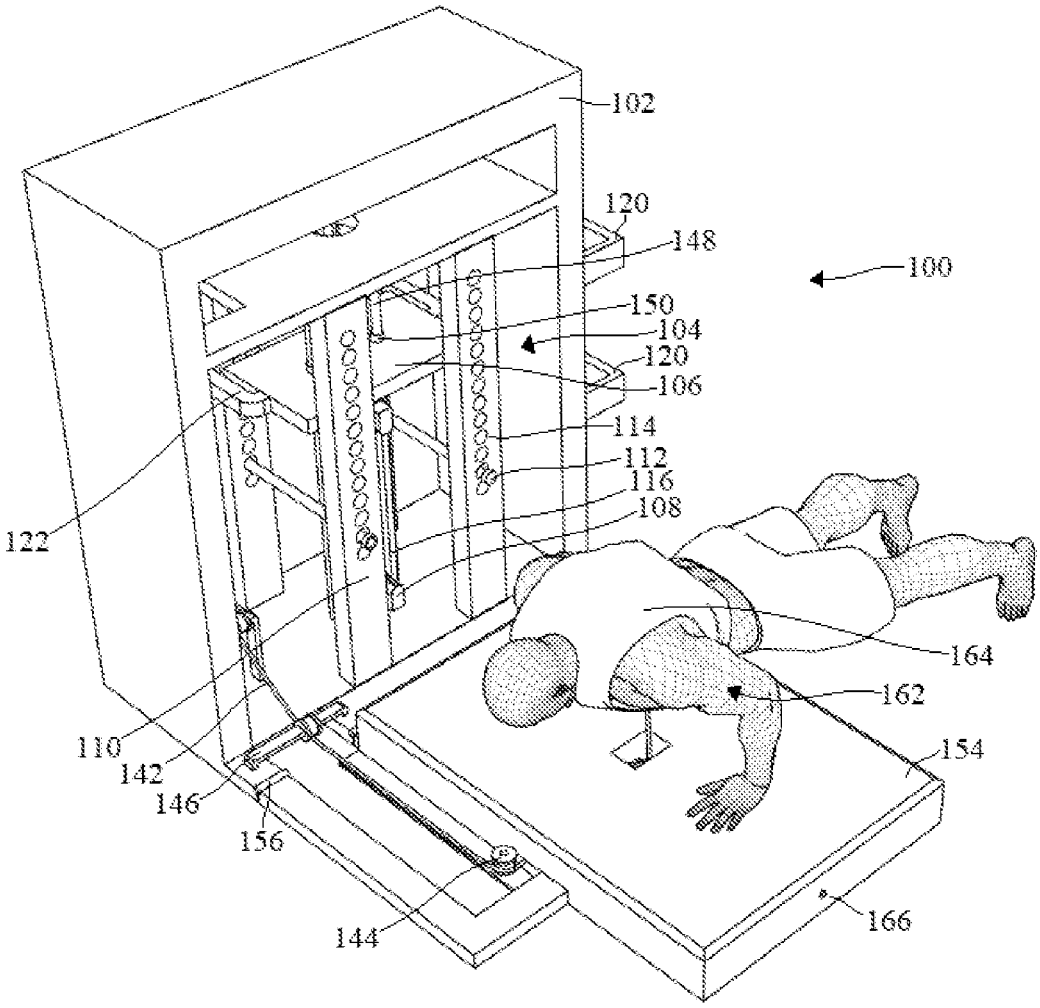
Figure 8F:
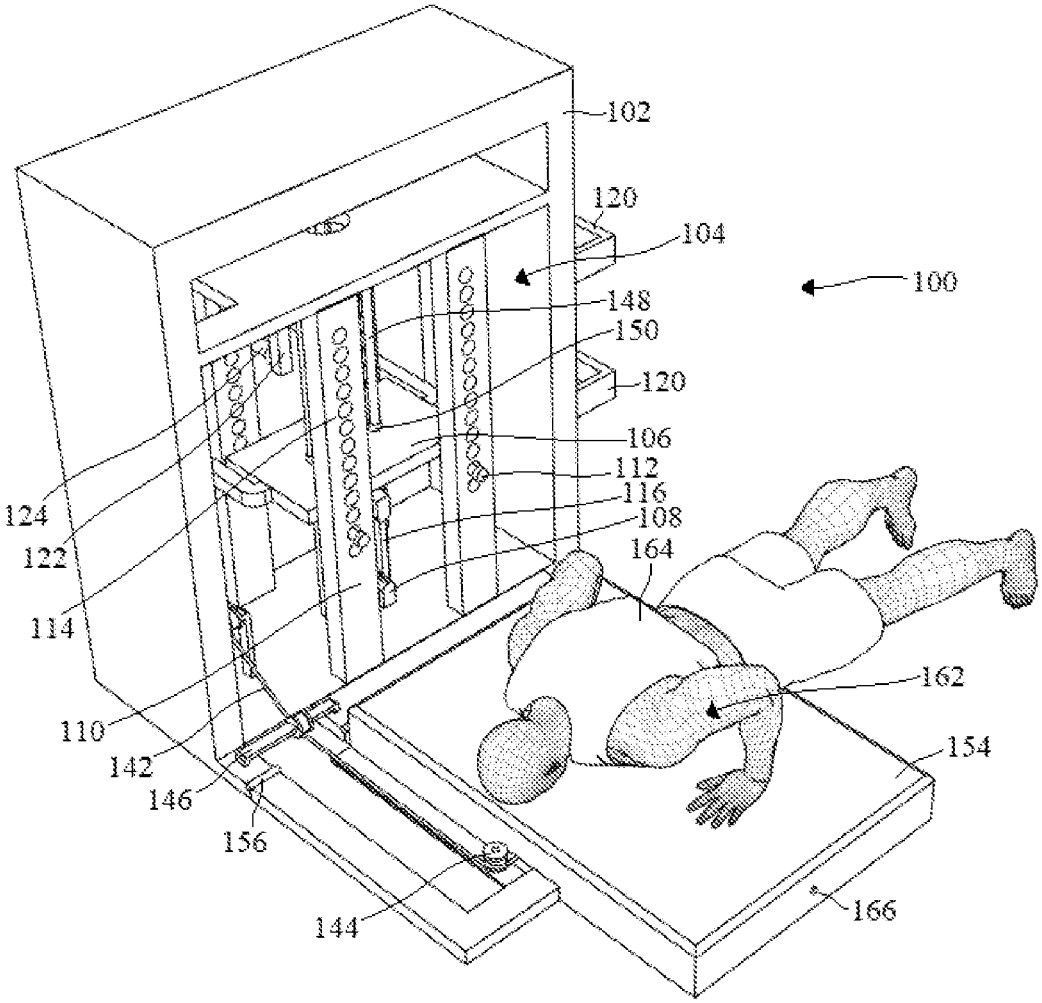
Figure 9A:
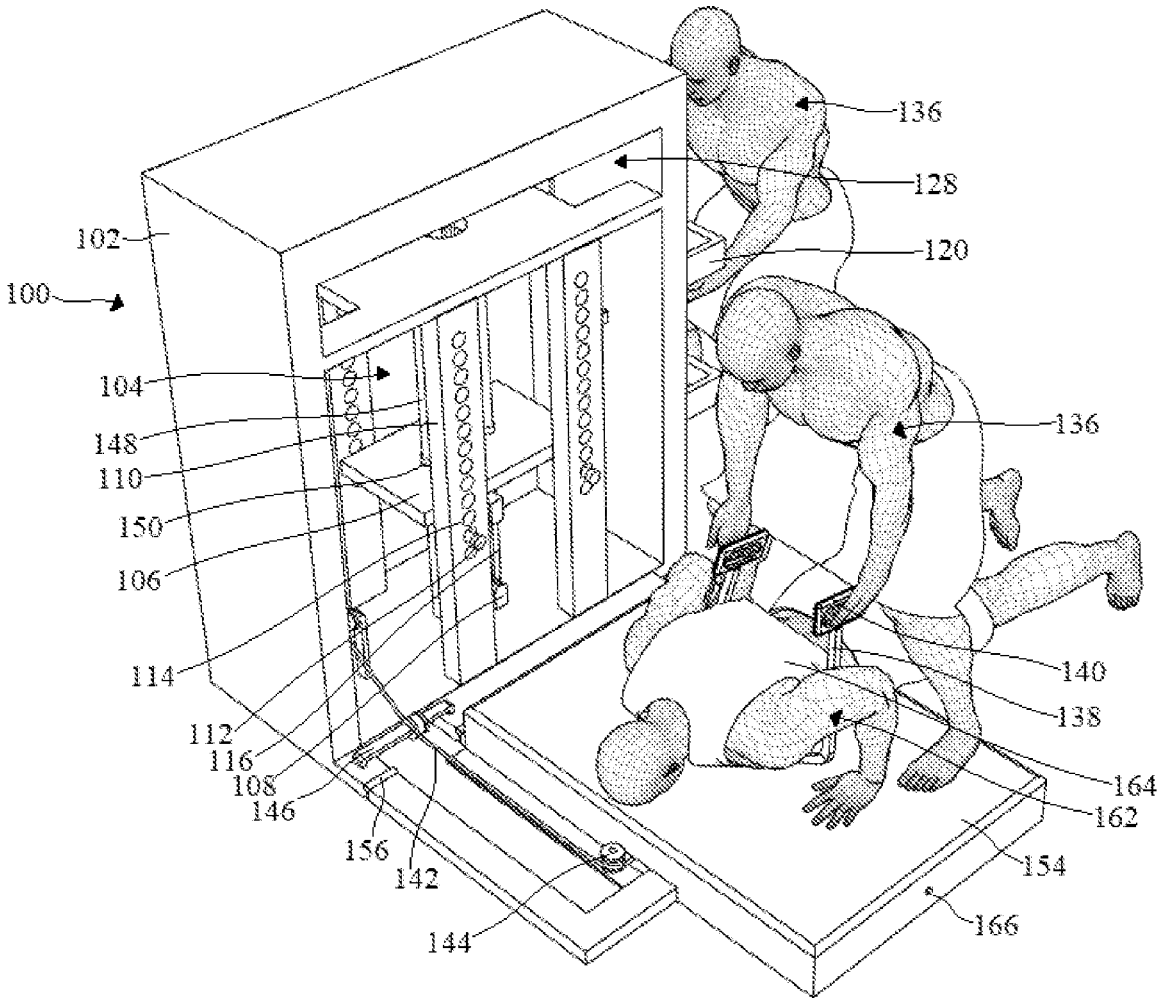
FIGS. 9A to 9F show a method of performing a negative full range of motion repetition only with interaction between user and resistance band exercise machine in accordance with another embodiment.
Figure 9B:
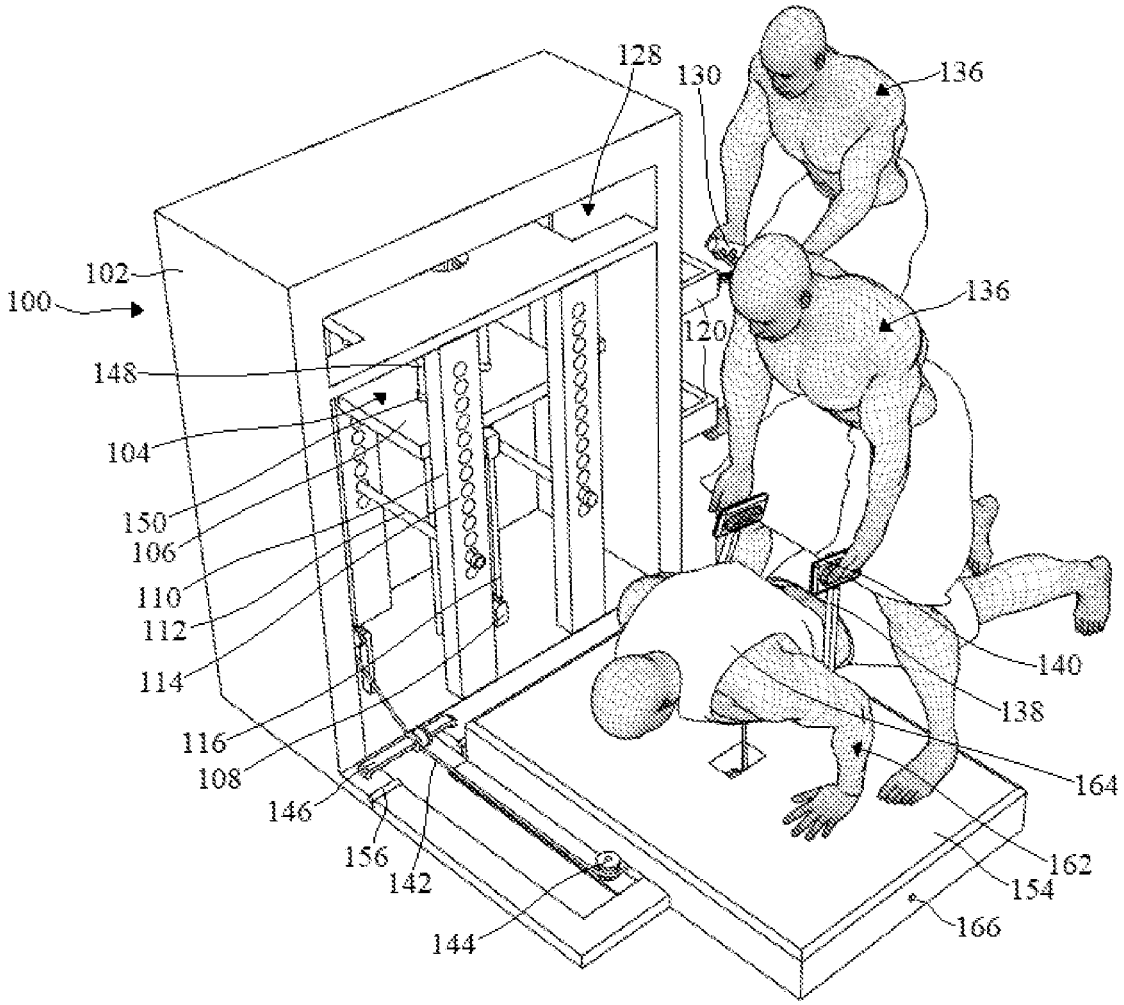
Figure 9C:
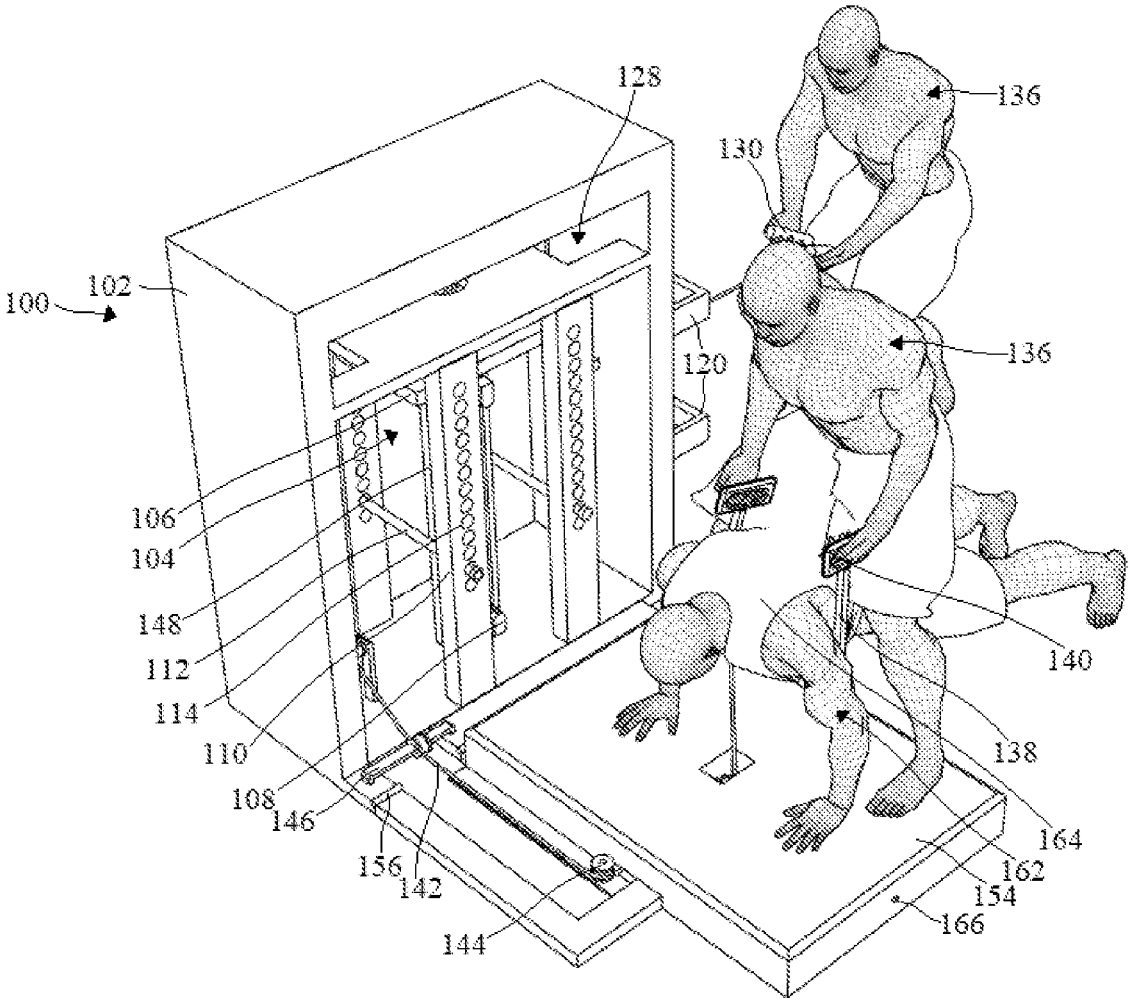
Figure 9D:
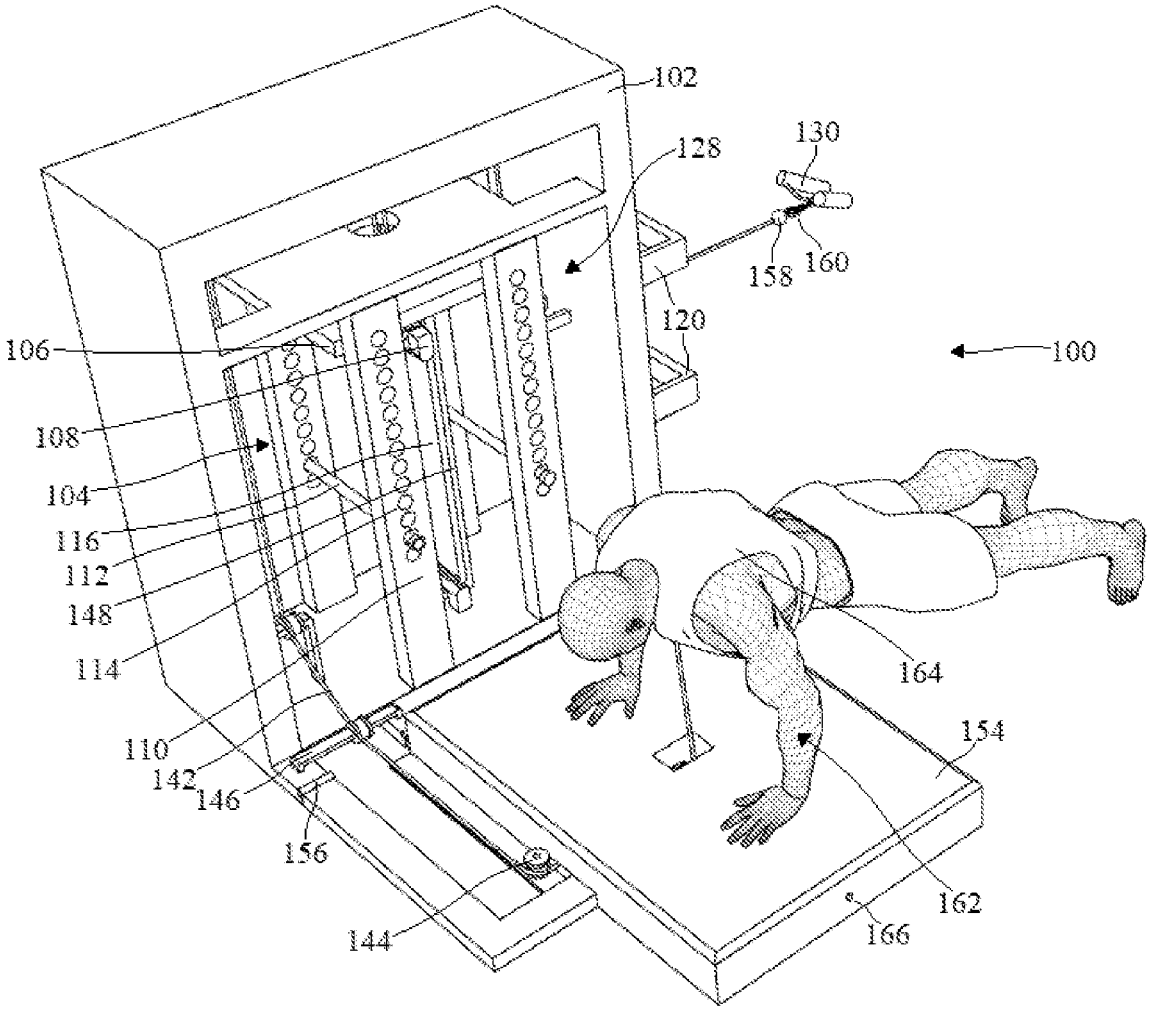
Figure 9E:
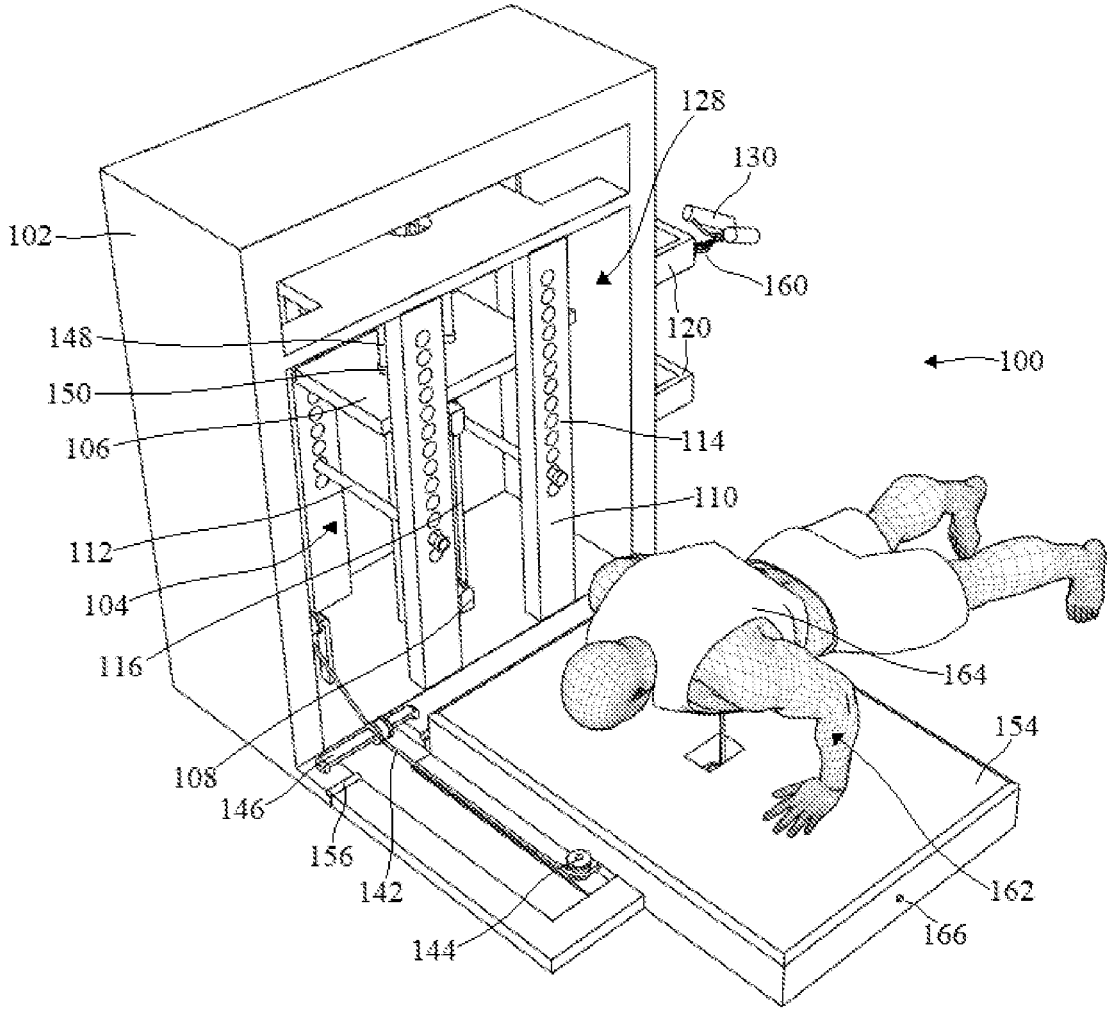
Figure 9F:
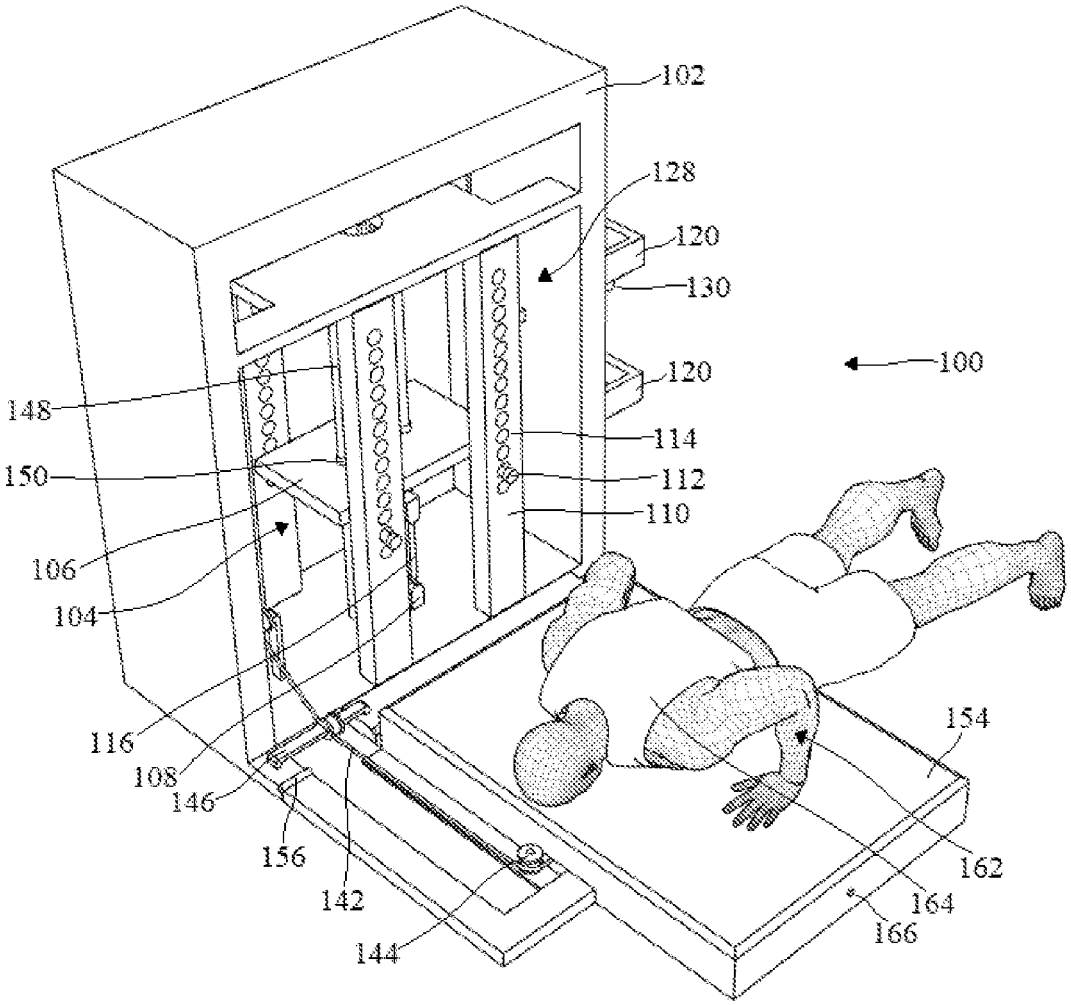

The user can add the springs by placing them on the top plate into the recessed spring pocket to perform the exercise through a full range of motion from start to end position contracting against the resistance band then the springs approaching the end position of the exercise as shown in FIGS. 7A-7C.

The user can perform full range of motion negative repetitions (lowering phase of an exercise; eccentric muscle contraction) only using training partners. One training partner lifts the user using a strap 138 with a strap handle grip 140 in this particular exercise because it's a bodyweight exercise while the other training partner assists by performing a much more powerful exercise than the exercise the user is going to perform to set the user to the end position of the exercise in order to perform full range of motion negative repetitions only. The powerful exercise the training partner performs in this scenario is deadlifts using an input lifting arm 122 with a handle grip 124 like one performing deadlifts using a trap bar or also known as hex bar as shown in FIGS. 8A-8F. In other non-bodyweight exercises, one training partner assisting by performing a more powerful exercise than the exercise the user will perform will be enough. In the absence of a training partner assistantship feature of having an input lifting arm 122 with a handle grip 124, the training partner may help the user get into the end position of an exercise by any means using exercise machine features for user to perform full range of motion negative repetitions only. Because the resistance band variably increases in resistance from start to end position of an exercise, it is easier to assist the user to get into the end position of an exercise than if fixed amounts of weights were used.

FIGS. 9A-9F, show another way the user can perform full range of motion negative repetitions only using training partners and the training partner assistantship cable-pulley system. In this scenario, the exercise the training partner performs is like pulling a rope as in a tug of war game. The difference between FIGS. 8A-8F and this is the training partner assistantship cable-pulley system. The configuration of the training partner assistantship cable-pulley system may be in any arrangement based on the exercise. With the training partner assistantship cable-pulley system, the direction of force applied by the training partner can be in any direction based on the configuration of the training partner assistantship cable-pulley system. This allows for any exercise to be performed by the training partner based on the configuration of the training partner assistantship cable-pulley system. Whereas in FIGS. 8A-8F, the direction of force applied by the training partner is upwards limiting the number of exercises that can be performed.

Figure 10A:
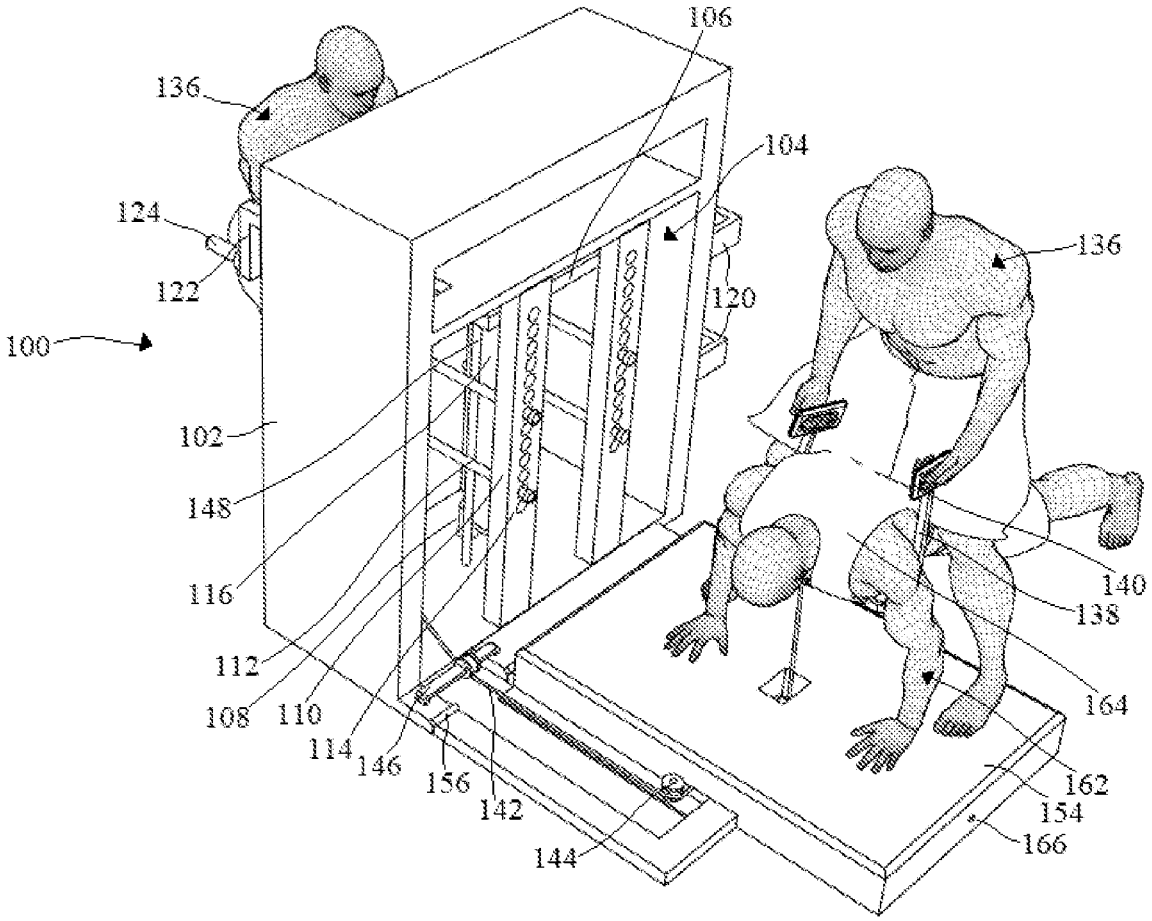
FIGS. 10A to 10C show a method of performing a negative partial range of motion repetition only and method of performing isometrics with interaction between user and resistance band exercise machine in accordance with another embodiment.
Figure 10B:
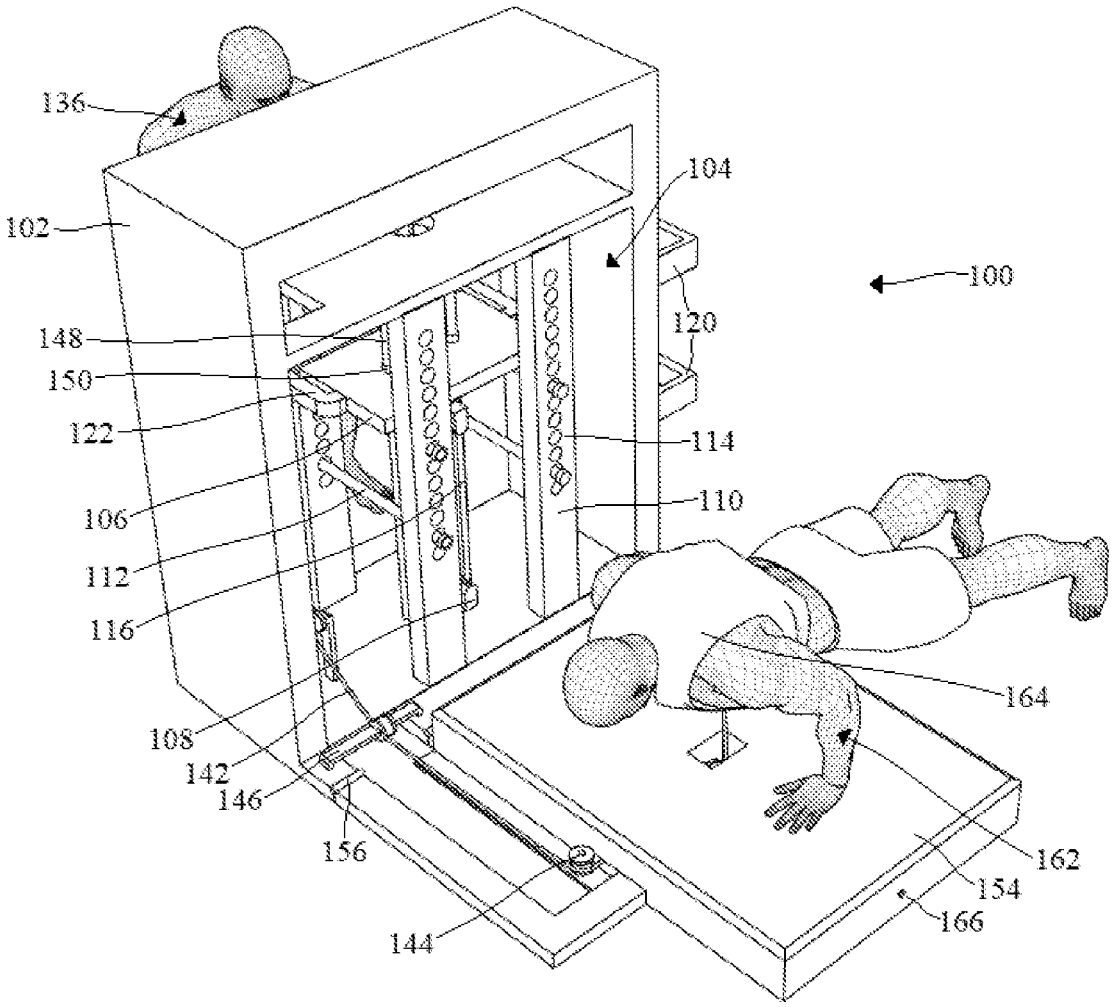
Figure 10C:
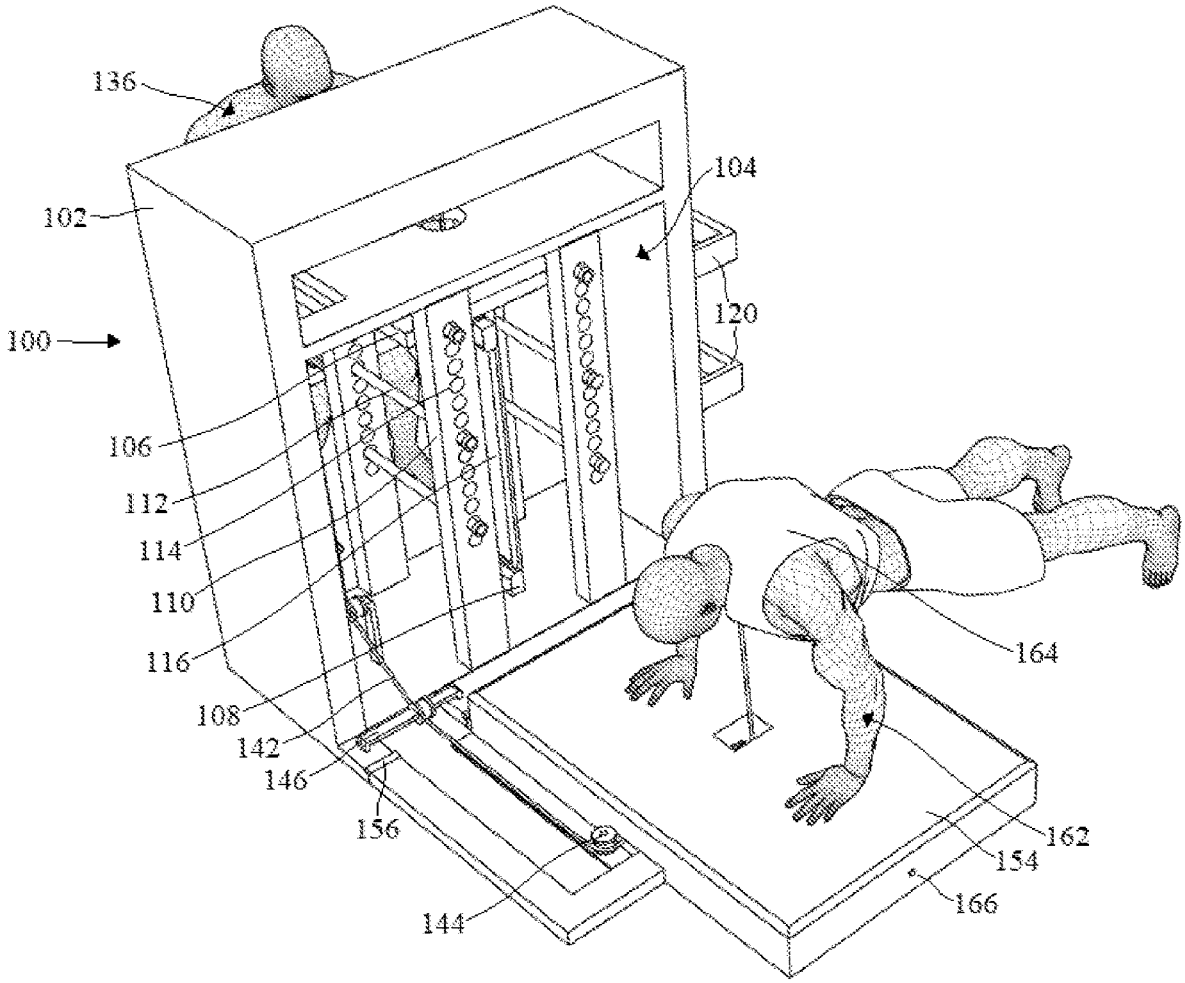

When the user cannot perform another full range of motion negative repetition only as shown in FIGS. 8A-8F, the training partners assist by lifting the user and inserting the safety bars into the safety bar hole so the user can perform negative partial range of motion repetitions as shown in FIGS. 10A and 10B. When then user cannot perform another negative partial range of motion repetition, the user performs isometrics against the safety bars as shown in FIG. 10C. The user may begin the exercise performing partial range of motion repetitions and end the exercise performing isometrics against the safety bars by having the training partners assist by lifting the user and inserting the safety bars into the safety bar hole as shown in FIGS. 10A-10C.

Figure 11A:
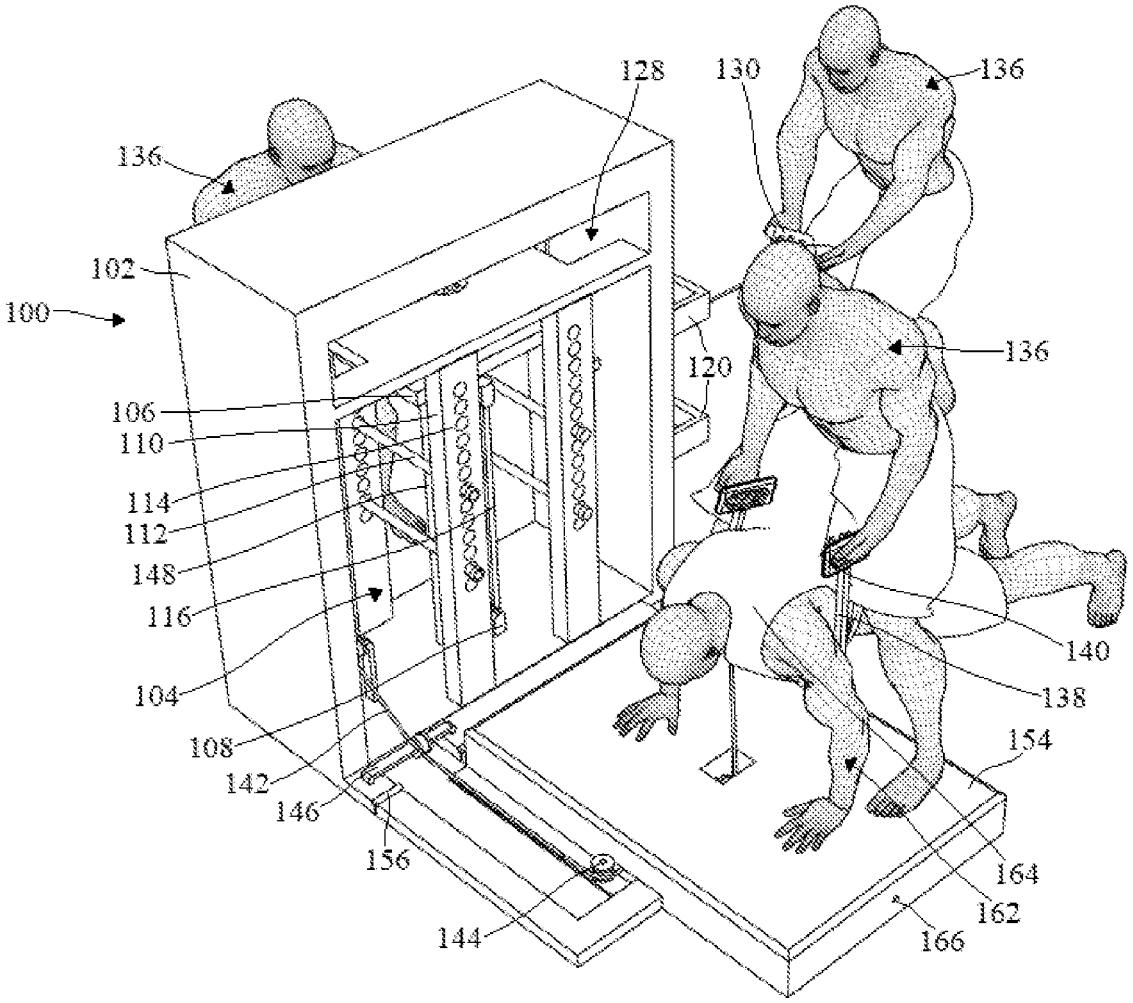
FIGS. 11A to 11D show a method of performing a negative partial range of motion repetition only and method of performing isometrics with interaction between user and resistance band exercise machine in accordance with another embodiment.
Figure 11B:
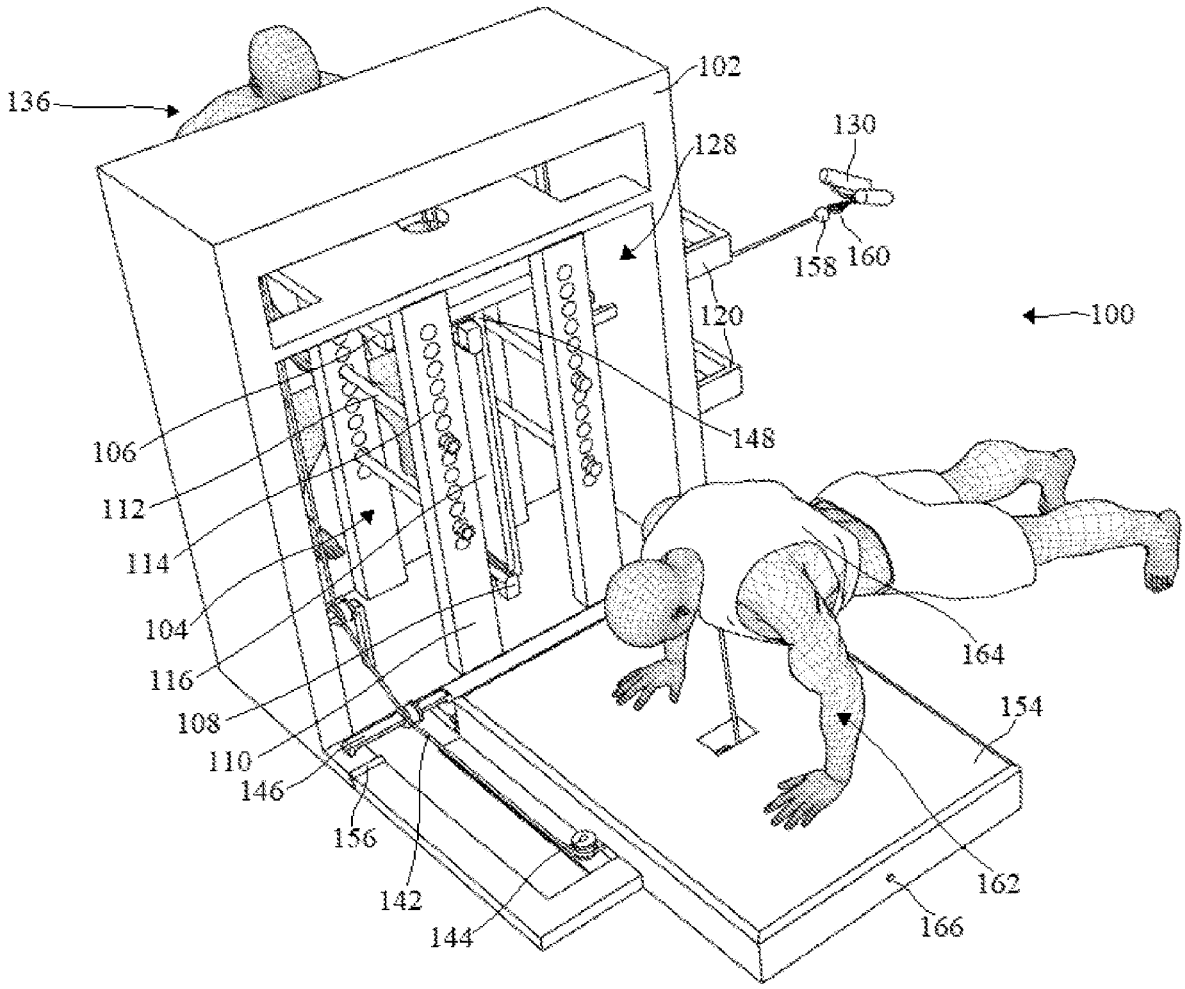
Figure 11C:
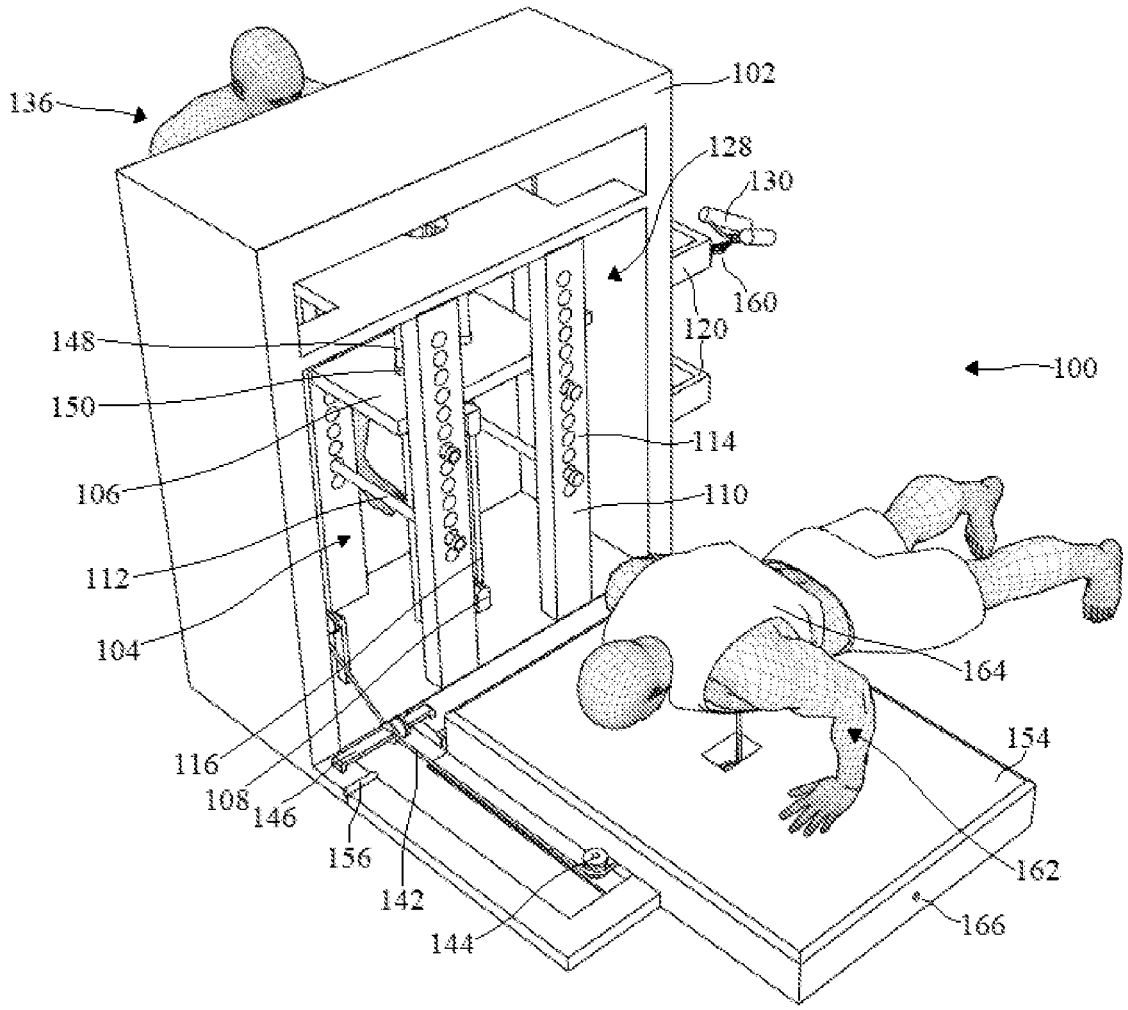
Figure 11D:
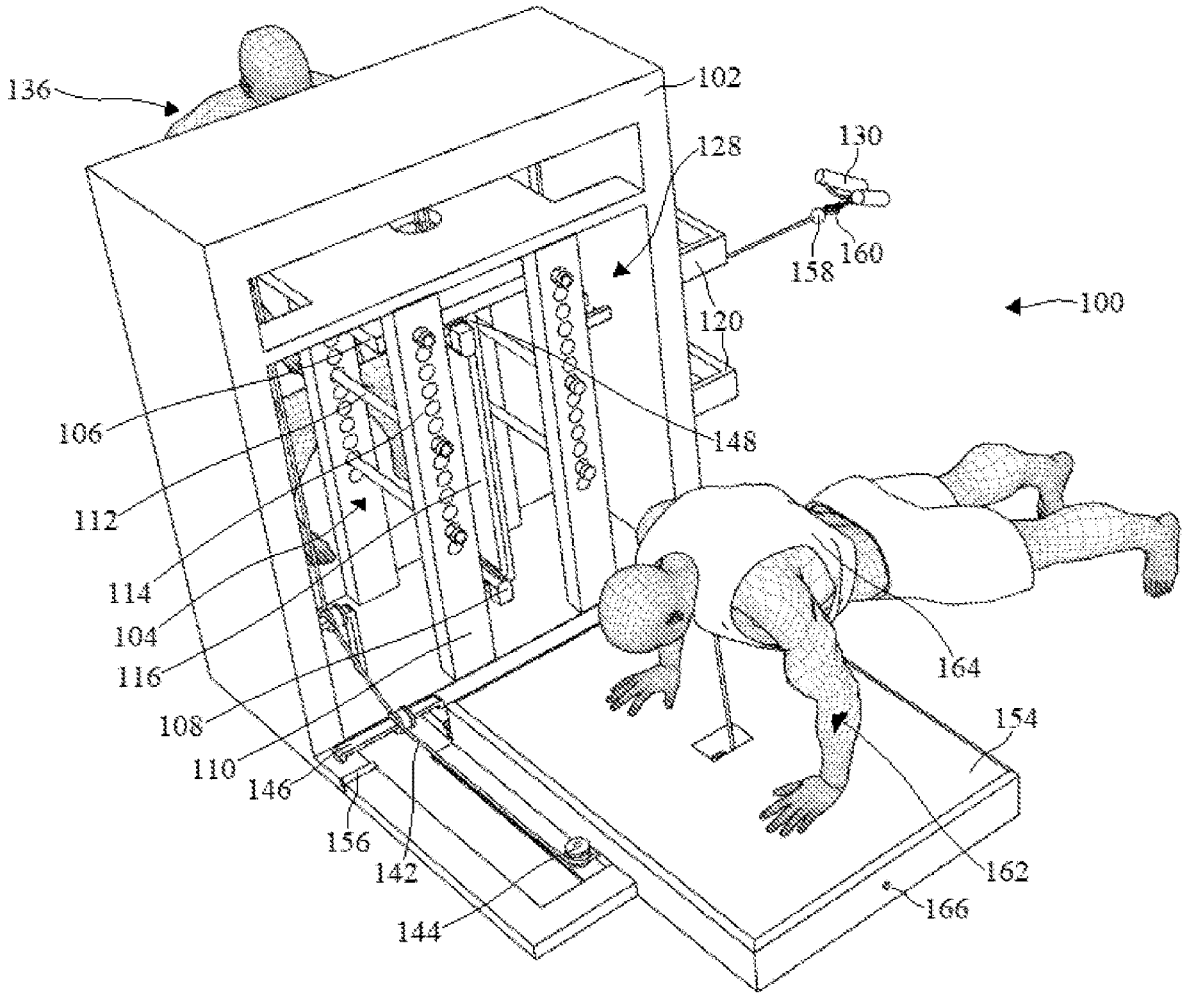

When the user cannot perform another full range of motion negative repetition only as shown in FIG. 9A-9F, the training partners assist by lifting the user and inserting the safety bars into the safety bar hole so the user can perform negative partial range of motion repetitions as shown in FIGS. 11A-11C. When the user cannot perform another negative partial range of motion repetition, the user performs isometrics against the safety bars as shown in FIG. 11D. The user may begin the exercise performing partial range of motion repetitions and end the exercise performing isometrics against the safety bars by having the training partners assist by lifting the user and inserting the safety bars into the safety bar hole as shown in FIGS. 11A-11D.

Figure 12A:
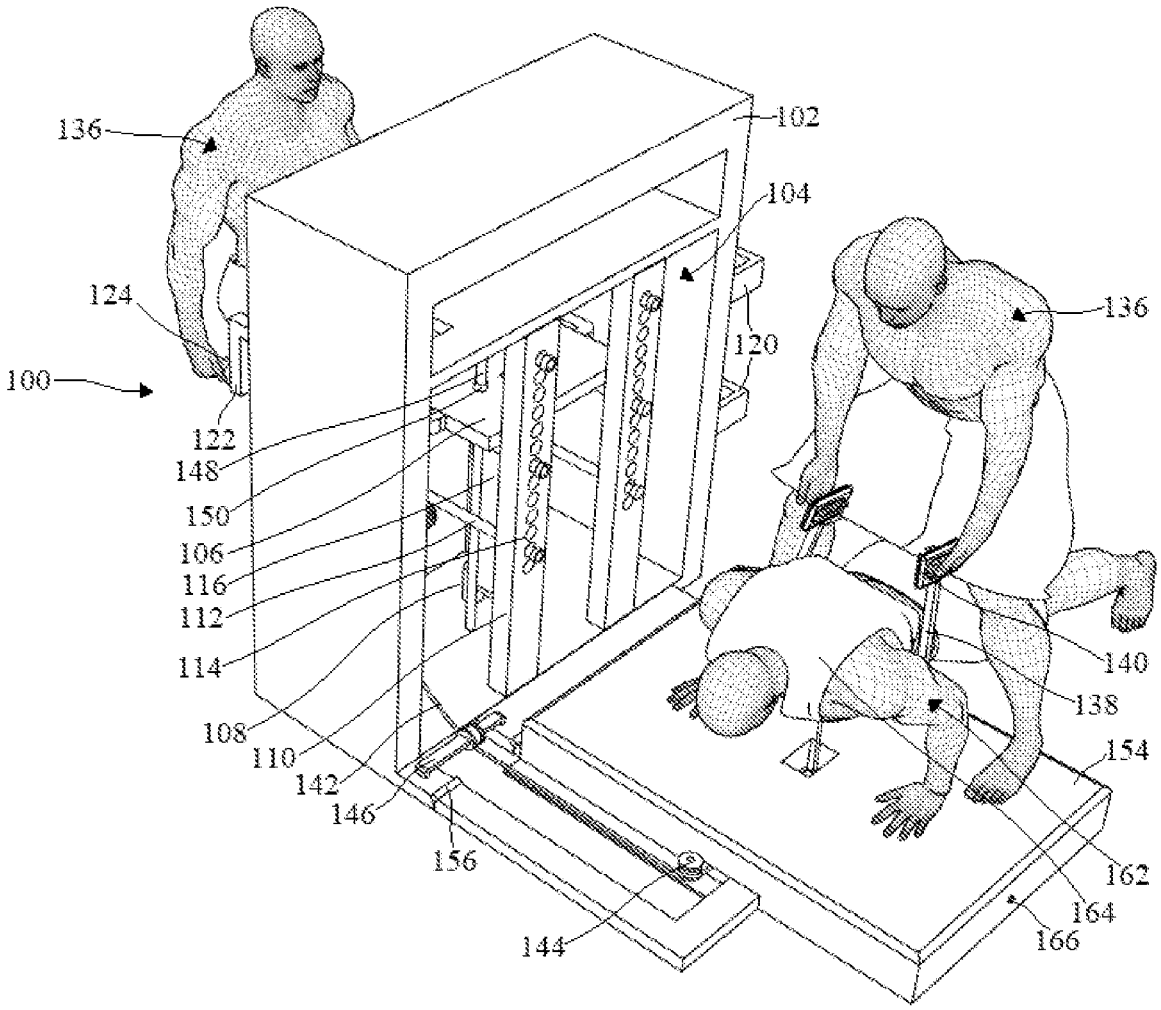
FIGS. 12A to 12C show a method of performing a negative partial range of motion repetition only with interaction between user and resistance band exercise machine in accordance with another embodiment.
Figure 12B:
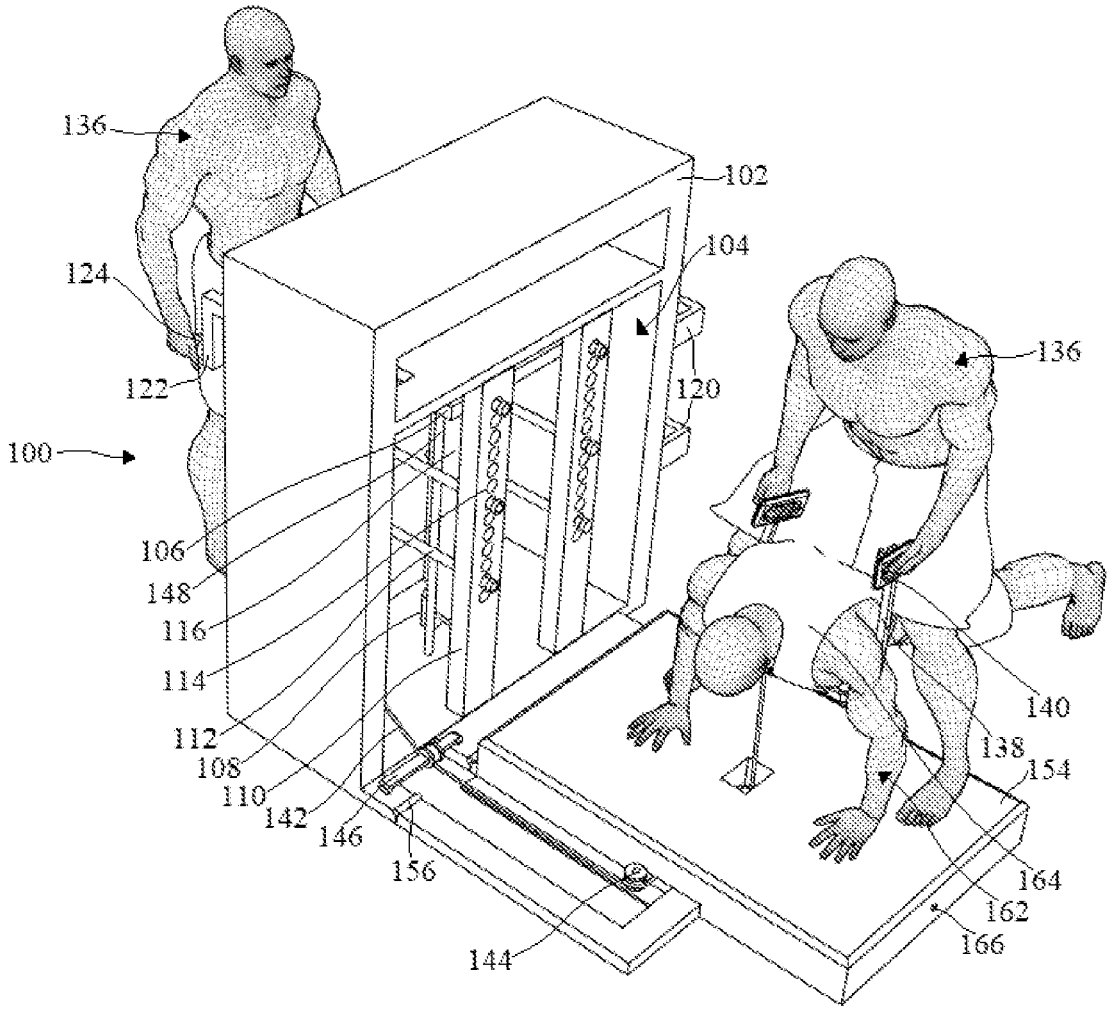
Figure 12C:
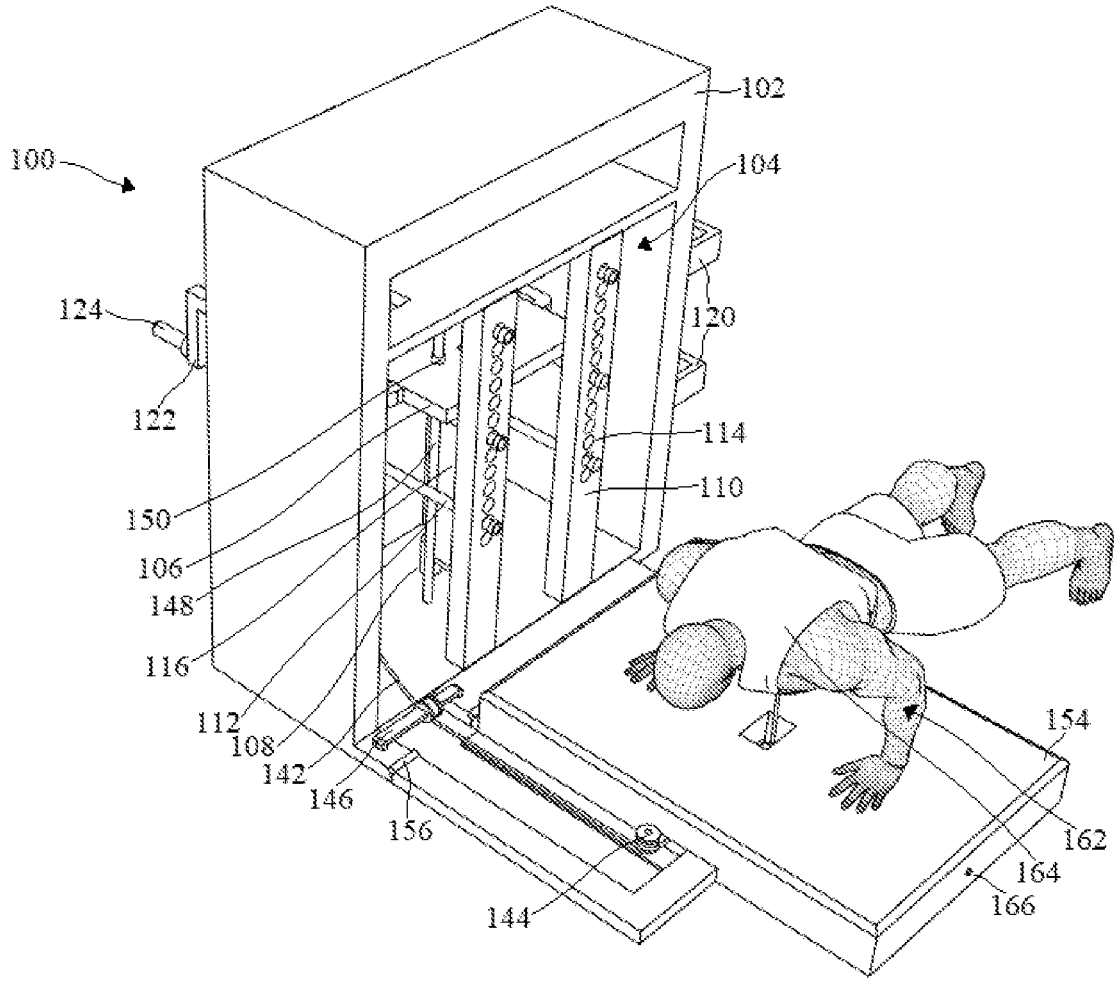
Figure 13A:
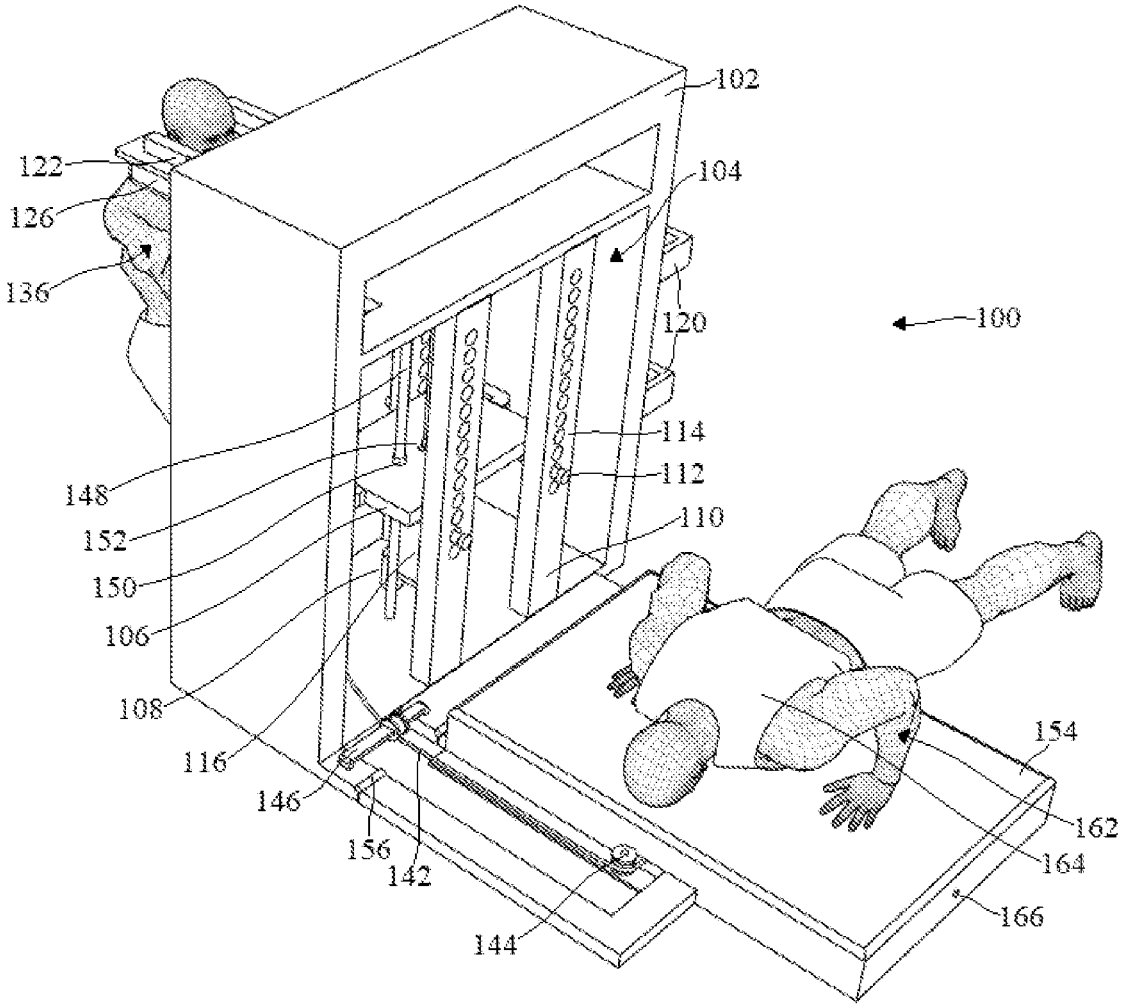
FIGS. 13A to 13F show another method of reducing an exercise's range of motion and method of performing isometrics with interaction between user and resistance band exercise machine in accordance with another embodiment.
Figure 13B:
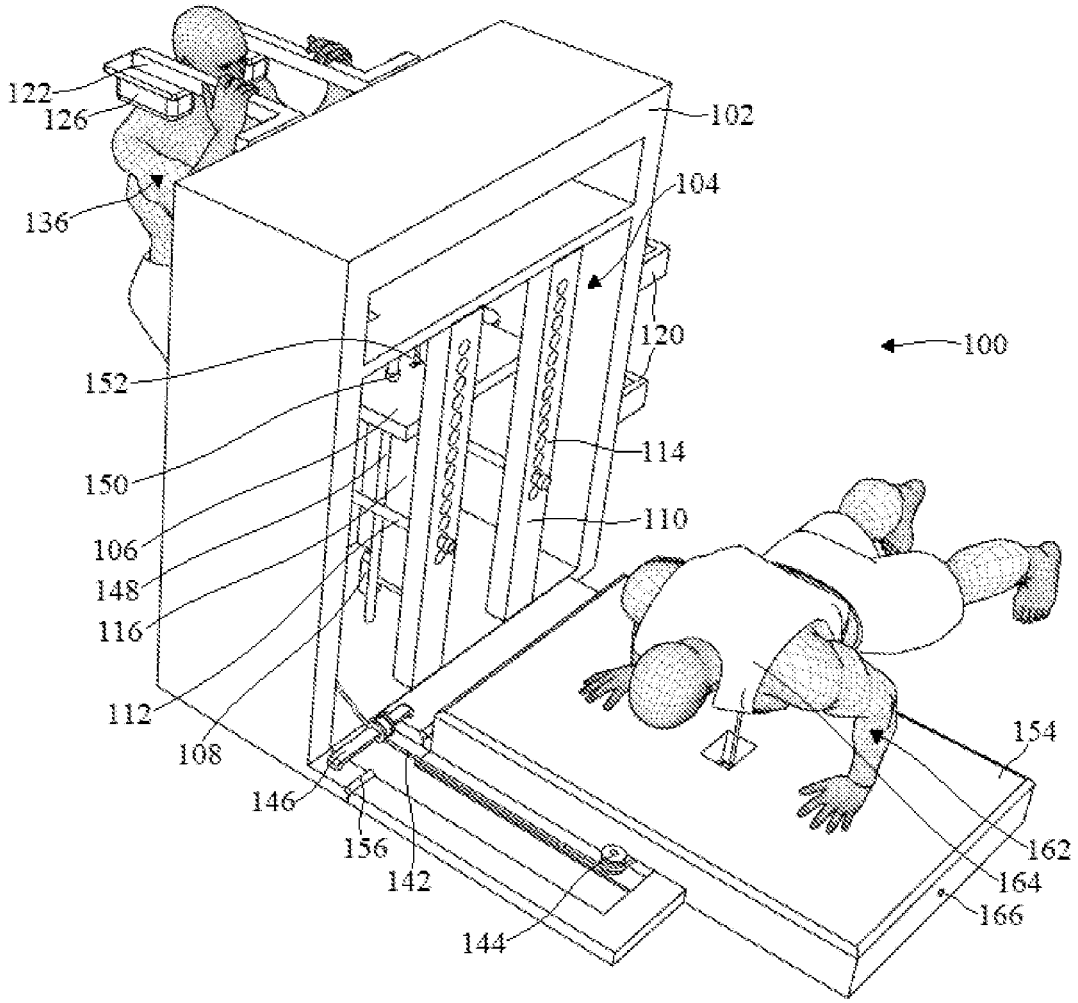
Figure 13C:
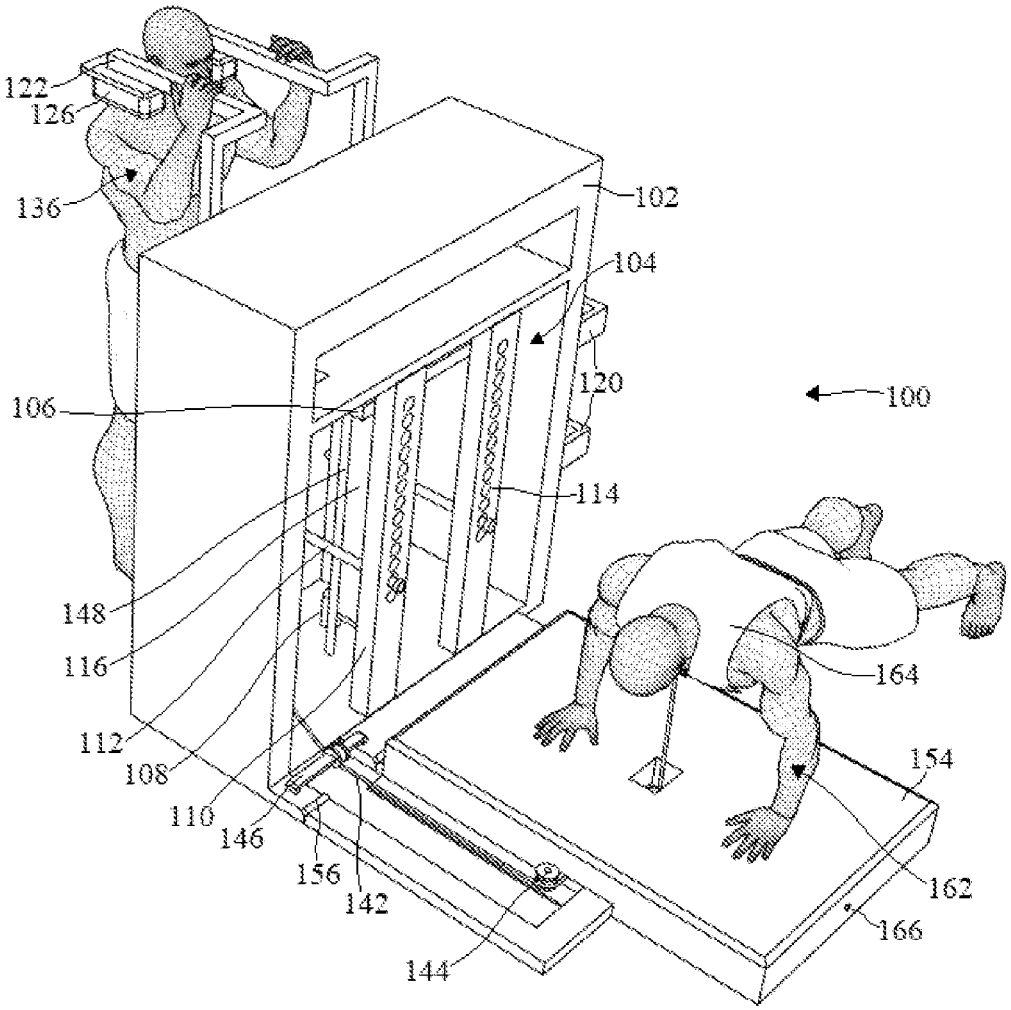
Figure 13D:
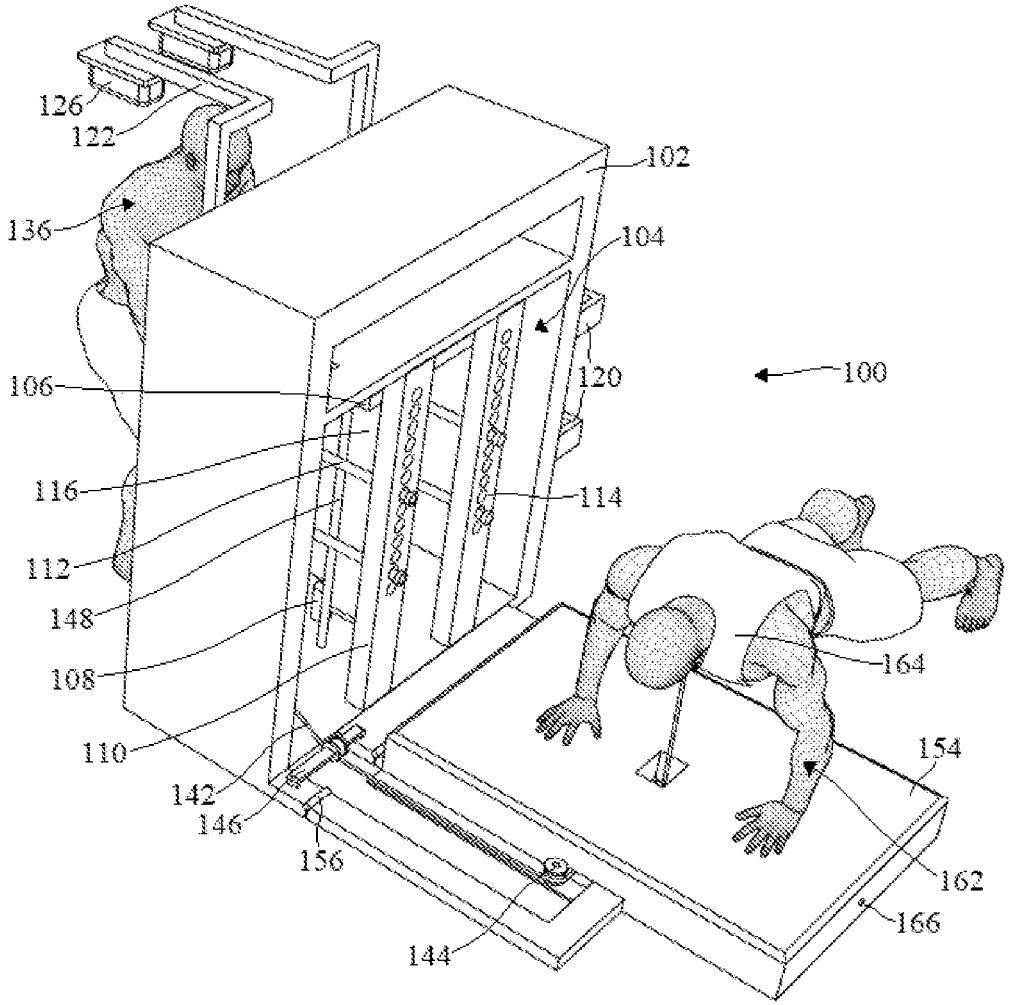
Figure 13E:
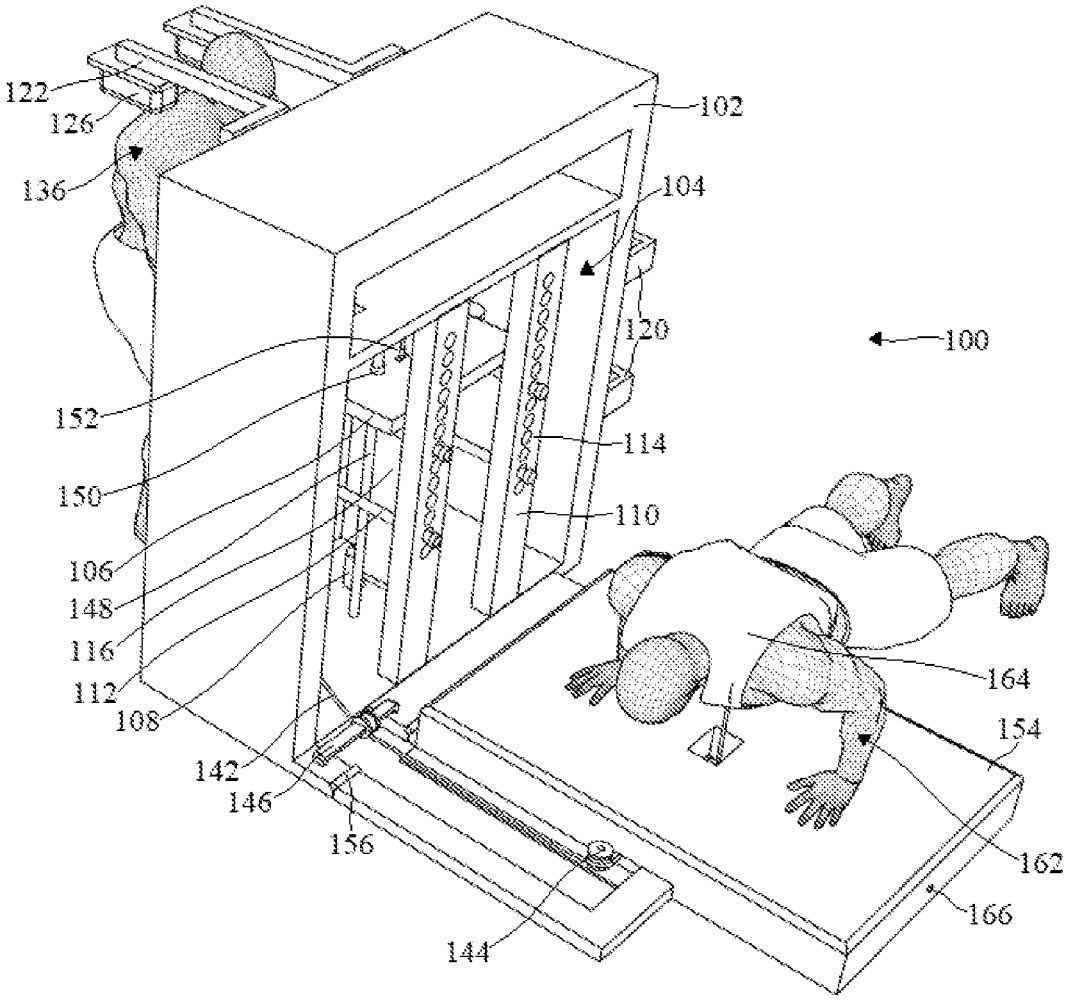
Figure 13F:
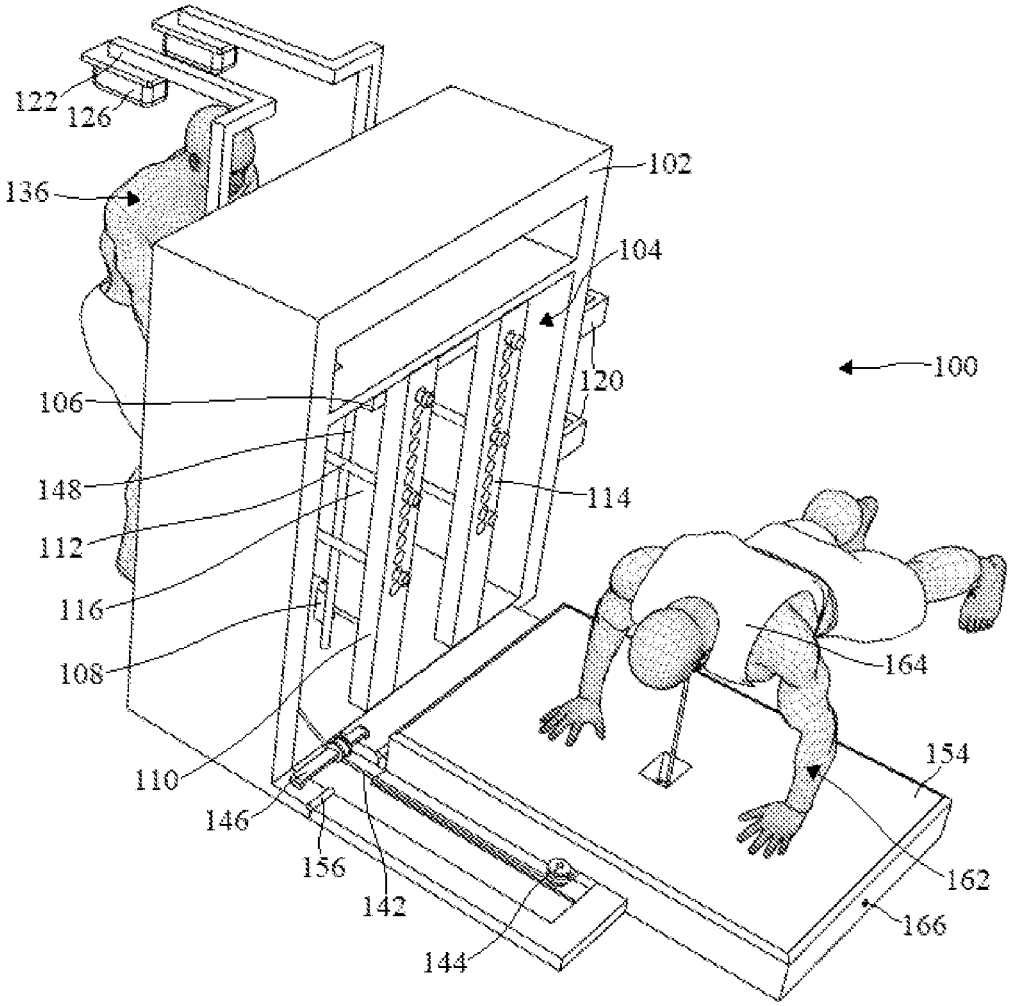

After the user is done performing partial range of motion repetitions and isometrics against the safety bars, the training partners can assist the user to perform negative partial range of motion repetitions as shown in FIGS. 12A-12C.

FIGS. 13A-13F, show the training partner assisting the user to get into the end position of the exercise by performing squats using the input lifting arm and the shoulder padding then inserting the safety bars into the safety bar hole so the user can perform partial range of motion repetitions then end the exercise performing isometrics against the safety bars.

DRAWINGS—REFERENCE NUMERALS

| | |
|---|---|
| 100 resistance band exercise machine | 102 cable-pulley variable resistance system housing |
| 104 cable-pulley variable resistance system | 106 top plate |
| 108 resistance band hook | 110 uprights |
| 112 safety bars | 114 safety bar hole |
| 116 resistance band | 118 joined safety bar |
| 120 container | 122 input lifting arm |
| 124 handle grip | 126 shoulder padding |
| 128 training partner assistantship cable-pulley system | 130 exercise handle attachment |
| 132 snap link hook | 134 O ring |
| 136 training partner | 138 strap |
| 140 strap handle grip | 142 cable |
| 144 pulley | 146 pulley mounts |
| 148 guide rods | 150 shaft collar |
| 152 cable-to-top plate adapter | 154 platform |
| 156 hinge | 158 cable stopper ball |
| 160 cable thimble | 162 user |
| 164 harness or belt | 166 rod |
| 168 springs | 170 recessed spring pocket |

Advantages

From the description above, a number of advantages of my resistance band exercise machine become evident:

(a) The user can perform full/partial range of motion push-up exercises in the prone position with their hands on the platform of the resistance band exercise machine against primary and secondary sources of variably increasing resistance.

(b) The user can perform full/partial range of motion push-up exercises in the prone position with their hands on the platform of the resistance band exercise machine against primary source of variably increasing resistance with isometrics using safety bars.

(c) The user can perform push-up exercises in the prone position with their hands on the platform of the resistance band exercise machine against primary and secondary sources of variably increasing resistance using full/partial range of motion negative repetitions only with the help of training partners.

(d) The user can perform isolation (single-joint) and compound (multi-joint) movement exercises contracting against primary and secondary sources of variably increasing resistance in proper form utilizing cable pulley systems and the ergonomic/biomechanical design features of weightlifting exercise machines. This allows the user to contract against variably increasing resistance along the direction of the muscle group's muscle fibers.

(e) The user can perform isolation (single-joint) and compound (multi-joint) movement exercises against primary source of variably increasing resistance through full/partial range of motion with isometrics using safety bars.

(f) The user can perform isolation (single-joint) and compound (multi-joint) movement exercises against primary and secondary sources of variably increasing resistance using full/partial range of motion negative repetitions only with the help of training partners.

CONCLUSION, RAMIFICATIONS, AND SCOPE

Accordingly, the reader will see that the resistance band exercise machine allows a user to perform exercises including exercises from U.S. patent application publication 20190374814-A1 through dynamic motion (full range motion and partial range of motion), full/partial range of motion negative repetitions only using training partners, and static position (yielding isometrics and overcoming isometrics) using primary and secondary sources of variably increasing resistance as well as safety bars in one machine. Also, the user can quickly change the resistance level and multiple users can perform push-up exercises in the prone position together assisting one another with no muscular effort lost. In addition, the user can perform more repetitions in the strong range of motion (from mid to end position of an exercise) using primary and secondary sources of variably increasing resistance with the help of training partners. Furthermore, the resistance band exercise machine has the additional advantages in that:

it allows the user to perform exercises along the direction of the muscle group's muscle fibers with comfort and proper form using primary and secondary sources of variably increasing resistance, cable pulley system, and ergonomic/biomechanical design features of exercise machines.

it allows the user to train a muscle group to its maximum strength capability by increasing the variability in resistance level using primary and secondary sources of variably increasing resistance to match a muscle group's strength curve.

it allows the user to perform exercises using isometronics training protocol which is a combination of isometric and isotonic exercises in one machine.

it allows the user to perform more full/partial range of motion negative repetitions only against variably decreasing resistances from primary and secondary sources of resistances with the help of training partners.

The above described embodiment is not intended to limit the scope of the present invention, as one skilled in the art can, in view of the present invention, expand such embodiment to correspond with the subject matter of the present invention claimed below. Therefore, all such substitutions and modifications are intended to be embraced within the scope of the invention as defined in the appended claims.

SEQUENCE LISTING

Not Applicable

We claim:

1. A resistance member exercise machine, the exercise machine comprising:

a cable-pulley variable resistance system housing having a cable-pulley variable resistance system, the cable-pulley variable resistance system including a moveable top plate operably connectable to a resistance member;

a cable attached to the top plate, wherein the cable is configured to enable a user to apply a force to move the top plate;

a pair of uprights configured to receive at least one safety bar extending therethrough to reduce a range of motion and set a starting position of an exercise by placing the top plate on said at least one safety bar; and a platform extending from a front portion of the cable-pulley variable resistance system housing through which the cable-pulley variable resistance system is routed such that the cable from the cable-pulley variable resistance system is positioned at a midpoint of the platform;

wherein the platform is configured such that the user is capable of performing push up exercises thereon while engaging with the cable;

whereby the cable-pulley variable system is configured such that the user is capable of imparting a force on the cable to overcome a resistance force from the resistance member and move the top plate from its starting position.

2. The machine of claim 1, further including a secondary resistance member configured to apply a secondary resistance force on the top plate when the top plate reaches a predetermined distance from an upper end of the cable-pulley variable resistance system housing.

3. The machine of claim 2, wherein the secondary resistance member is one or more springs.

4. The machine of claim 1, further including a training partner assistantship feature operably connected to the top plate, wherein the training partner assistantship feature is configured to allow another user to impart a force onto the top plate via the training partner assistantship feature.

5. The machine of claim 4, wherein the training partner assistantship feature includes a lifting arm with a handle grip and/or a shoulder padding.

6. The machine of claim 1, further including a user-wearable device having a snap link hook configured to connect to the cable to allow the user to perform push-up exercises in the prone position with their hands on said platform to overcome resistance force from the resistance member.

7. The machine of claim 1, wherein the resistance member is a resistance band.

8. The machine of claim 1, further including:

a first hook on the top plate;

a second hook secured proximate to a lower end of the cable-pulley variable resistance system housing; and whereby the resistance member is configured to be looped around the first and second hooks.

9. A resistance member exercise machine, the exercise machine comprising:

a cable-pulley variable resistance system housing having a cable-pulley variable resistance system, the cable-pulley variable resistance system including a moveable top plate operably connectable to a resistance member;

a cable attached to the top plate, wherein the cable is configured to enable a user to apply an initial force to move the top plate while performing an exercise with the resistance member exercise machine;

a training partner assistantship feature operably connected to the top plate, wherein the training partner assistantship feature is configured to allow another user to impart a secondary force onto the top plate via the training partner assistantship feature; and a platform extending from a front portion of the cable-pulley variable resistance system housing through which the cable-pulley variable resistance system is routed such that the cable from the cable-pulley variable resistance system is positioned at a midpoint of the platform;

wherein the platform is configured such that the user is capable of performing push up exercises thereon while engaging with the cable;

whereby the cable-pulley variable resistance system is configured such that the user is capable of imparting the initial force onto the cable to overcome a resistance force from the resistance member and move the top plate from its starting position and another user is capable of assisting in moving the top plate by imparting the secondary force onto the top plate.

10. The machine of claim 9, a pair of uprights configured to receive at least one safety bar to reduce a range of motion and set a starting position of an exercise by placing the top plate on said safety bars.

11. The machine of claim 9, further including a user-wearable device having a snap link hook configured to connect to the cable to allow the user to perform push-up exercises in the prone position with their hands on said platform to overcome resistance force from the resistance member.

12. The machine of claim 9, wherein the resistance member is a resistance band.

13. The machine of claim 9, further including a secondary resistance member configured to apply a secondary resistance force on the top plate when the top plate reaches a predetermined distance from an upper end of the cable-pulley variable resistance system housing.

14. The machine of claim 9, wherein the training partner assistantship feature includes a lifting arm with a handle grip and/or a shoulder padding.

15. The machine of claim 9, further including:

a first hook on the top plate;

a second hook secured proximate to a lower end of the cable-pulley variable resistance system housing; and whereby the resistance member is configured to be looped around the first and second hooks.

* * * * *